US009501962B2

(12) United States Patent
Ando et al.

(10) Patent No.: US 9,501,962 B2
(45) Date of Patent: Nov. 22, 2016

(54) IMAGE DISPLAY DEVICE

(71) Applicant: CANON KABUSHIKI KAISHA, Tokyo (JP)

(72) Inventors: Muneki Ando, Kawasaki (JP); Yoshiki Ishii, Yokohama (JP); Kousei Sugimoto, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 249 days.

(21) Appl. No.: 14/219,354

(22) Filed: Mar. 19, 2014

(65) Prior Publication Data

US 2014/0292834 A1 Oct. 2, 2014

(30) Foreign Application Priority Data

Mar. 27, 2013 (JP) ..... 2013-066613
Dec. 16, 2013 (JP) ..... 2013-259258

(51) Int. Cl.
*G09G 3/34* (2006.01)
*G09G 3/20* (2006.01)

(52) U.S. Cl.
CPC ..... *G09G 3/2022* (2013.01); *G09G 3/20* (2013.01); *G09G 2310/0235* (2013.01); *G09G 2320/0242* (2013.01); *G09G 2320/0666* (2013.01); *G09G 2340/06* (2013.01); *G09G 2360/16* (2013.01)

(58) Field of Classification Search
CPC ..... G09G 3/3413
See application file for complete search history.

(56) References Cited

U.S. PATENT DOCUMENTS

| | | | |
|---|---|---|---|
| 7,053,888 | B2 | 5/2006 | Ando |
| 7,218,316 | B2 | 5/2007 | Ando |
| 7,227,521 | B2 | 6/2007 | Yamazaki et al. |
| 7,227,541 | B2 | 6/2007 | Ando |
| 7,268,751 | B2 | 9/2007 | Yamazaki et al. |
| 7,889,168 | B2 | 2/2011 | Yamazaki et al. |
| 2003/0020698 | A1 | 1/2003 | Ando |
| 2004/0125046 | A1 | 7/2004 | Yamazaki et al. |
| 2004/0179031 | A1 | 9/2004 | Ando |
| 2004/0263638 | A1 | 12/2004 | Ohsawa et al. |

(Continued)

FOREIGN PATENT DOCUMENTS

| | | | |
|---|---|---|---|
| JP | 2003141518 | A | 5/2003 |
| JP | 2004138827 | A | 5/2004 |

(Continued)

*Primary Examiner* — Dorothy Harris
(74) *Attorney, Agent, or Firm* — Fitzpatrick, Cella, Harper & Scinto

(57) ABSTRACT

An image display device includes: a color gamut determining unit configured to determine a color gamut of pixels constituting an image; an image separating unit configured to separate the image into a low chroma image component and a high chroma image component based on a color gamut determination result; and a display unit configured to divide one frame period into subframe periods and temporally separate the low chroma image component and the high chroma image component in each subframe period to form an image. A backlight driving unit causes a broadband light source to emit light when the low chroma image component is being displayed and causes a narrowband light source to emit light when the high chroma image component is being displayed.

18 Claims, 60 Drawing Sheets

(56) References Cited

U.S. PATENT DOCUMENTS

| | | | | |
|---|---|---|---|---|
| 2006/0152534 | A1* | 7/2006 | Chang | G09G 3/2007 345/690 |
| 2007/0132680 | A1 | 6/2007 | Kagawa et al. | |
| 2007/0139302 | A1 | 6/2007 | Yamazaki et al. | |
| 2011/0273495 | A1* | 11/2011 | Ward | G09G 3/3413 345/694 |
| 2012/0001954 | A1* | 1/2012 | Yamazaki | G09G 3/3406 345/690 |
| 2012/0062584 | A1* | 3/2012 | Furukawa | H04N 9/3111 345/589 |
| 2012/0293571 | A1* | 11/2012 | Gotoh | G09G 3/3413 345/690 |
| 2013/0293598 | A1* | 11/2013 | Ishihara | G09G 3/3648 345/690 |
| 2014/0267445 | A1* | 9/2014 | Yaras | G09G 3/2037 345/690 |

FOREIGN PATENT DOCUMENTS

| | | | |
|---|---|---|---|
| JP | 2005275204 | A | 10/2005 |
| JP | 2012515948 | A | 7/2012 |
| WO | 2010085505 | A1 | 7/2010 |

* cited by examiner

INPUT IMAGE

COLOR GAMUT DETERMINATION RESULT

FIRST SUBFRAME DISPLAY RATIO

FIRST SUBFRAME (WIDE COLOR GAMUT LIGHT SOURCE)

SECOND SUBFRAME DISPLAY RATIO

SECOND SUBFRAME (LOW CHROMA LIGHT SOURCE)

INPUT IMAGE 1

HIGH CHROMA PIXEL

LOW CHROMA PIXEL 7601 7602

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 1 | 1 | 0 | 0 | 0 | 0 | 0 | 0 | 1 | 1 | 1 | 1 | 1 | 0 | 0 |
| 0 | 1 | 1 | 0 | 0 | 0 | 0 | 0 | 0 | 1 | 1 | 1 | 1 | 1 | 0 | 0 |
| 0 | 0 | 0 | 0 | 0 | 0 | 0 | 0 | 0 | 1 | 1 | 1 | 1 | 1 | 0 | 0 |
| 0 | 0 | 0 | 0 | 1 | 1 | 0 | 0 | 0 | 1 | 1 | 1 | 1 | 1 | 0 | 0 |
| 0 | 0 | 0 | 0 | 1 | 1 | 0 | 0 | 0 | 1 | 1 | 1 | 1 | 1 | 0 | 0 |
| 0 | 0 | 0 | 0 | 0 | 0 | 0 | 0 | 0 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 |

COLOR GAMUT DETERMINATION RESULT 221

| | | | | | | | | | | | | | | | |
|---|---|---|---|---|---|---|---|---|---|---|---|---|---|---|---|
| Z | Z | Z | Z | Z | Z | Z | Z | Z | Z | Z | Z | Z | Z | Z | Z |
| Z | A | A | Z | Z | Z | Z | Z | Z | B | B | B | B | B | Z | Z |
| Z | A | A | Z | Z | Z | Z | Z | Z | B | B | B | B | B | Z | Z |
| Z | Z | Z | Z | Z | Z | Z | Z | Z | B | B | B | B | B | Z | Z |
| Z | Z | Z | Z | C | C | Z | Z | Z | B | B | B | B | B | Z | Z |
| Z | Z | Z | Z | C | C | Z | Z | Z | B | B | B | B | B | Z | Z |
| Z | Z | Z | Z | Z | Z | Z | Z | Z | B | B | B | B | B | Z | Z |
| Z | Z | Z | Z | Z | Z | Z | Z | Z | Z | Z | Z | Z | Z | Z | Z |

AREA ANALYSIS RESULT 7502

*Fig.38C*

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 1 | 0 | 0 | 1 | 0 | 0 | 0 | 0 | 1 | 1 | 1 | 1 | 1 | 0 | 0 |
| 0 | 1 | 0 | 0 | 1 | 0 | 0 | 0 | 0 | 1 | 1 | 1 | 1 | 1 | 0 | 0 |
| 0 | 1 | 0 | 0 | 1 | 0 | 0 | 0 | 0 | 1 | 1 | 1 | 1 | 1 | 0 | 0 |
| 0 | 1 | 0 | 0 | 1 | 0 | 0 | 0 | 0 | 1 | 1 | 1 | 1 | 1 | 0 | 0 |
| 0 | 1 | 0 | 0 | 1 | 0 | 0 | 0 | 0 | 1 | 1 | 1 | 1 | 1 | 0 | 0 |
| 0 | 1 | 0 | 0 | 1 | 0 | 0 | 0 | 0 | 1 | 1 | 1 | 1 | 1 | 0 | 0 |
| 0 | 0 | 0 | 0 | 0 | 0 | 0 | 0 | 0 | 0 | 0 | 0 | 0 | 0 | 0 | 0 |

BRIGHTNESS VALUE (NORMALIZED)

| | | |
|---|---|---|
| −1 | −1 | −1 |
| −1 | 8 | −1 |
| −1 | −1 | −1 |

HIGH-PASS FILTER COEFFICIENTS

*Fig.39C*

7801 7802 7803

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 7 | 0 | 0 | 7 | 0 | 0 | 0 | 0 | 5 | 3 | 3 | 3 | 5 | 0 | 0 |
| 0 | 6 | 0 | 0 | 6 | 0 | 0 | 0 | 0 | 3 | 0 | 0 | 0 | 3 | 0 | 0 |
| 0 | 6 | 0 | 0 | 6 | 0 | 0 | 0 | 0 | 3 | 0 | 0 | 0 | 3 | 0 | 0 |
| 0 | 6 | 0 | 0 | 6 | 0 | 0 | 0 | 0 | 3 | 0 | 0 | 0 | 3 | 0 | 0 |
| 0 | 6 | 0 | 0 | 6 | 0 | 0 | 0 | 0 | 3 | 0 | 0 | 0 | 3 | 0 | 0 |
| 0 | 7 | 0 | 0 | 7 | 0 | 0 | 0 | 0 | 5 | 3 | 3 | 3 | 5 | 0 | 0 |
| 0 | 0 | 0 | 0 | 0 | 0 | 0 | 0 | 0 | 0 | 0 | 0 | 0 | 0 | 0 | 0 |

FREQUENCY ANALYSIS RESULT 7504

*Fig.39D*

INPUT IMAGE 1

7901 7902

| | | | | | | | | | | | | | | | |
|---|---|---|---|---|---|---|---|---|---|---|---|---|---|---|---|
| 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |
| 0.5 | 0.5 | 1 | 0 | 1 | 0 | 1 | 0.5 | 0.5 | 1 | 1 | 1 | 1 | 1 | 0.5 | 0.5 |
| 0.5 | 0.5 | 0 | 1 | 0 | 1 | 0 | 0.5 | 0.5 | 1 | 1 | 1 | 1 | 1 | 0.5 | 0.5 |
| 0.5 | 0.5 | 1 | 0 | 1 | 0 | 1 | 0.5 | 0.5 | 1 | 1 | 1 | 1 | 1 | 0.5 | 0.5 |
| 0.5 | 0.5 | 0 | 1 | 0 | 1 | 0 | 0.5 | 0.5 | 1 | 1 | 1 | 1 | 1 | 0.5 | 0.5 |
| 0.5 | 0.5 | 1 | 0 | 1 | 0 | 1 | 0.5 | 0.5 | 1 | 1 | 1 | 1 | 1 | 0.5 | 0.5 |
| 0.5 | 0.5 | 0 | 1 | 0 | 1 | 0 | 0.5 | 0.5 | 1 | 1 | 1 | 1 | 1 | 0.5 | 0.5 |
| 0.5 | 0.5 | 0.5 | 0.5 | 0.5 | 0.5 | 0.5 | 0.5 | 0.5 | 0.5 | 0.5 | 0.5 | 0.5 | 0.5 | 0.5 | 0.5 |

BRIGHTNESS VALUE (NORMALIZED)

7901 7902

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 |
| 0 | 0 | 4.5 | 4.5 | 4.5 | 4.5 | 4.5 | 0 | 0 | 2.5 | 1.5 | 1.5 | 1.5 | 2.5 | 0 | 0 |
| 0 | 0 | 4.5 | 4 | 4 | 4 | 4.5 | 0 | 0 | 1.5 | 0 | 0 | 0 | 1.5 | 0 | 0 |
| 0 | 0 | 4.5 | 4 | 4 | 4 | 4.5 | 0 | 0 | 1.5 | 0 | 0 | 0 | 1.5 | 0 | 0 |
| 0 | 0 | 4.5 | 4 | 4 | 4 | 4.5 | 0 | 0 | 1.5 | 0 | 0 | 0 | 1.5 | 0 | 0 |
| 0 | 0 | 4.5 | 4 | 4 | 4 | 4.5 | 0 | 0 | 1.5 | 0 | 0 | 0 | 1.5 | 0 | 0 |
| 0 | 0 | 4.5 | 4.5 | 4.5 | 4.5 | 4.5 | 0 | 0 | 2.5 | 1.5 | 1.5 | 1.5 | 2.5 | 0 | 0 |
| 0 | 0 | 0 | 0 | 0 | 0 | 0 | 0 | 0 | 0 | 0 | 0 | 0 | 0 | 0 | 0 |

TEXTURE ANALYSIS RESULT 7506

*Fig.40C*

7901 7902

| | | | | | | | | | | | | | | | |
|---|---|---|---|---|---|---|---|---|---|---|---|---|---|---|---|
| Z | Z | Z | Z | Z | Z | Z | Z | Z | Z | Z | Z | Z | Z | Z | Z |
| Z | Z | A | A | A | A | A | Z | Z | B | B | B | B | B | Z | Z |
| Z | Z | A | A | A | A | A | Z | Z | B | B | B | B | B | Z | Z |
| Z | Z | A | A | A | A | A | Z | Z | B | B | B | B | B | Z | Z |
| Z | Z | A | A | A | A | A | Z | Z | B | B | B | B | B | Z | Z |
| Z | Z | A | A | A | A | A | Z | Z | B | B | B | B | B | Z | Z |
| Z | Z | A | A | A | A | A | Z | Z | B | B | B | B | B | Z | Z |
| Z | Z | Z | Z | Z | Z | Z | Z | Z | Z | Z | Z | Z | Z | Z | Z |

AREA ANALYSIS RESULT 7502

*Fig.40D*

IMAGE DISPLAY DEVICE

BACKGROUND OF THE INVENTION

Field of the Invention

The present invention relates to an image display device which forms an image using a light source and an optical modulator that modulates transmittance or reflectance of light incident from the light source per pixel according to a drive signal.

Description of the Related Art

Color matching functions that represent human visual characteristics related to color are known to have individual variability attributable to fluctuations caused by age and the like. CIE170-1 is proposed as a model of such a fluctuation by the CIE (International Commission on Illumination).

The existence of such individual variability sometimes causes color to be perceived on an image display device as being subtly different from person to person (hereinafter, referred to as "individual variability in color perception"). As a result, there may be cases where, depending on an observer, a color does not appear to be matched even after performing color calibration for colorimetric matching with printed matter. This phenomenon is particularly prominent among display devices using light sources with a narrow spectrum as a backlight in order to expand a display color gamut.

In order to solve this problem, there is a method of reducing individual variability in color perception by reproducing a color spectrum of the real world as faithfully as possible on the assumption that image signals and display devices have six primary colors (Japanese Patent Application Laid-open No. 2003-141518).

Alternatively, a display device is proposed which combines a broad light source having a broad emission spectrum and used in a display region of an image with low chroma and a narrow light source having a narrow emission spectrum and used in a display region of an image with high chroma and which selectively uses such combinations per region on a screen (Japanese Patent Application Laid-open No. 2012-515948). The display device is intended to achieve both a reduction of individual variability in color perception and an expansion of a display color gamut.

In addition, a method is proposed for forming an image with a substantially larger number of primary colors than the number of primary colors of pixels constituting an optical modulator by temporally dividing a display period of an image, and switching among and emitting light from a plurality of light sources with different emission colors in each subframe (Japanese Patent Application Laid-open No. 2004-138827).

Furthermore, a method is proposed for expanding a color gamut of a display device by changing an applied current value of an RGB basic light source per factice field to increase the number of colors of the light source (Japanese Patent Application Laid-open No. 2005-275204).

SUMMARY OF THE INVENTION

However, since the technique according to Japanese Patent Application Laid-open No. 2003-141518 described above is intended to reduce individual variability in color perception as a result of performing multi-spectral image display using multi-spectral input image data of six primary colors, the technique is ineffective with respect to ordinary input image data of three primary colors.

In addition, with the technique according to Japanese Patent Application Laid-open No. 2012-515948 described above, since light source characteristics are controlled by the backlight per region of the image, color mixing of light sources occurs depending on a size of the region and a spread of the backlight and, as a result, it is difficult to obtain light source characteristics optimized for each pixel.

In consideration thereof, an object of the present invention is to provide an image display device that achieves both a reduction of individual variability in color perception and an expansion of a display color gamut.

The present invention provides an image display device that displays an image, including:

an illuminating unit including a plurality of light sources;

a separating unit configured to divide an input image into a first image component and a second image component;

a modulating unit configured to modulate light from the illuminating unit based on the first image component in a first period within a display period of the image and based on the second image component in a second period within a display period of the image; and a control unit configured to control the illuminating unit so as to emit first light in the first period and to emit second light in the second period, wherein a spectrum of light of a prescribed color that is included in the second light is wider than a spectrum of light of the prescribed color that is included in the first light.

According to the present invention, an image display device that achieves both a reduction of individual variability in color perception and an expansion of a display color gamut can be provided.

Further features of the present invention will become apparent from the following description of exemplary embodiments with reference to the attached drawings.

BRIEF DESCRIPTION OF THE DRAWINGS

FIGS. 38A to 38C are diagrams illustrating operation examples of an area analyzing unit 7501 according to the eighth embodiment;

FIGS. 39A to 39D are diagrams illustrating operation examples of a frequency analyzing unit 7503 according to the eighth embodiment;

FIGS. 40A to 40D are diagrams illustrating operation examples of a texture analyzing unit 7505 according to the eighth embodiment;

DESCRIPTION OF THE EMBODIMENTS (First Embodiment)

Figure 1A:
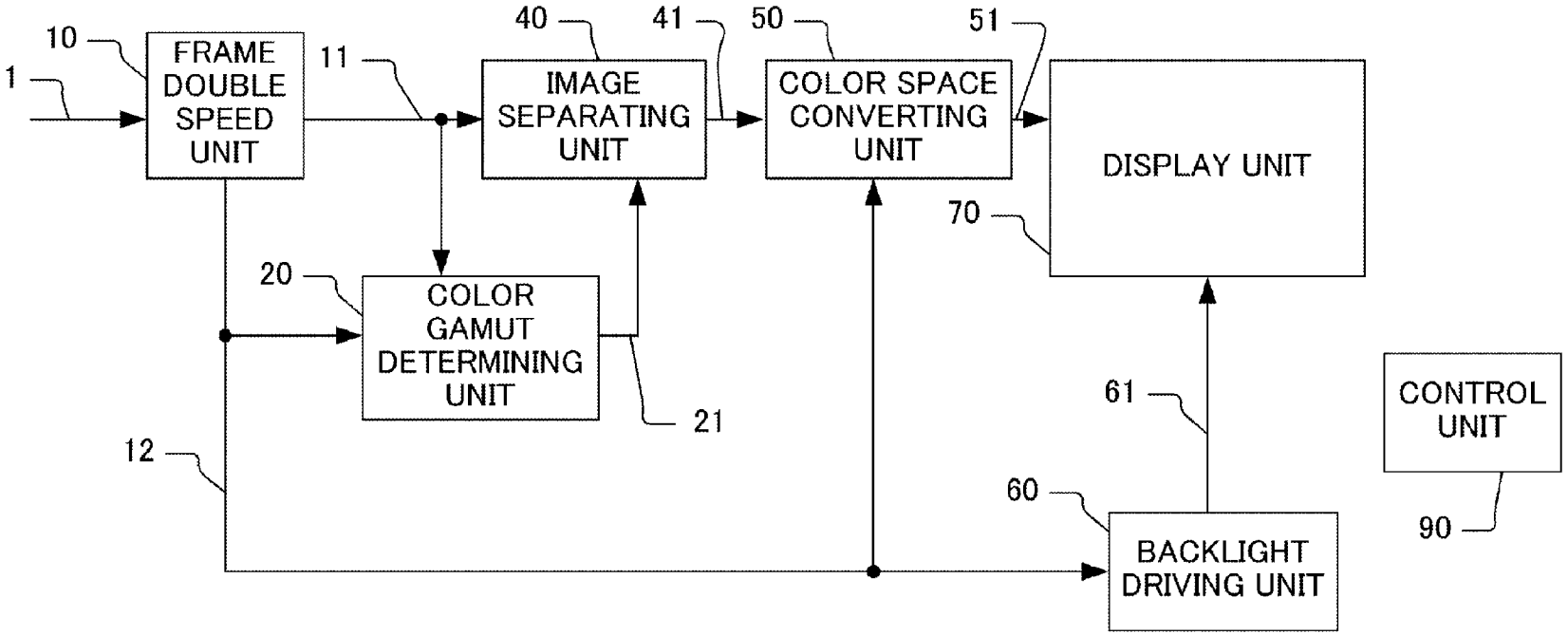
FIGS. 1A and 1B are a configuration diagram of an image display device and a color gamut determining unit 20 according to a first embodiment.

Configuration diagrams of an image display device according to a first embodiment of the present invention will be described with reference to FIGS. 1A, 2, and 3.

A frame double speed unit 10 temporarily accumulates an image signal (an input image 1) inputted to the device from an image inputting unit (not shown) in a frame memory. The frame double speed unit 10 reads out an image of one frame twice at double the frequency of the input image 1 and outputs a double speed input image 11. In addition, the frame double speed unit 10 outputs a double speed timing signal 12 indicating whether the output corresponds to a first subframe or a second subframe.

A color gamut determining unit 20 outputs a display ratio 21 of each pixel constituting the double speed input image 11 based on the double speed timing signal 12. A display ratio 21 represents an output level (a ratio of distribution to the first subframe and the second subframe) per pixel and is assumed to be a value between 0 and 1. Details of a color gamut determining process will be described later.

Based on the display ratio 21, an image separating unit 40 controls an output level per pixel of the double speed input image 11 and outputs a separated pixel value 41. The image separating unit 40 sets a value obtained by multiplying a pixel value of each pixel in each subframe by the display ratio 21 as a separated pixel value 41.

A color space converting unit 50 converts the separated pixel value 41 from a color space assumed by the input image 1 to a color space unique to the display device based on the double speed timing signal 12, and outputs a corrected pixel value 51. Details of a color space converting method will be described later.

A backlight driving unit 60 outputs a backlight drive signal 61 that controls driving of the backlight of the display unit 70 based on the double speed timing signal 12. Details of control for driving the backlight will be described later.

The display unit 70 is constituted by a liquid crystal panel unit 71 that is made up of liquid crystal elements and a backlight unit 72.

Figure 2:
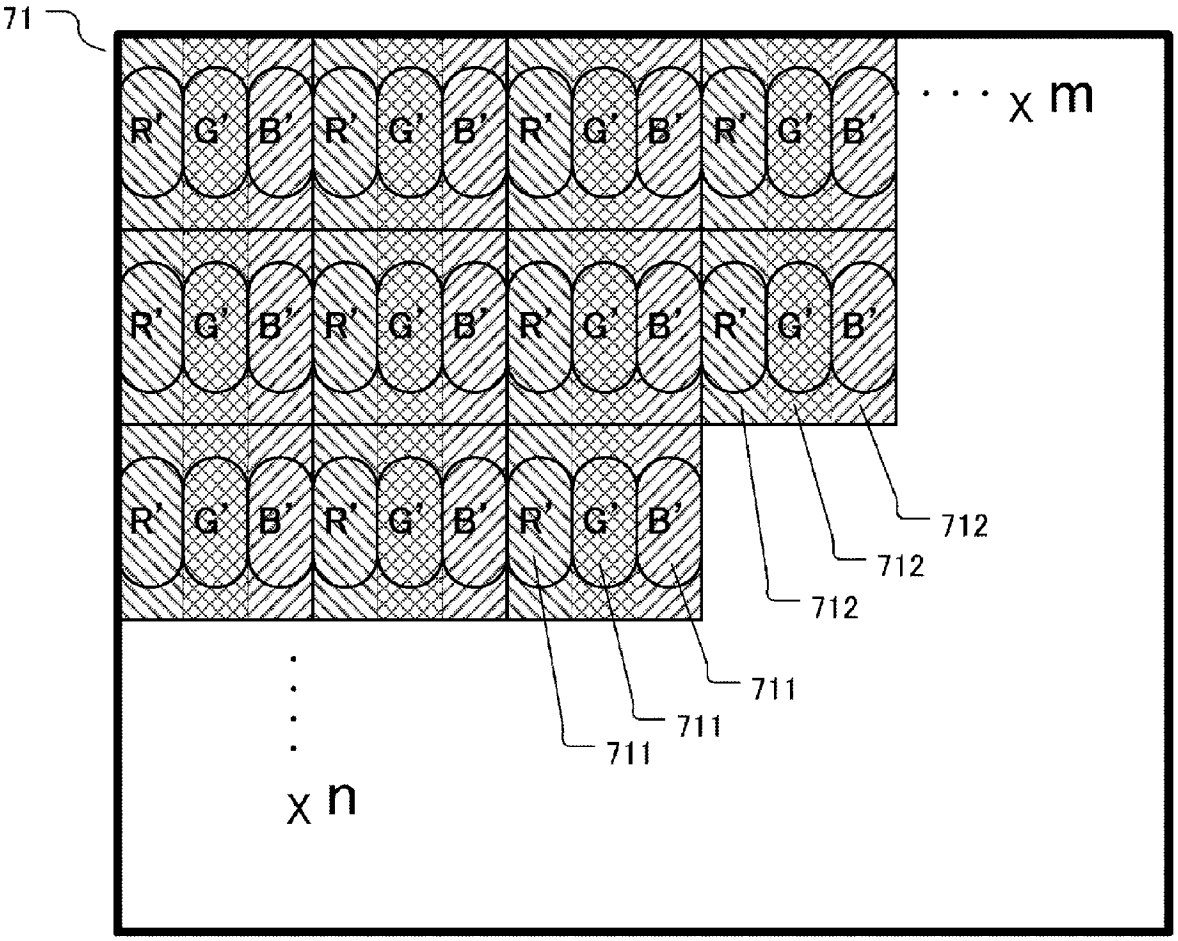
FIG. 2 is a conceptual diagram of a liquid crystal panel unit 71.

FIG. 2 shows a conceptual diagram of the liquid crystal panel unit 71. m-number of horizontal pixels and n-number of vertical pixels are arranged in a matrix pattern. Each pixel is constituted by an R'G'B' liquid crystal shutter element 711 and a color filter 712. An image is formed on the panel due a change in transmittance of a corresponding liquid crystal shutter element in accordance with an (R'G'B') value of each pixel among the corrected pixel value 51. In addition, characteristics of the color filter 712 corresponding to R'G'B' will be described later.

Figure 3:
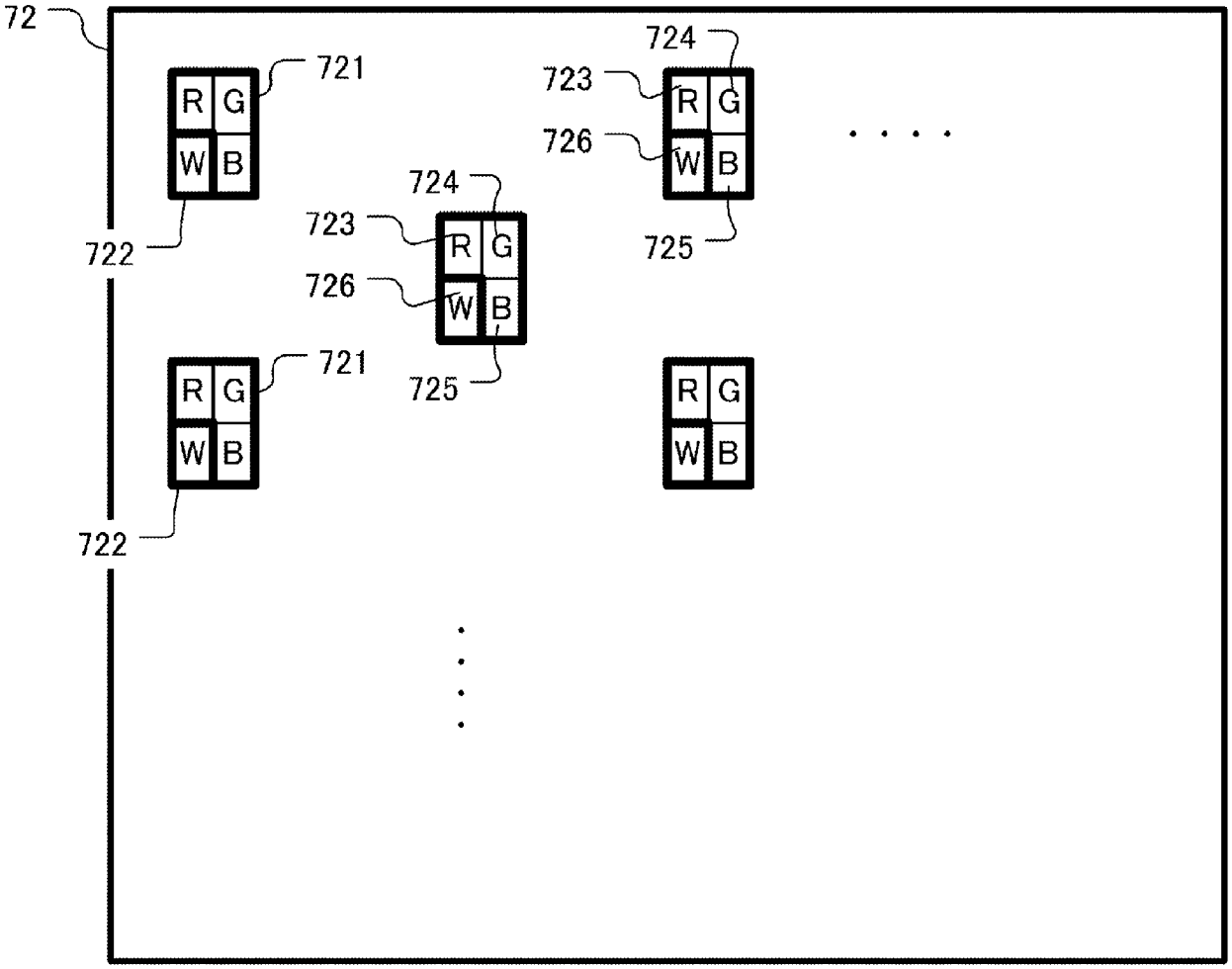
FIG. 3 is a conceptual diagram of a backlight unit 72.

FIG. 3 shows a conceptual diagram of the backlight unit 72. Light sources are arranged at prescribed intervals on a unit surface, and each light source is constituted by a wide color gamut light source (high chroma light source) group 721 (a first light source) and a low chroma light source group 722 (a second light source). The wide color gamut light source group 721 is constituted by a red light source 723, a green light source 724, and a blue light source 725. In addition, the low chroma light source group 722 is constituted only by a white light source 726 in the first embodiment. The respective light source groups are simultaneously lighted based on the backlight drive signal 61. The backlight unit 72 is an illuminating unit capable of switching light to be emitted between when light is emitted by the wide color gamut light source group 721 and when light is emitted by the low chroma light source group 722 due to control by the backlight driving unit 60. Light emitted from a light source is diffused in a planar direction by a diffuser plate (not shown) and irradiates the liquid crystal panel unit 71 from the rear as a backlight.

A control unit 90 controls operations of the respective units and timings thereof via control lines (not shown).

Next, emission characteristics of the respective light source groups and a selection method thereof will be described.

Figure 4B:
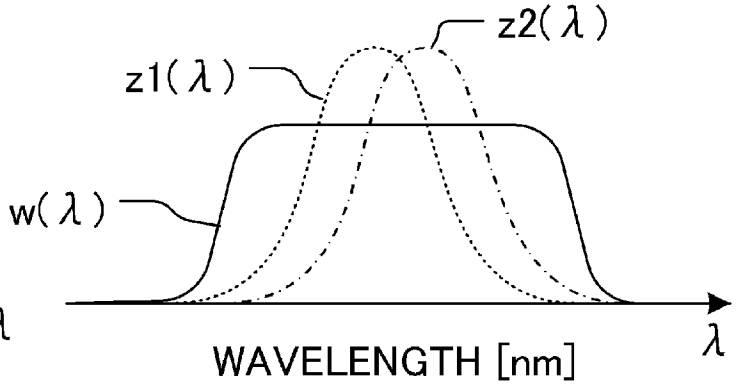
FIGS. 4A and 4B are conceptual diagrams showing relationships between color matching functions that represents characteristics of the human eye and spectra of light sources.
Figure 4A:
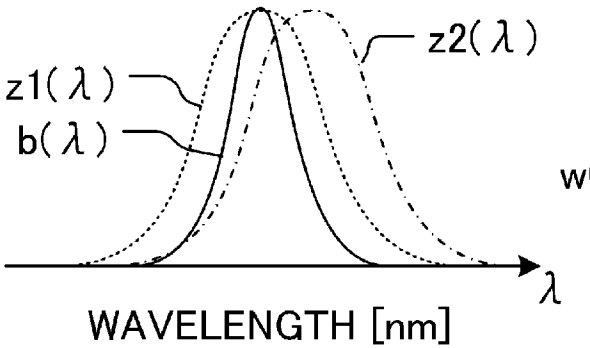

FIG. 4A shows a conceptual diagram of a relationship between color matching functions representing characteristics of a human eye and a spectrum of a light source when only one light source is used in a display device. As described in BACKGROUND OF THE INVENTION, there is individual variability in color matching functions. In the drawing, a spectrum of a wide color gamut light source b is denoted by b (λ), a color matching function of an observer A is denoted by z1 (λ), and a color matching function of another observer B is denoted by z2 (λ). As shown in FIG. 4A, there is individual variability between the color matching functions of the observer A and the observer B.

A stimulus ZA of the light source b as sensed by the observer A is expressed as $$ZA=\int b(\lambda)z1(\lambda)d\lambda. \quad \text{[Expression 1]}$$

A stimulus ZB of the light source b as sensed by the observer B is expressed as $$ZB=\int b(\lambda)z2(\lambda)d\lambda. \quad \text{[Expression 2]}$$

Since peaks of b (λ) and z1 (λ) are relatively closely matched, the observer A substantially senses all the energy of the light source b. On the other hand, since peaks of b (λ) and z2 (λ) are misaligned, ZB is smaller than ZA. In other words, the observer B only senses a part of the energy of the light source b. Due to such a mechanism, a phenomenon occurs where differences are created among energy received from a light source by individuals and, as a result, different colors are perceived.

In comparison, FIG. 4*b* shows a conceptual diagram of a relationship between spectra of light sources and color matching functions when a low chroma light source w with a broadband emission spectrum is used. In the diagram, a spectrum of the low chroma light source w is denoted by w (λ). In this case, a stimulus ZA' that is sensed by the observer A and a stimulus ZB' that is sensed by the observer B are expressed as $$ZA'=\int w(\lambda)z1(\lambda)d\lambda.$$

$$ZB'=\int w(\lambda)z2(\lambda)d\lambda. \quad \text{[Expression 3]}$$

The spectrum w (λ) of the low chroma light source w has sufficiently flat characteristics in a wavelength range containing sensitivities of the color matching functions z1 (λ) and z2 (λ) of the observers A and B. When such a relationship exists between the spectrum and the color matching functions, the stimulus ZA' received by the observer A from the low chroma light source w and the stimulus ZB' received by the observer B from the low chroma light source w are approximately equal to each other. Although not strictly ZA'=ZB', the difference between ZA' and ZB' is significantly smaller than the difference between ZA and ZB. Therefore, the stimulus sensed by the observer A and the stimulus sensed by the observer B can practically be considered sufficiently equivalent. The stimulus sensed by the observer A and the stimulus sensed by the observer B being equivalent means that perceived colors can be made equivalent even when there is individual variability among color matching functions.

Next, a description will be given on characteristics of a light source necessary to substantially equalize color as perceived between observers having individual variability in their color matching functions based on the above principles.

Let us assume that a wavelength range having a sensitivity that equals or exceeds a first reference in both a color matching function having fluctuated furthest on a short wavelength side and a color matching function having fluctuated furthest on a long wavelength side in a model of fluctuation due to individual variability of color matching functions is a sensitive wavelength range (zL to zH). For example, the first reference can be set to a sensitivity that is ¾ of a peak sensitivity. In order to produce the effect described above, the low chroma light source w desirably has an intensity equal to or exceeding a second reference in the entire sensitive wavelength range from zL to zH. For example, the second reference can be set to an intensity that is ½ of a peak intensity in the sensitive wavelength range.

For example, a wavelength λBL having a sensitivity of ¾ of a peak on a short wavelength side of s-bar characteristics (age 20) as shown in CIE170-1 is approximately 425 nm. In addition, a wavelength λBH having a sensitivity of ¾ of a peak on a long wavelength side of s-bar characteristics (age 80) is approximately 475 nm. Therefore, a light source having a spectrum in which at least a minimum level between 425 nm to 475 nm is ½ or more of a peak level between 425 nm to 475 nm may be used as the low chroma light source w. As long as similar conditions are also satisfied for red and green, the low chroma light source group 722 can have a necessary spectrum as a low chroma light source for each color component. Even when the low chroma light source group 722 is configured by a combination of a plurality of light sources with different characteristics, a composite spectrum thereof need only satisfy the condition described above. In other words, if composite spectrum of low chroma light source group 722: w (λ), color matching function: z (λ), peak wavelength of color matching function z (λ): λpz, sensitive wavelength range of color matching function z (λ): zL to zH, and peak wavelength of w (λ) in sensitive wavelength range: λpw, then it may suffice that min (z(zL) to z(zH))>z(λpz)×¾, and min (w(zL) to w(zH))>z(λpz)×½ are satisfied with respect to all observers (all color matching functions that fluctuate according to the fluctuation model of the color matching functions).

As the light sources used in the wide color gamut light source group 721, light sources with wavelengths at which the color matching function of each primary color has sufficient sensitivity and color matching functions of other primary colors have only low sensitivities may be selected. In order to expand a displayable color gamut of the image display device, an emission spectrum of each light source is favorably narrow. Desirably, a half-value width of the emission spectrum is equal to or less than 50 nm.

As a selection of specific light sources that approximately satisfy the selection method and emission characteristics described above, in the first embodiment, a blue LED (light-emitting diode), a green LED, and a red LED are selected which are light-emitting elements that cause emission peak wavelengths of the respective light sources constituting the wide color gamut light source group 721 to be set to $\lambda b=450$ nm, $\lambda g=530$ nm, and $\lambda r=630$ nm.

In addition, as the light source constituting the low chroma light source group 722, a white LED having an approximately flat emission spectrum in a wavelength range of 380 nm to 700 nm is selected. The blue LED, the green LED, and the red LED that constitute the wide color gamut light source group 721 are narrowband LEDs with narrow emission spectra, and the white LED that constitutes the low chroma light source group 722 is a broadband LED with a broad emission spectrum.

Figure 5A:
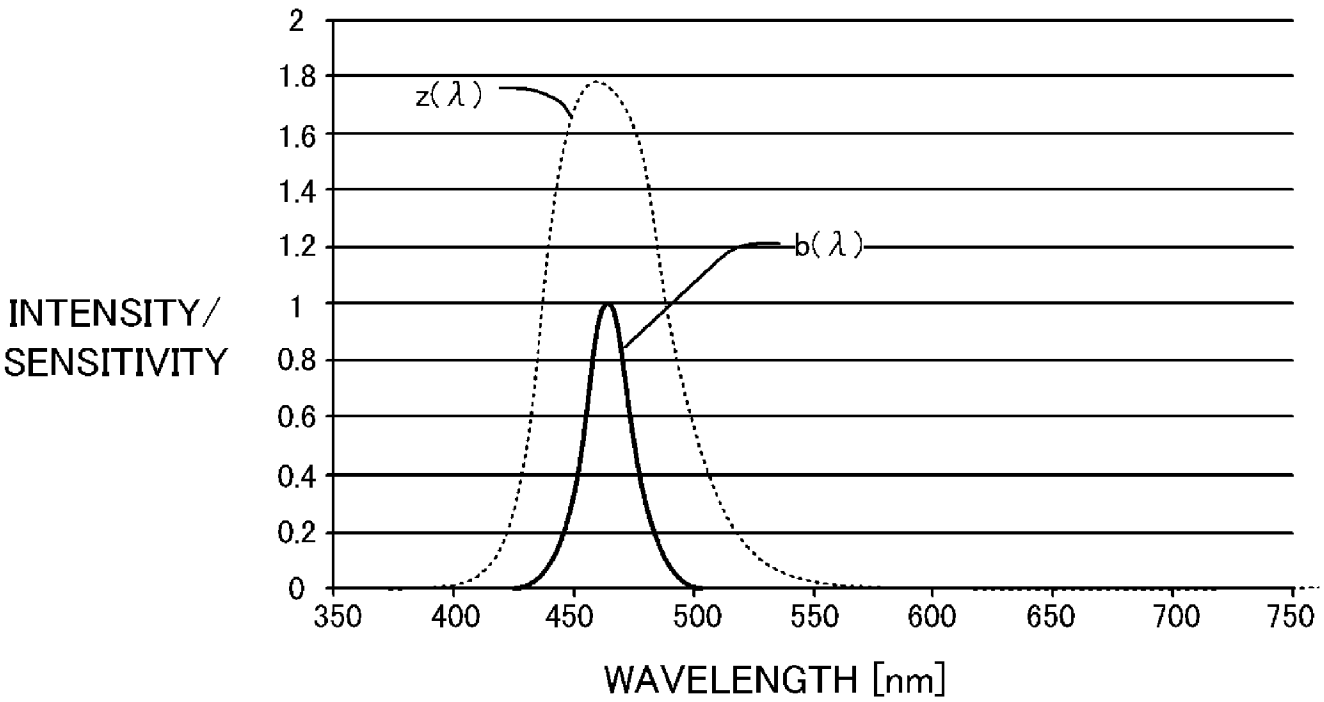
FIGS. 5A to 5E are diagrams showing relationships between characteristics of light sources and color matching functions according to the first embodiment.
Figure 5B:
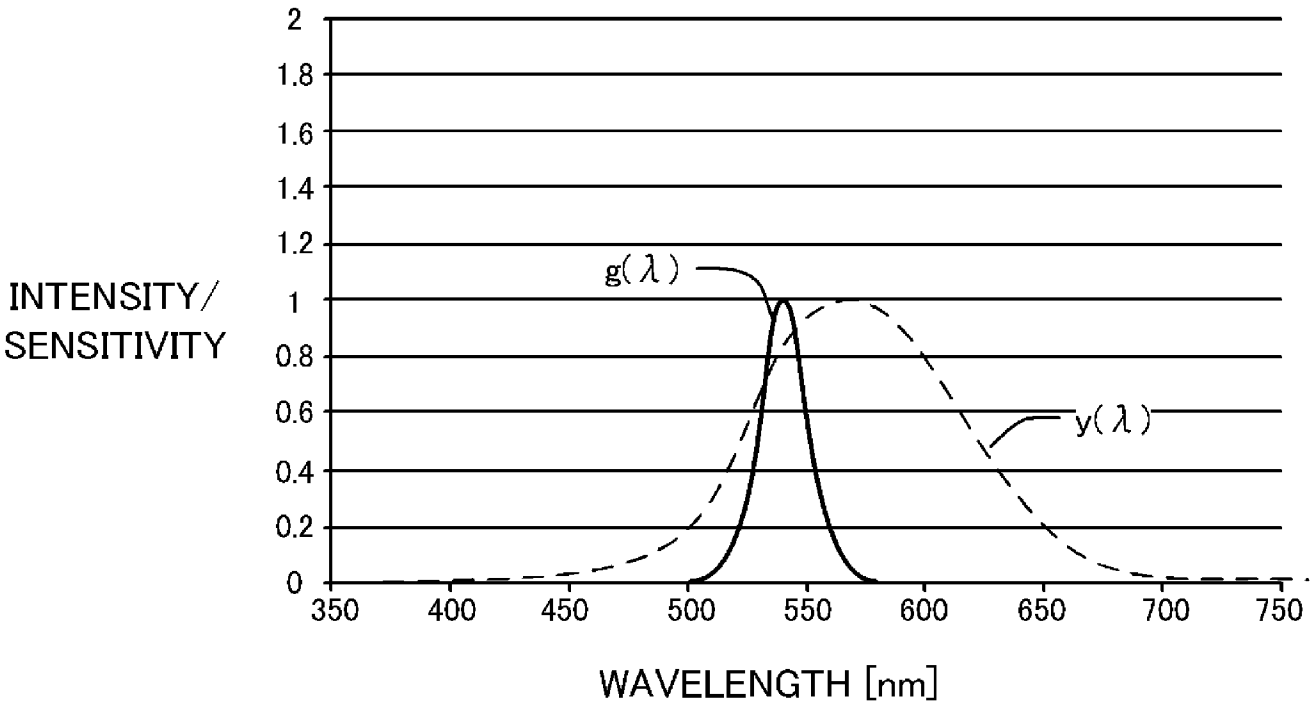
Figure 5C:
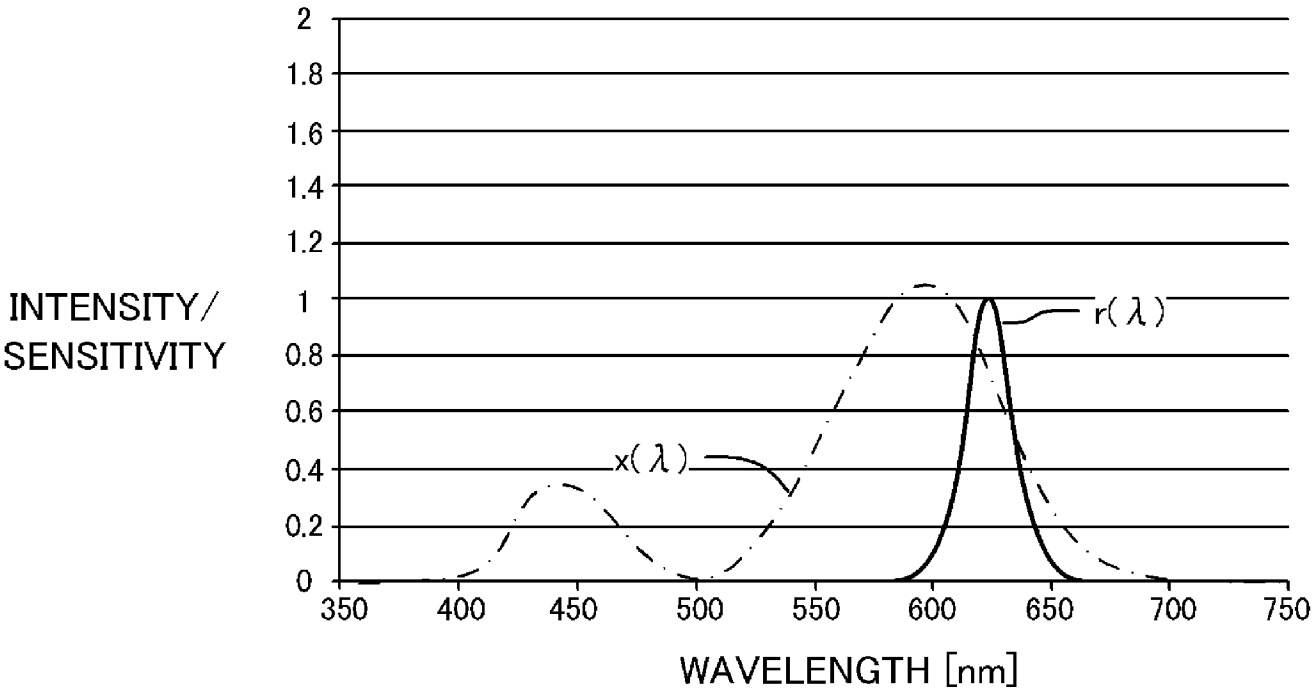
Figure 5D:
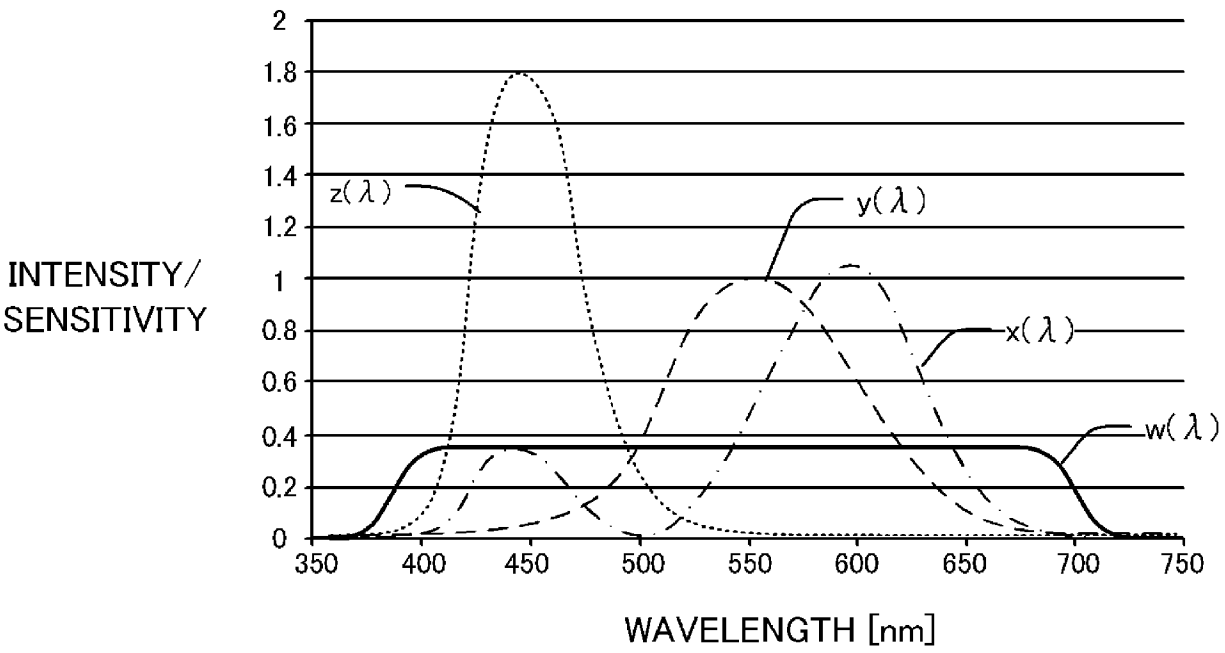
Figure 5E:
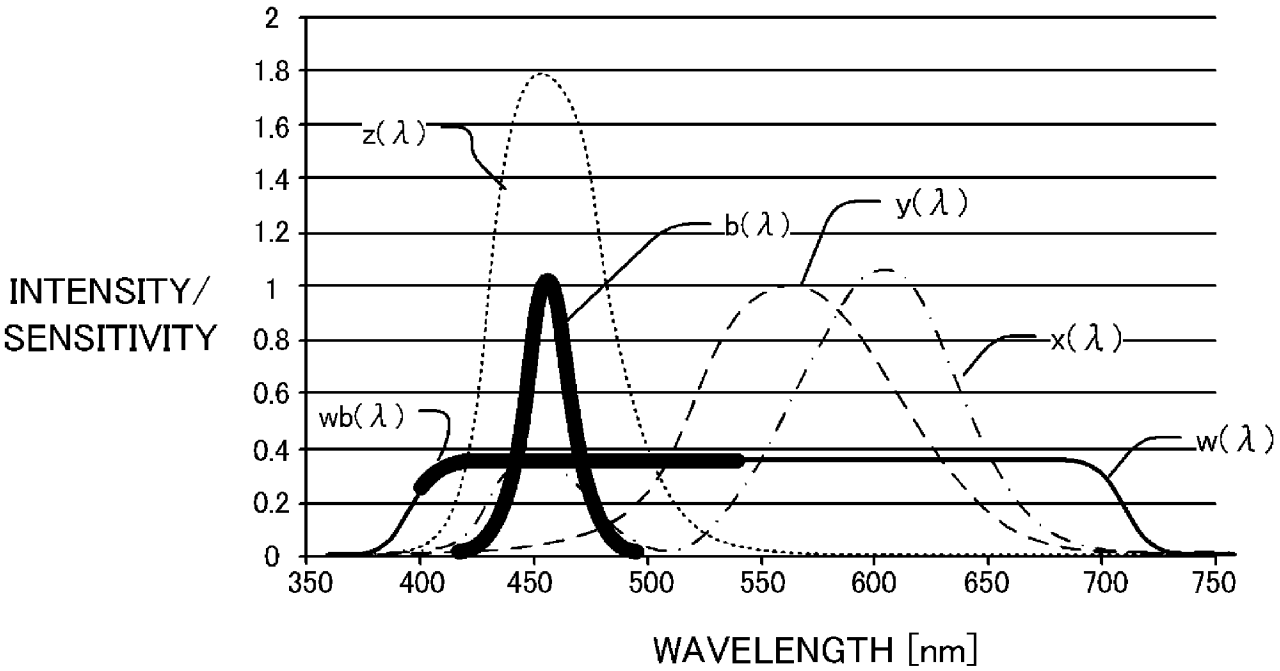

FIGS. 5A to 5E show relationships between characteristics of the light sources selected in the first embodiment and color matching functions. FIG. 5A is a diagram showing a relationship between an emission spectrum b (λ) of the blue light source 725 and a blue color matching function z (λ). FIG. 5B is a diagram showing a relationship between an emission spectrum g (λ) of the green light source 724 and a green color matching function y (λ). FIG. 5C is a diagram showing a relationship between an emission spectrum r (λ) of the red light source 723 and a red color matching function x (λ). FIG. 5D is a diagram showing a relationship between an emission spectrum w (λ) of the white light source 726 and the blue, green, and red color matching functions z (λ), y (λ), and x (λ). A spectrum obtained by compositing the emission spectra b (λ), g (λ), and r (λ) shown in FIGS. 5A to 5C is adopted as a spectrum of the first light and the emission spectrum w (λ) shown in FIG. 5D is adopted as a spectrum of the second light. FIG. 5E shows a spectrum of a blue component included in the spectrum w (λ) of the white light shown in FIG. 5D enhanced as wb (λ), and also shows the emission spectrum b (λ) of the blue light shown in FIG. 5A being superimposed for comparison. As shown in FIG. 5E, the spectrum wb (λ) of the blue component contained in the second light has a broader bandwidth than the spectrum b (λ) of the blue light contained in the first light. Although not shown in FIG. 5E, in a similar manner, a spectrum of the green component and a spectrum of the red component contained in the second light are respectively broader than the spectrum g (λ) of the green component and the spectrum r (λ) of the red component contained in the first light shown in FIGS. 5B and 5C.

Figure 6:
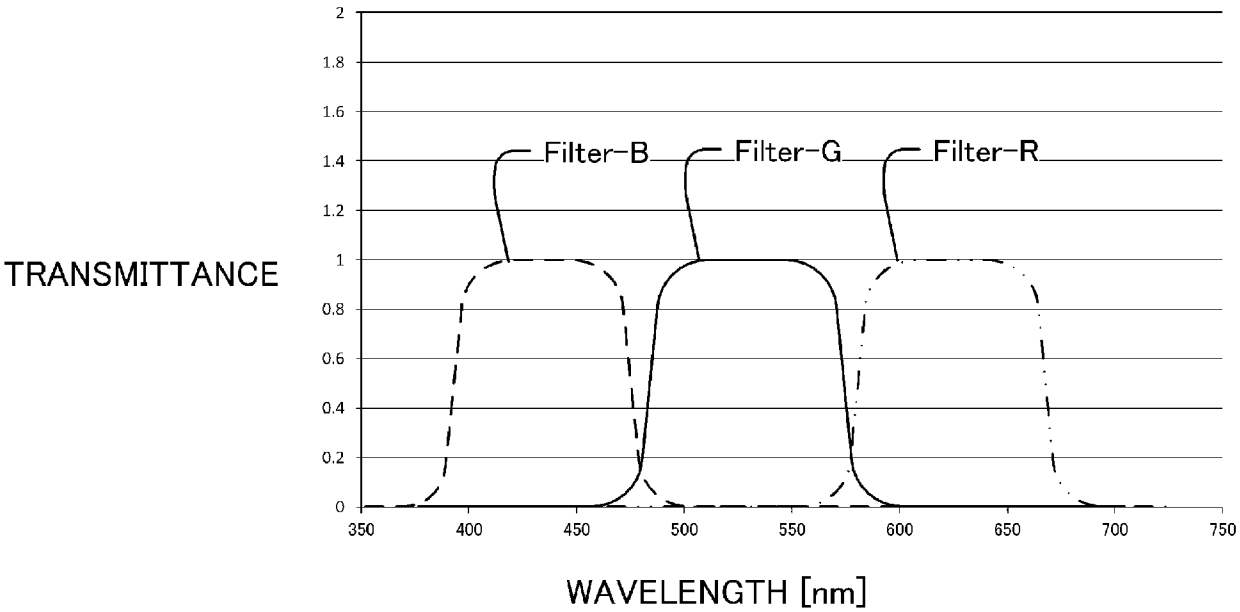
FIG. 6 shows transmission characteristics of a color filter.

The color filter 712 transmits light source light irradiated from the backlight unit 72 according to respective transmission wavelength characteristics of RGB that correspond to the three primary colors of the liquid crystal shutter element 711 in order to obtain transmitted light of the respective wavelength bands of the three primary colors. Transmission characteristics of the color filter used in the first embodiment are shown in FIG. 6. A Filter-B that is the filter of blue (B) performs filtering so as to transmit light emitted from the blue light source 725 and to transmit a blue component among light emitted from the white light source 726. A Filter-G that is the filter of green (G) performs filtering so as to transmit light emitted from the green light source 724 and to transmit a green component among light emitted from the white light source 726. A Filter-R that is the filter of red (R) performs filtering so as to transmit light emitted from the red light source 723 and to transmit a red component among light emitted from the white light source 726.

Figure 7:
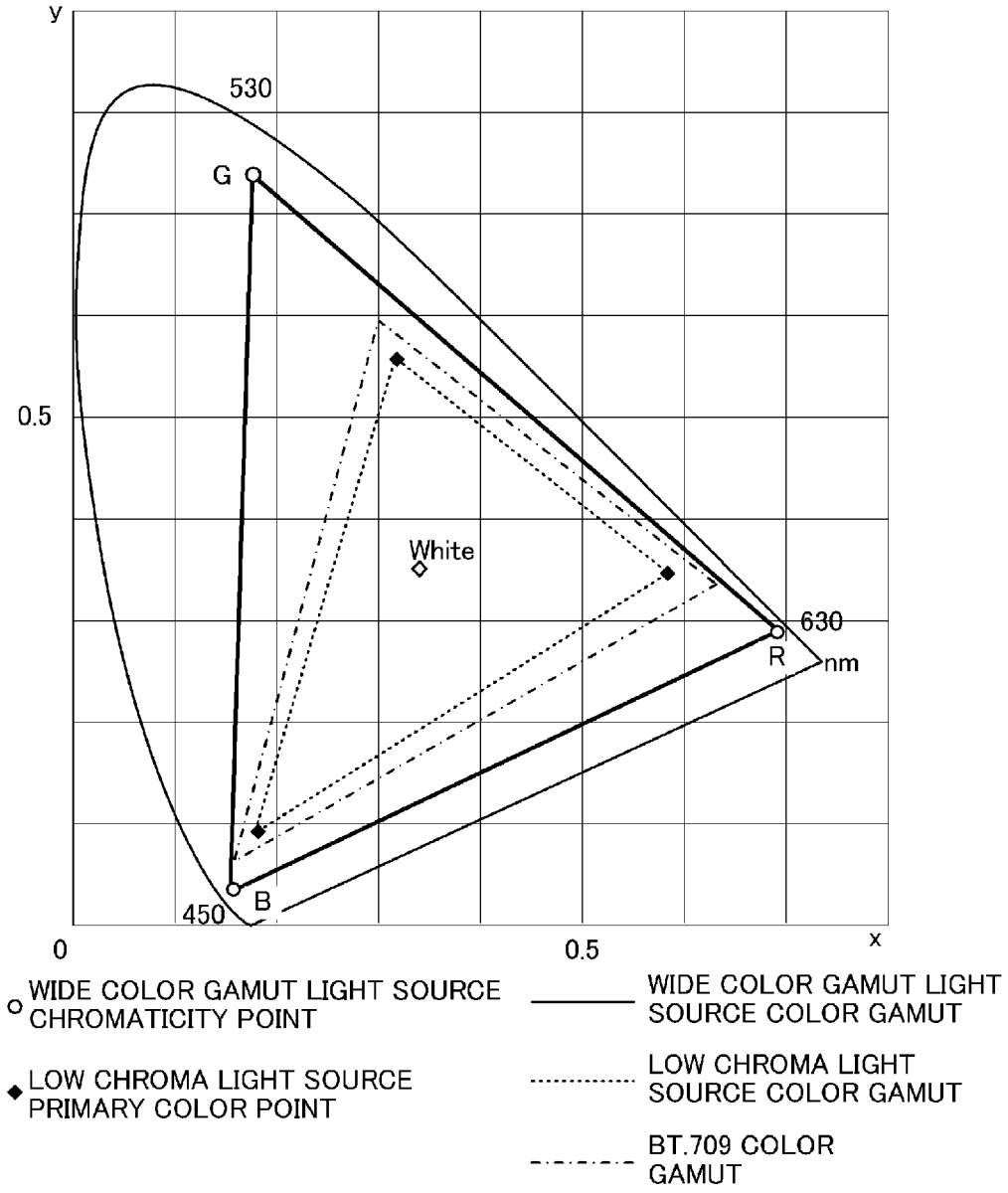
FIG. 7 is a diagram showing light sources and color gamuts displayable by a color filter 712 according to the first embodiment.

In addition, FIG. 7 is a chromaticity diagram showing color gamuts that can be displayed by combinations of the light sources selected in the first embodiment and the color filter 712. Since light sources with narrow spectra are used as the light sources constituting the wide color gamut light source group 721, a color gamut that is displayable by the wide color gamut light source group 721 (a wide color gamut light source color gamut) is wider than the BT.709 color gamut. On the other hand, since the color filter 712 broadly transmits each primary color range, due to color mixing, a color gamut that is displayable by the low chroma light source group 722 (a low chroma light source color gamut) is narrower than the BT.709 color gamut.

Figure 1B:
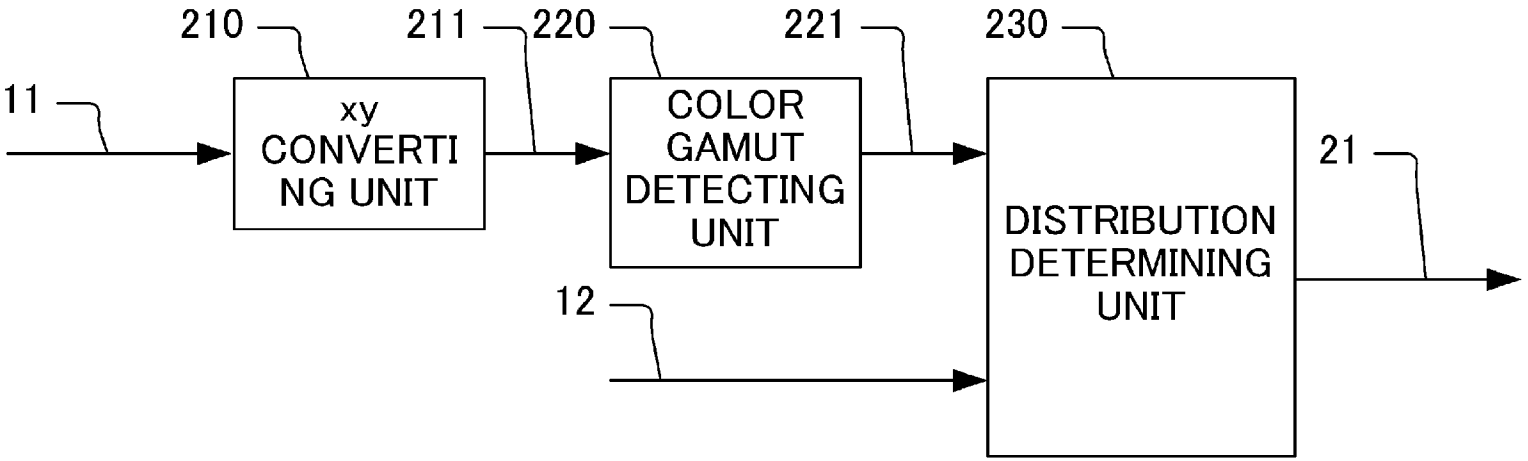

Next, a method of determining a color gamut according to the color gamut determining unit 20 will be described in detail. FIG. 1B shows a configuration diagram of the color gamut determining unit 20.

An xy converting unit 210 converts an RGB pixel value of each pixel constituting the double speed input image 11 into a value in a Yxy color system based on a color space of the double speed input image 11 and outputs an xy value 211.

Figure 8:
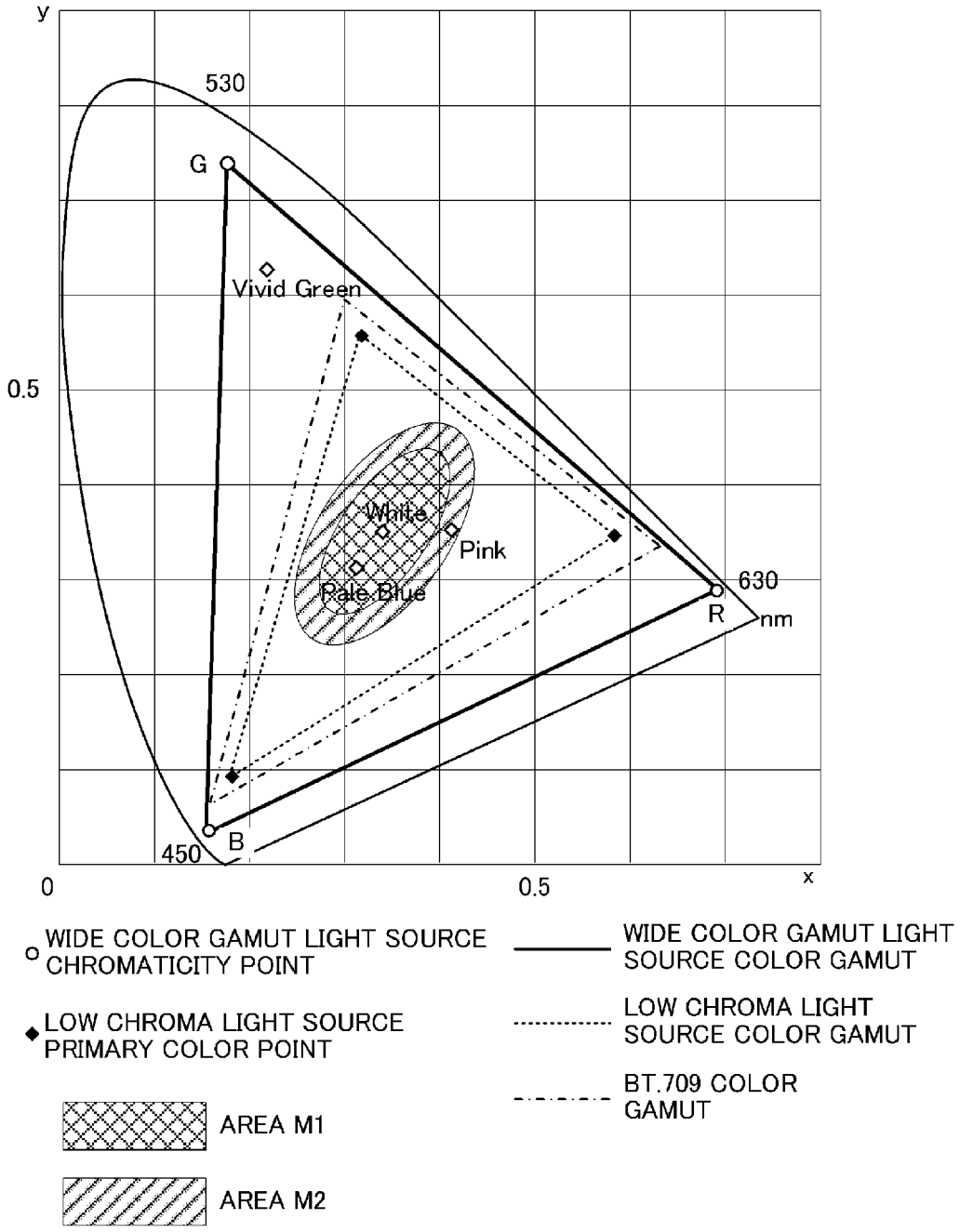
FIG. 8 is a conceptual diagram of a color gamut determining process.

A color gamut detecting unit 220 determines which color gamut the xy value 211 of each pixel is to be classified into and outputs a color gamut determination result 221. FIG. 8 shows a conceptual diagram of the color gamut determining process. It is empirically known that individual variability in color perception is more sharply sensed in colors close to white or, in other words, colors with low chroma. It is also empirically known that individual variability is sensed more sharply in the blue component than in the red and green components. Based on these empirical facts, a prescribed color gamut which includes a white point and which is close to white (a low chroma color gamut) and which is a flat color gamut that is wide in blue and yellow directions is defined as an area M1 (a first color gamut), and a color gamut which surrounds the first color gamut and which is in a certain range with a higher chroma than the first color gamut is defined as an area M2 (a second color gamut). Moreover, the flat shape may be set so as to expand in at least one of blue and yellow directions. The color gamut detecting unit 220 refers to a two-dimensional lookup table having x and y as indexes and determines, for each inputted pixel, whether the color gamut to which the pixel belongs is M1, M2, or another color gamut, and sets a result of the determination as a color gamut determination result 221.

Figure 9:
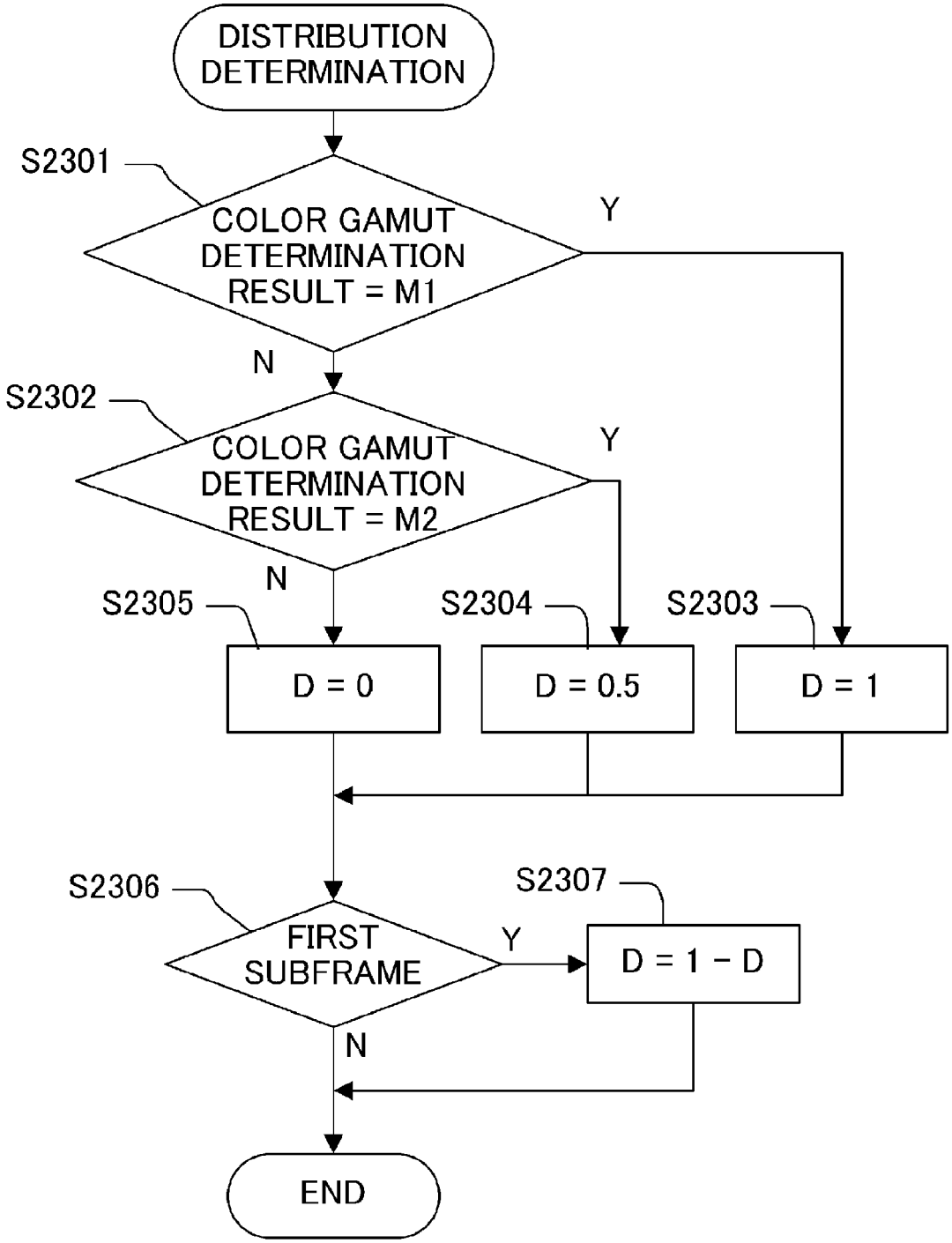
FIG. 9 is a flow chart of a distribution determining unit 230.

Based on the color gamut determination result 221 and the double speed timing signal 12, a distribution determining unit 230 determines a ratio at which a determination object pixel is distributed to a first subframe (a first image component) using the wide color gamut light source group 721 and a second subframe (a second image component) using the low chroma light source group 722. FIG. 9 shows a flow chart showing processing performed by the distribution determining unit 230. Values of 0 to 1 of a display ratio D correspond to distribution ratios of 0% to 100%.

In step S2301, the distribution determining unit 230 determines whether or not the color gamut determination result 221 is a value representing the area M1. If the color gamut determination result 221 is the area M1, the distribution determining unit 230 proceeds to step S2303, and if not, the distribution determining unit 230 proceeds to step S2302.

In step S2302, the distribution determining unit 230 determines whether or not the color gamut determination result 221 is a value representing the area M2. If the color gamut determination result 221 is the area M2, the distribution determining unit 230 proceeds to step S2304, and if not, the distribution determining unit 230 proceeds to step S2305.

In step S2303, the distribution determining unit 230 sets the display ratio D to 1.

In step S2304, the distribution determining unit 230 sets the display ratio D to 0.5.

In step S2305, the distribution determining unit 230 sets the display ratio D to 0.

In step S2306, the distribution determining unit 230 determines whether or not the double speed timing signal 12 is a value representing the first subframe (the wide color gamut light source). If so, the distribution determining unit 230 proceeds to step S2307, and if not, the series of processes is concluded.

In step S2307, the distribution determining unit 230 inverts the display ratio D so that D=D−1.

The distribution determining unit 230 outputs the display ratio D obtained by the procedure described above as a display ratio 21.

Next, a method of converting a color space according to the color space converting unit 50 will be described in detail.

The color space converting unit 50 internally has two conversion coefficients, namely, a wide color gamut matrix coefficient for mapping from a color space of the input image 1 to a color space of the wide color gamut light source group 721 and a robust matrix coefficient for mapping from the color space of the input image 1 to a color space of the low chroma light source group 722. If the double speed timing signal 12 is a value representing the first subframe (the wide color gamut light source), the color space converting unit 50 maps the separated pixel value 41 onto the color space of the wide color gamut light source group 721 using the wide color gamut matrix coefficient and outputs the mapped separated pixel value 41 as the corrected pixel value 51. Meanwhile, if the double speed timing signal 12 is a value representing the second subframe (the low chroma light source), the color space converting unit 50 maps the separated pixel value 41 onto the color space of the low chroma light source group 722 using the robust matrix coefficient and outputs the mapped separated pixel value 41 as the corrected pixel value 51.

Next, backlight driving control according to the backlight driving unit 60 will be described in detail.

When the double speed timing signal 12 is a value representing the first subframe, the backlight driving unit 60 outputs a backlight drive signal 61 for driving the wide color gamut light source group 721. Meanwhile, when the double speed timing signal 12 is a value representing the second subframe, the backlight driving unit 60 outputs a backlight drive signal 61 for driving the low chroma light source group 722. By driving light sources in this manner, a pixel of a color (a high chroma image component) that requires the wide color gamut light source group is displayed in a first subframe period that is a first period within the display period of the input image. In addition, a pixel of a color (a low chroma image component) that requires the low chroma light source group is displayed in a second subframe period that is a second period within the display period of the input image.

Next, operations of the image display device shown in the first embodiment will be described using a specific input image as an example. FIGS. 10A to 10F show conceptual diagrams of operations according to the first embodiment.

Figure 10A:
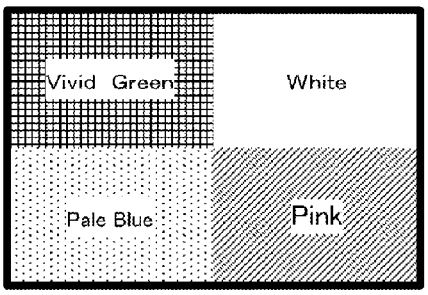
FIGS. 10A to 10F are conceptual diagrams of operations according to the first embodiment.

Let us assume that the input image 1 is an image that is selectively colored by vivid green in a upper left portion, white in a upper right portion, pale blue in a lower left portion, and pink in a lower right portion as shown in FIG. 10A.

Figure 10B:
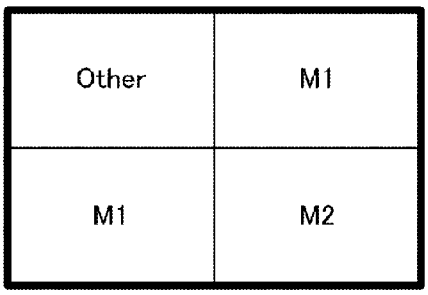
Figure 10C:
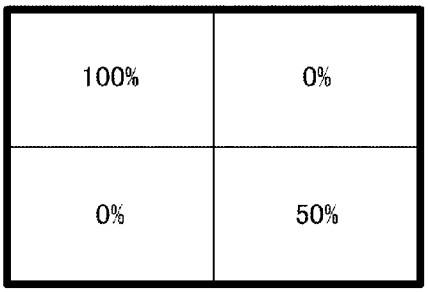
Figure 10D:
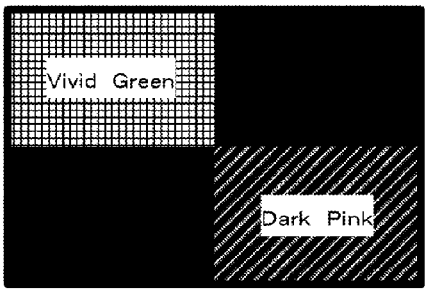
Figure 10E:
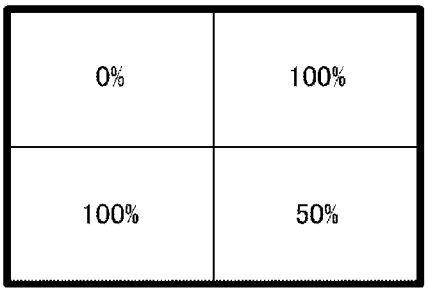
Figure 10F:
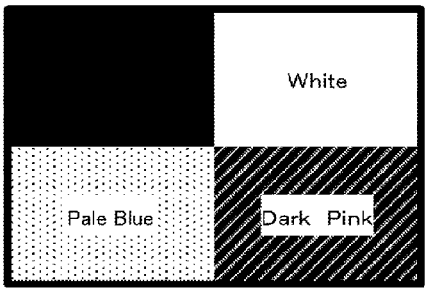

As shown in FIG. 10B, the color gamut determination result 221 by the color gamut detecting unit 220 is expressed as vivid green: "other",
white: M1,
pale blue: M1, and
pink: M2 for both the first subframe and the second subframe. In addition, since the display ratio D in the first subframe is expressed as vivid green: 1,
white: 0,
pale blue: 0, and
pink: 0.5 as shown in FIG. 10C, a display content of the first subframe using the wide color gamut light source is as shown in FIG. 10D. In addition, since the display ratio D in the second subframe is expressed as vivid green: 0,
white: 1,
pale blue: 1, and
pink: 0.5 as shown in FIG. 10E, a display content of the second subframe using the low chroma light source is as shown in FIG. 10F.

During observation, since an afterimage of around 15 ms occurs in the human eye, the two subframes are perceived as being composited. In other words, an observer perceives as if the image in FIG. 10A is being displayed.

Since the frame rate of a subframe is 120 Hz when the frame rate of the input image 1 is 60 Hz, flicker due to frame division is hardly sensed by the observer. The perceptual image composition used in the present invention is realized when the frame rate of a subframe is equal to or higher than approximately 90 Hz.

Pixels of colors requiring the wide color gamut light source group and pixels of colors requiring the low chroma light source group are independently displayed in respective subframes. In other words, since lighting and pixel display of the respective light source groups are separated from one another on a time axis, in principle, color mixing between the light source groups does not occur.

According to the configuration and the procedures described above, by selectively using light source groups with different characteristics of wide color gamut and low chroma, contrary effects of expanding a display color gamut and reducing individual variability in color perception can be both achieved.

The wide color gamut light source and the low chroma light source may be lighted in any order. In other words, the low chroma light source may be used in the first subframe and the wide color gamut light source may be used in the second subframe. An order of perceptual composition does not affect the essence of the present invention.

Figure 11:
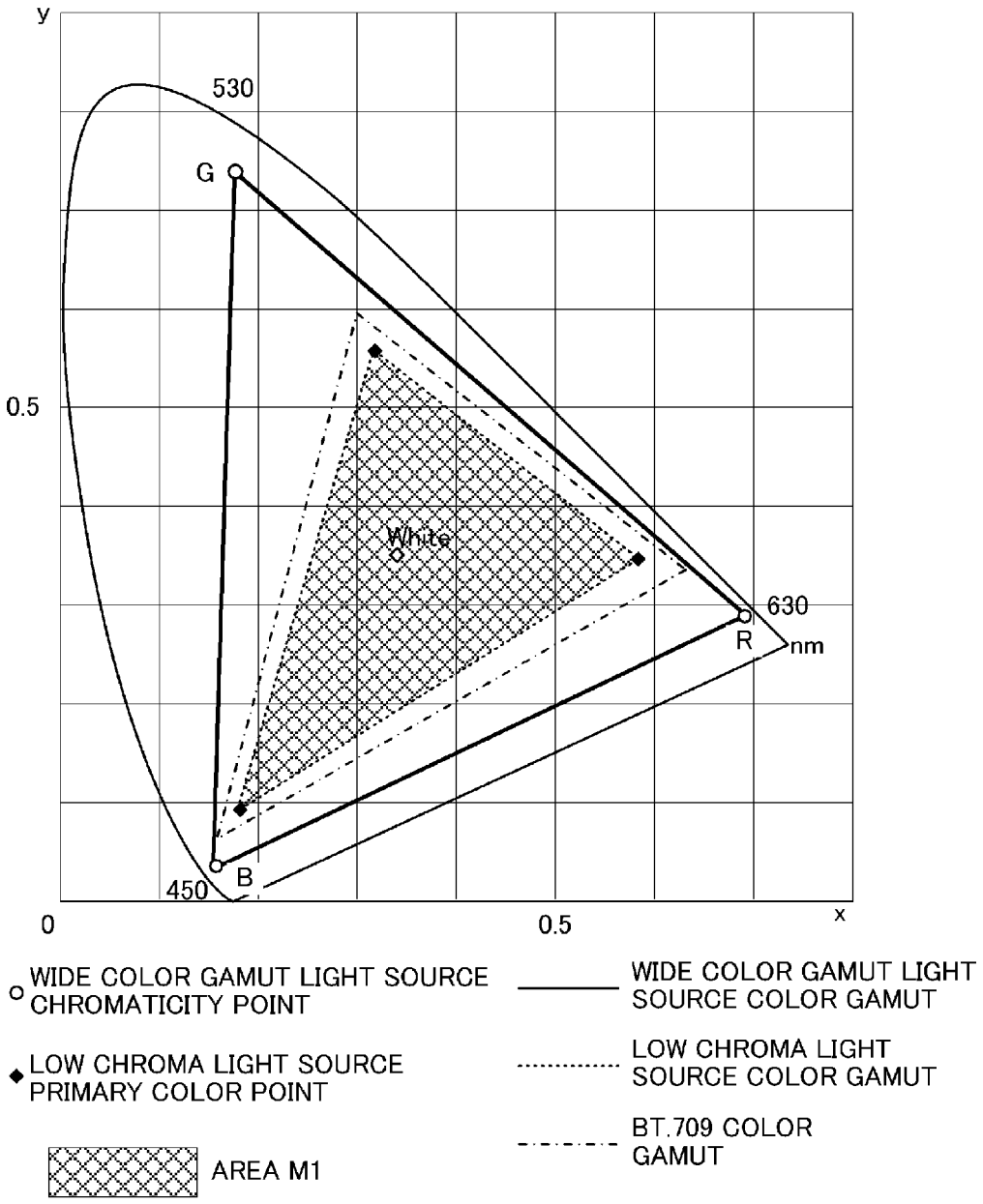
FIG. 11 is a conceptual diagram of a color gamut determining process having different determination regions.

In addition, color gamuts can be determined by the color gamut detecting unit 220 as shown in FIG. 11 so as to determine all color gamuts that can be displayed by the low chroma light source group as the area M1 and to eliminate the area M2. In this case, for example, the pink pixels in the input image shown in FIG. 10A are to be displayed in the second subframe that uses the low chroma light source group. In this manner, when the determination of a color gamut is performed so as to divide pixels into the area M1 that is not wider than a color gamut that can be displayed by the low chroma light source group and color gamuts other than the area M1, a ratio at which pixels belonging to the area M1 are distributed between a first image component (a high chroma component) and a second image component (a low chroma component) is assumed to be a first ratio. In addition, a ratio at which pixels belonging to color gamuts other than the area M1 are distributed between the first image component (the high chroma component) and the second image component (the low chroma component) is assumed to be a second ratio.

Meanwhile, when the determination of a color gamut is performed so as to divide pixels into the area M1, the area M2, and other color gamuts according to processing represented by the flow chart described above, a ratio at which pixels belonging to the area M1 are distributed between the first image component (the high chroma component) and the second image component (the low chroma component) is assumed to be a fourth ratio. A ratio at which pixels belonging to the area M2 are distributed between the first image component (the high chroma component) and the second image component (the low chroma component) is assumed to be a fifth ratio. In the flow chart described above, when a pixel value of a determination object pixel belongs to the area M1, the pixel is distributed at a ratio of 0% to the first image component and 100% to the second image component (the fourth ratio). When the pixel value of the determination object pixel belongs to the area M2, the pixel is distributed at a ratio of 50% to the first image component and 50% to the second image component (the fifth ratio). When the pixel value of the determination object pixel does not belong to either of the areas M1 and M2, the pixel is distributed at a ratio of 100% to the first image component and 0% to the second image component (the second ratio).

In addition, the display ratio D by the distribution determining unit 230 with respect to the area M1 need not necessarily be 100%. In other words, when M1 is determined as a color gamut determination result in step S2301 shown in FIG. 9, D may be set to a value smaller than 1 in step S2303. In this case, a pixel of a color close to white whose color gamut determination result is M1 is also displayed in a frame of a wide color gamut light source at a ratio of 1−D. In other words, a display ratio by the wide color gamut light source of a low chroma color pixel belonging to a color gamut close to a white point increases. When control is performed in this manner, while the effect of reducing individual variability in color perception decreases slightly, since a degree of temporal separation when displaying low chroma colors is reduced, there is less of a flicker sensation.

In a similar manner, when D is set to a value greater than 0 in step S2305, a pixel of a high chroma color whose color gamut determination result is neither M1 nor M2 is also displayed in a frame of a low chroma light source at a ratio of 1−D. In this case, while a color gamut of a displayed color becomes slightly narrower, flicker sensation is reduced.

The distribution ratio among frames in the respective color gamuts defined in step S2303, step S2304, and step S2305 can be set independently. For example, when the display ratio of high chroma color pixels is set to D=0 in step S2305 and the display ratio of pixels close to white is set to D=0.9 in step S2303, flicker sensation can be reduced by slightly reducing the effect of reducing individual variability in color perception without narrowing the color gamut.

Figure 12:
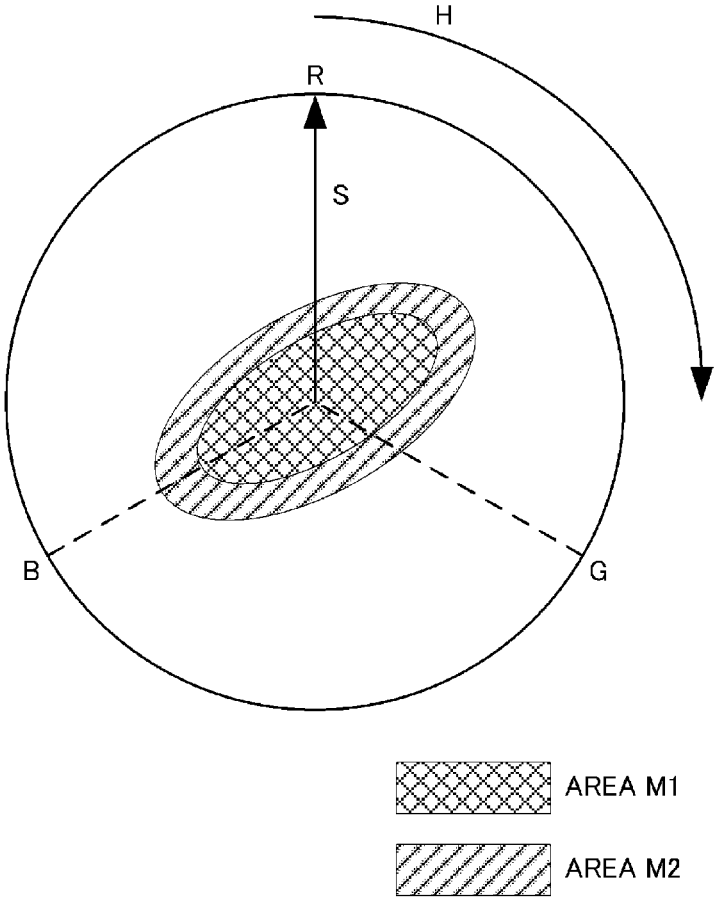
FIG. 12 is a conceptual diagram of a color gamut determining process based on an HSV color space.

In addition, detection and determination of a color gamut by the color gamut determining unit 20 can be performed by using a method other than detection based on an xy color space. For example, a determination can also be made using an HSV color space as shown in FIG. 12. More simply, a determination may be made solely based on chroma without flattening a determination area in a color direction.

Figure 13:
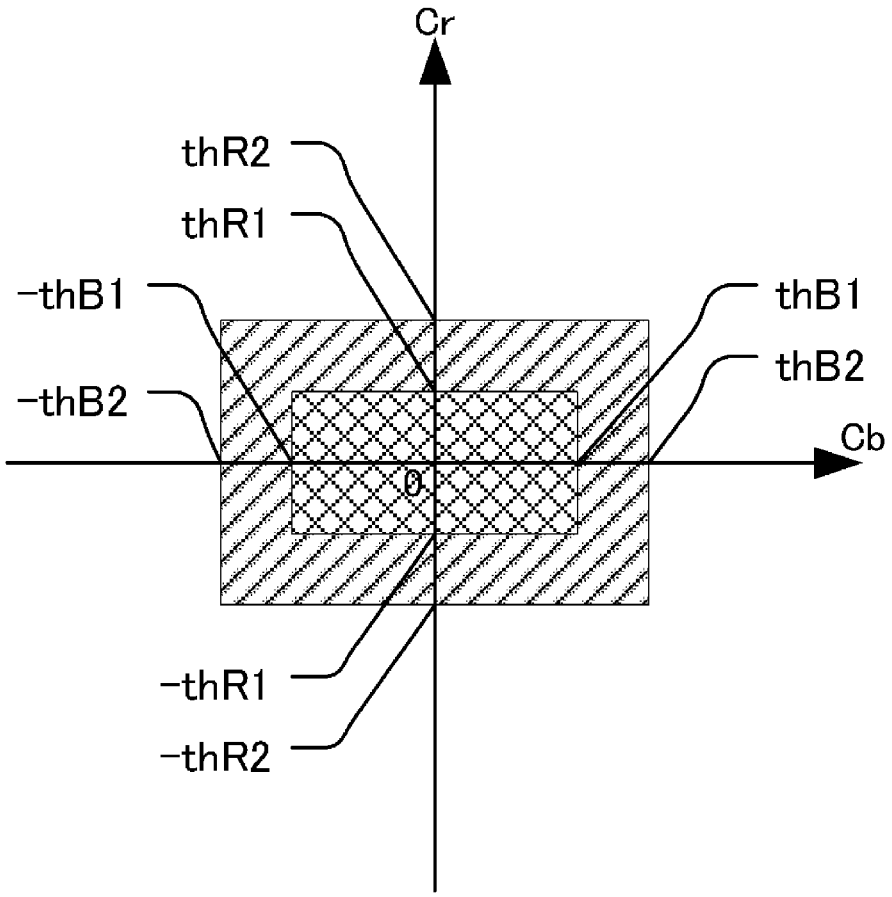
FIG. 13 is a conceptual diagram of a color gamut determining process based on a YCbCr color space.

Furthermore, for example, color gamut detection can be performed using a YCbCr color space as shown in FIG. 13 by a computation using component values and thresholds of Cb and Cr. In this case, by setting the display ratio D to $$D=Db^{**}Dr,$$

where Db takes values of $Db=1$ when $|Cb|<thB1$, $Db=(|Cb|-thB1)/(thB2-thB1)$ when $thB1\leq|Cb|<thB2$, and $Db=0$ when $thB2\leq|Cb|$, and Dr takes values of $Dr=1$ when $|Cr|<thR1$, $Dr=(|Cr|-thR1)/(thR2-thR1)$ when $thR1\leq|Cr|<thR2$, and $Dr=0$ when $thR2\leq|Cr|$, a display ratio of pixels of a color of intermediate chroma (the fifth ratio) can be distributed between the first subframe and the second subframe at a continuous value corresponding to chroma (a variable value corresponding to pixel value).

Moreover, while the backlight unit 72 exemplified in the first embodiment is a direct-type light source arrangement, the present invention can also be implemented using an edge light-type light source arrangement.

(Second Embodiment)

In a second embodiment, an example of reducing individual variability in color perception (increasing robustness) only with respect to a blue light source having relatively large individual variability in color perception will be described. A configuration of an image display device according to the second embodiment is approximately similar to that of the image display device according to the first embodiment.

In the second embodiment, laser light source are used as the wide color gamut light source group 721. While the lasers are preferably semiconductor lasers, wavelength converting layers such as a DPSS (diode pumped solid-state laser) may be used. Emission peak wavelengths of the respective light sources used in the second embodiment are set to blue laser: $\lambda b=430$ nm, green laser: $\lambda g=530$ nm, and red laser: $\lambda r=640$ nm.

In addition, a blue LED with a peak wavelength $\lambda bw=450$ nm is used as the low chroma light source group 722. Since the blue LED is used as a low chroma light source in the second embodiment, an LED with broader characteristics than the LED of the blue light source exemplified in the first embodiment is used. The approach to specific desirable characteristics is similar to that of the low chroma light source according to the first embodiment.

Figure 14:
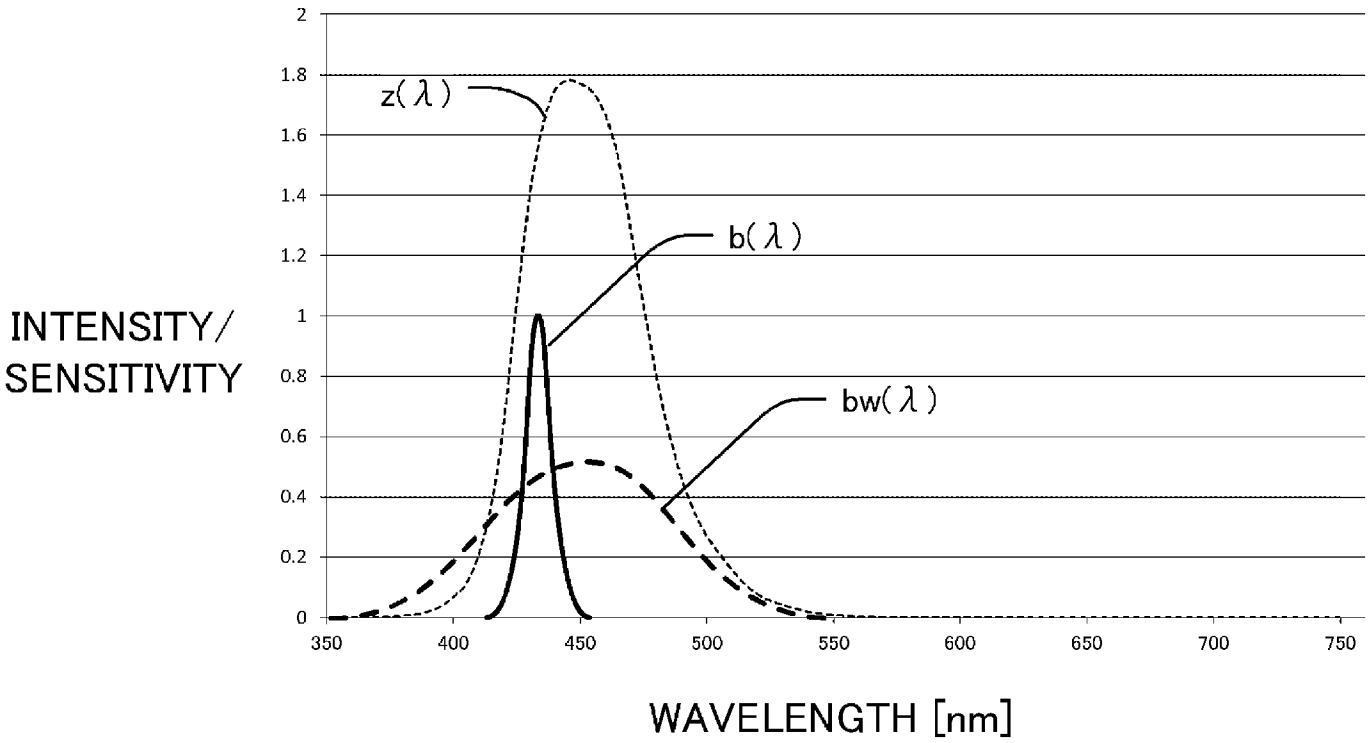
FIG. 14 is a diagram showing a relationship between characteristics of light sources and color matching functions according to a second embodiment.

FIG. 14 shows a relationship diagram of an emission spectrum b (λ) of the blue light source (blue laser) and an emission spectrum bw (λ) of a low chroma light source (blue LED) used in the second embodiment, and a color matching function.

In the first subframe, the backlight driving unit 60 lights a red laser, a green laser, and a blue laser as the wide color gamut light source group 721. In addition, in the second subframe, the backlight driving unit 60 lights the red laser, the green laser, and a blue LED as the low chroma light source group 722. In other words, the red laser and the green laser are shared between the wide color gamut light source group 721 and the low chroma light source group 722.

The present invention can be implemented by keeping other configurations and operations similar to those of the first embodiment.

As described above, the same light sources may be shared between the wide color gamut light source group 721 and the low chroma light source group 722 for some of the primary colors. When narrowband light sources are shared as in the second embodiment, an effect of reducing individual variability in color perception declines with respect to the shared primary color components. However, since individual variability in color perception occurs prominently in the blue component, by adopting a configuration in which an effect of reducing individual variability in color perception is produced with respect to the blue component, the problem can be sufficiently solved depending on the application of the image display device and cost reduction can be achieved. Conversely, when sharing broadband light sources, while individual variability in color perception can be effectively reduced, an effect of expanding a displayable color gamut with respect to color components corresponding to the shared light sources declines.

In addition, in the second embodiment, the image separating unit 40 may perform control of the output level of the double speed input image 11 based on the display ratio 21 only on the blue component. In this case, respective ratios (third ratios) of distribution of the red component and the green component to the respective subframes are set to 50% to the first subframe and 50% to the second subframe. Since adopting such a configuration results in outputs of the red light source and the green light source to be leveled across subframes, a system can be designed by reducing a maximum rating of each light source. However, the values of the third ratio are simply an example and are not limited to these specific ones. In the second embodiment, only a spectrum of light used to display a prescribed primary color (in this case, blue) among the plurality of primary colors included in the light emitted by the low chroma light source (the second light) is broader than a spectrum of light used to display the prescribed primary color included in the light emitted by the wide color gamut light source (the first light). In such a case, with respect to a low chroma pixel, a color component of the prescribed primary color (blue) may be distributed between image components of the respective subframes at the display ratio D and color components of primary colors other than the prescribed primary color (red and green) may be equally distributed between the image components of the respective subframes.

Furthermore, in the second embodiment, a configuration may be adopted in which only the blue LED is lighted as the low chroma light source group 722 in the second subframe. In this case, the image separating unit 40 distributes 100% of the red component and the green component of the double speed input image 11 to the first subframe. In this case, the light emitted by the low chroma light source (the second light) only includes light used to display the prescribed primary color (blue). In such a case, with respect to a low chroma pixel, a color component of the prescribed primary color (blue) may be distributed between image components of the respective subframes at the display ratio D and color components of primary colors other than the prescribed primary color (red and green) may be entirely distributed to the high chroma image component (the first image component).

In addition, the wide color gamut light source group 721 and the low chroma light source group 722 can be configured using light sources other than the LED light sources exemplified in the first embodiment and the laser light sources exemplified in the second embodiment. For example, the present invention can be implemented with an approximately similar configuration even using a light source based on different emission principles such as an organic EL element and an ultraviolet-excited phosphor light source or a light source in which white light is filtered by a color filter.

(Third Embodiment)

In a third embodiment, an example of configuring the low chroma light source group 722 by combining a plurality of light sources with different characteristics will be described. A configuration of an image display device according to the third embodiment of the present invention is substantially identical to that of the image display device according to the first embodiment.

LEDs are used as the wide color gamut light source group 721 in a similar manner to the first embodiment. Emission peak wavelengths of the respective light sources constituting the wide color gamut light source group 721 are set to blue LED 1: λb1=430 nm, green LED: λg=530 nm, and red LED: λr=630 nm.

Meanwhile, the low chroma light source group 722 is constituted by four LEDs including blue LEDs shared partially as the wide color gamut light source, where blue LED 1: λb1=430 nm (shared with the wide color gamut light source group 721), blue LED 2: λb2=470 nm (exclusively used by the low chroma light source group), green LED: λg=530 nm (shared with the wide color gamut light source group 721), and red LED: λr=630 nm (shared with the wide color gamut light source group 721).

In the first subframe, the backlight driving unit 60 lights the red LED, the green LED, and the blue LED 1 as the wide color gamut light source group 721. Furthermore, in the second subframe, the red LED and the green LED are lighted as the low chroma light source group 722 at similar intensities as in the first subframe and the blue LED 1 and the blue LED 2 are lighted at half the intensity of the first subframe.

Figure 15A:
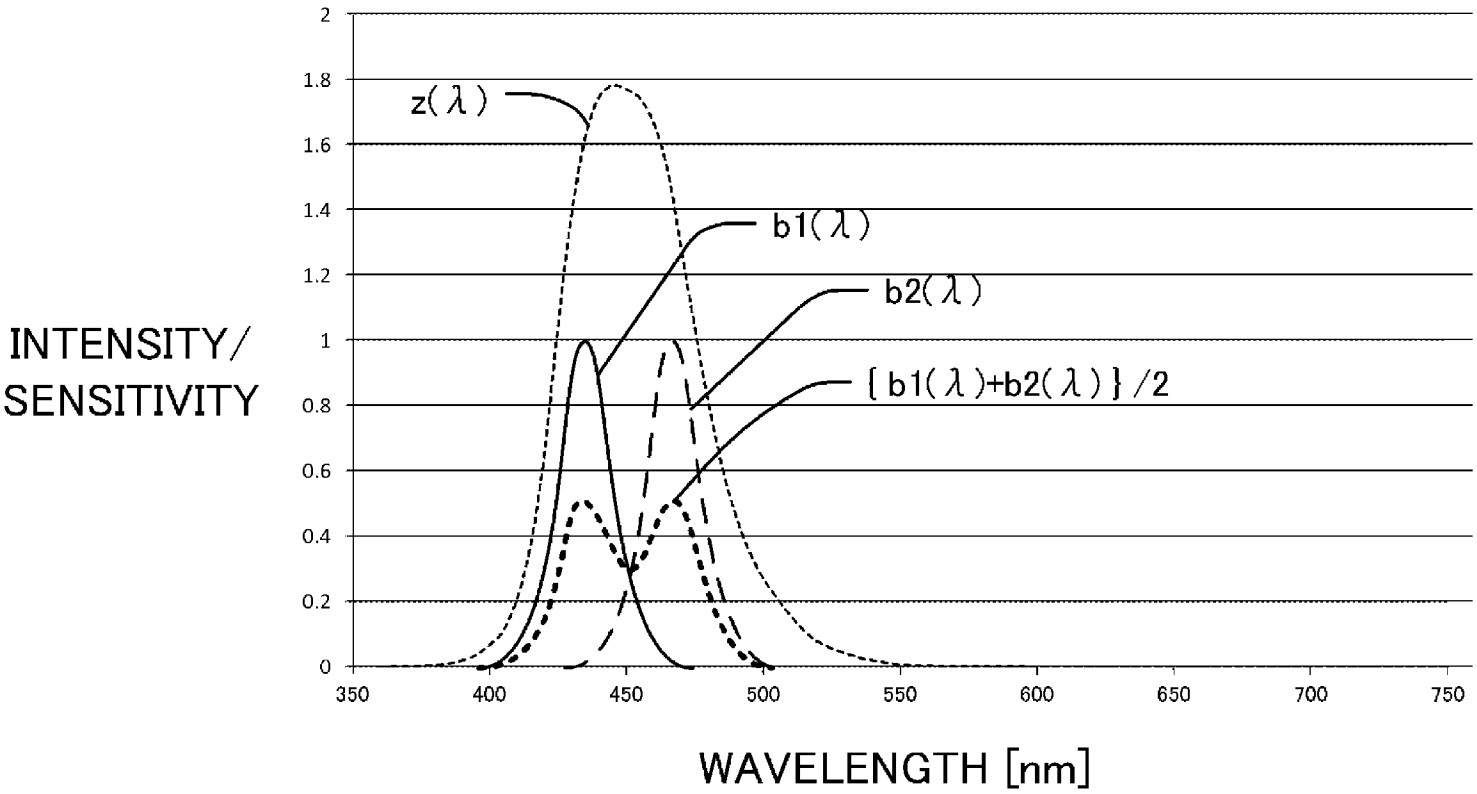
FIGS. 15A and 15B are diagrams showing relationships between characteristics of light sources and color matching functions according to a third embodiment.

FIG. 15A shows a relationship diagram of an emission spectrum b1 (λ) of the blue LED 1, an emission spectrum b2 (λ) of the blue LED 2, and a color matching function. Since the low chroma light source group 722 according to the third embodiment is a composite of the blue LED 1 and the blue LED 2, a composite spectrum thereof is expressed by $\{b1(\lambda)+b2(\lambda)\}/2$. As characteristics of light sources for obtaining the effect of the present invention, the composite spectrum need only satisfy the conditions described in the first embodiment.

The present invention can be implemented by keeping other configurations and operations similar to those of the first embodiment.

Figure 15B:
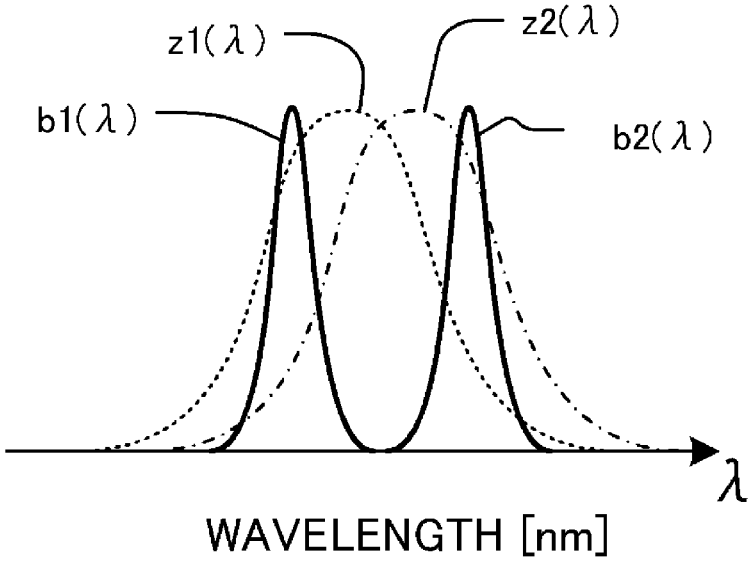

When a low chroma light source group is configured by combining light sources of different wavelengths as in the third embodiment, light source characteristics may be selected according to a different way of thinking. FIG. 15B shows a conceptual diagram of a relationship between light source characteristics and color matching functions in this case.

In the drawing, a color matching function of the observer A is denoted by z1 (λ), a color matching function of the observer B is denoted by z2 (λ), a spectrum of a light source 1 is denoted by b1 (λ), and a spectrum of a light source 2 is denoted by b2 (λ). In this case, stimuli ZA' and ZB' that are sensed by the observer A and the observer B are respectively expressed as $$ZA'=\int(b1(\lambda)+b2(\lambda))z1(\lambda)d\lambda.$$

$$ZB'=\int(b1(\lambda)+b2(\lambda))z2(\lambda)d\lambda \quad \text{[Expression 4]}$$

Let us assume that D1 represents a difference between a stimulus ∫b1 (λ) z1 (λ) dλ received by the observer A from the light source b1 and a stimulus ∫b1 (λ) z2 (λ) dλ received by the observer B from the light source b1. Let us also assume that D2 represents a difference between a stimulus ∫b2 (λ) z1 (λ) dλ received by the observer A from the light source b2 and a stimulus ∫b2 (λ) z2 (λ) dλ received by the observer B from the light source b2. In a spectral relationship such as that shown in FIG. 15B, the differences D1 and D2 have a substantially mutually complementary relationship (D1+D2≅0). Although not strictly ZA'=ZB', the difference between ZA' and ZB' is significantly smaller than the difference between ZA and ZB. Therefore, the stimuli can practically be considered sufficiently equivalent.

In order to satisfy such a relationship, wavelengths of the two light sources are favorably set outside of a fluctuation range of peaks of color matching functions of all observers serving as subjects.

As a selection example of light sources based on the thinking described above, the present invention can also be implemented by configuring the light sources such that blue LED 1: λb1=420 nm (shared with the wide color gamut light source group 721), and blue LED 2: λb2=480 nm (exclusively used by the low chroma light source group).

Figure 16:
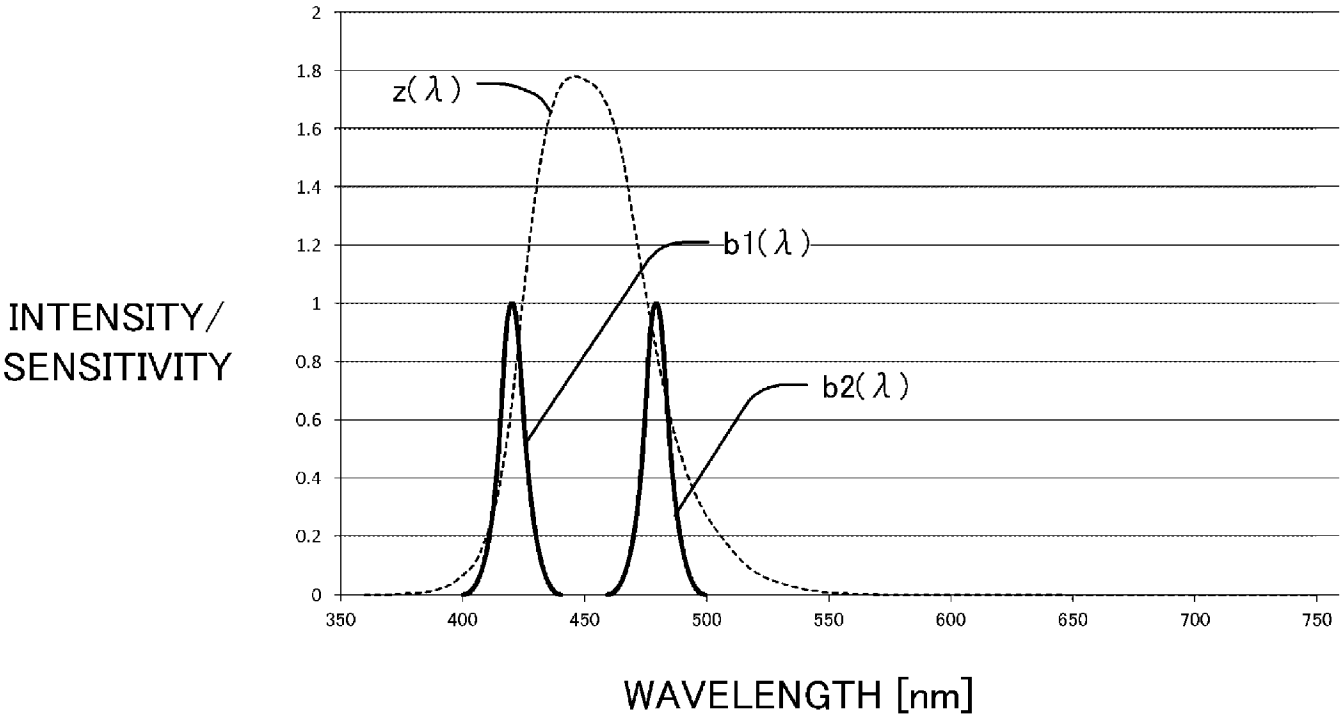
FIG. 16 is a diagram showing a relationship between characteristics of light sources selected according to a different way of thinking and color matching functions.

FIG. 16 shows a relationship diagram between emission spectra of the blue LED 1 and the blue LED 2 and color matching functions in this case.

When selecting light source characteristics, essentially, it suffices that a fluctuation of an integration of a product of a color matching function and an emission spectrum of a light source is sufficiently small with respect to a fluctuation of the color matching function. In other words, by selecting an emission spectrum and an emission intensity of each LED so as to satisfy $$\int(Pb1\cdot b1(\lambda)+Pb2\cdot b2(\lambda))z1(\lambda)\approx\int(Pb1\cdot b1(\lambda)+Pb2\cdot b2(\lambda))z2(\lambda)d\lambda \quad \text{[Expression 5]}$$

where b1 (λ): emission spectrum of LED 1,

Pb1: emission intensity of LED 1, b2 (λ): emission spectrum of LED 2, and Pb2: emission intensity of LED 2, the present invention can be implemented without diminishing the essence of the present invention even when applying a selection method other than the selection methods exemplified in the first and third embodiments. Alternatively, light sources may be selected so that emission peak wavelengths of a plurality of LEDs are all within a transmission wavelength range of a color filter.

(Fourth Embodiment)

In the first to third embodiments, examples of application of the present invention to direct-type image display devices in which an image formed on a modulating unit that modulates transmittance of light from an illuminating unit have been described. The present invention can also be applied to a projecting-type image display device in which an image formed on a modulating unit that modulates transmittance or reflectance of light from an illuminating unit is projected onto a screen.

Figure 17:
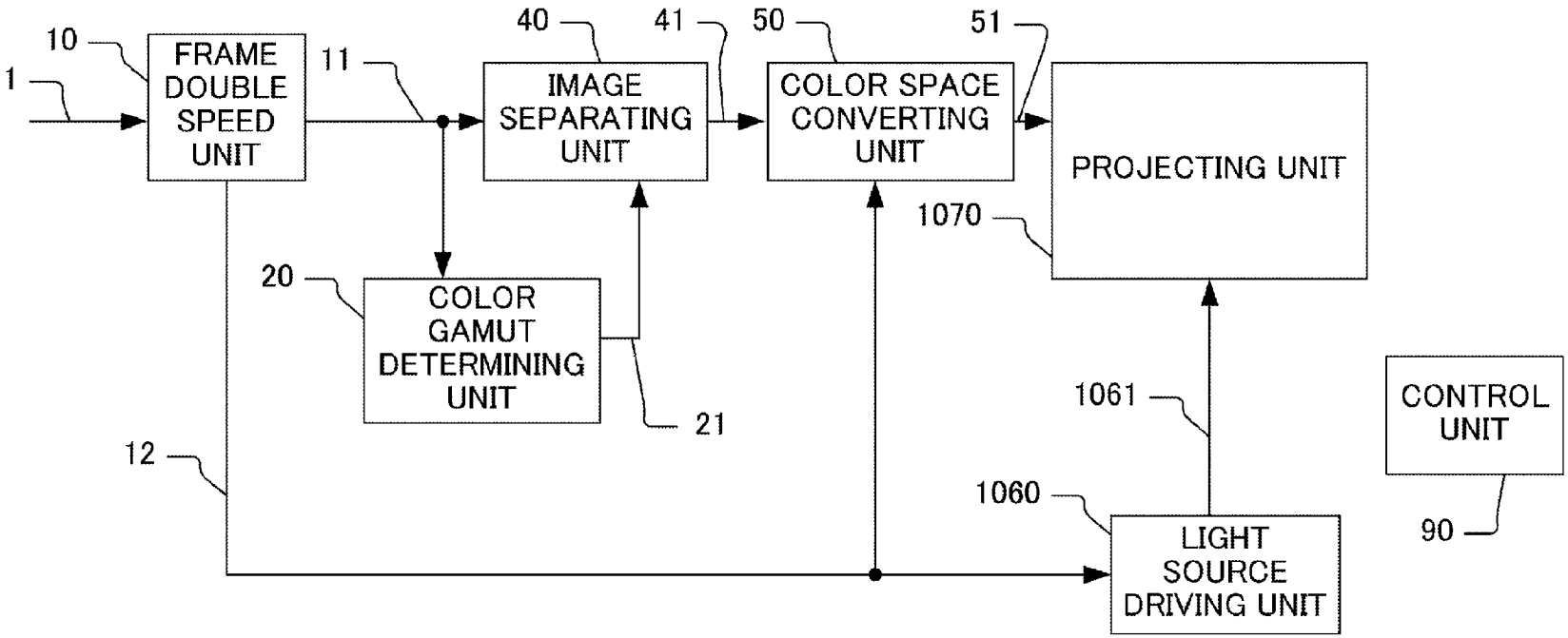
FIG. 17 is a configuration diagram of an image display device according to a fourth embodiment.

FIG. 17 shows a configuration diagram of an image display device according to a fourth embodiment of the present invention.

Figure 18:
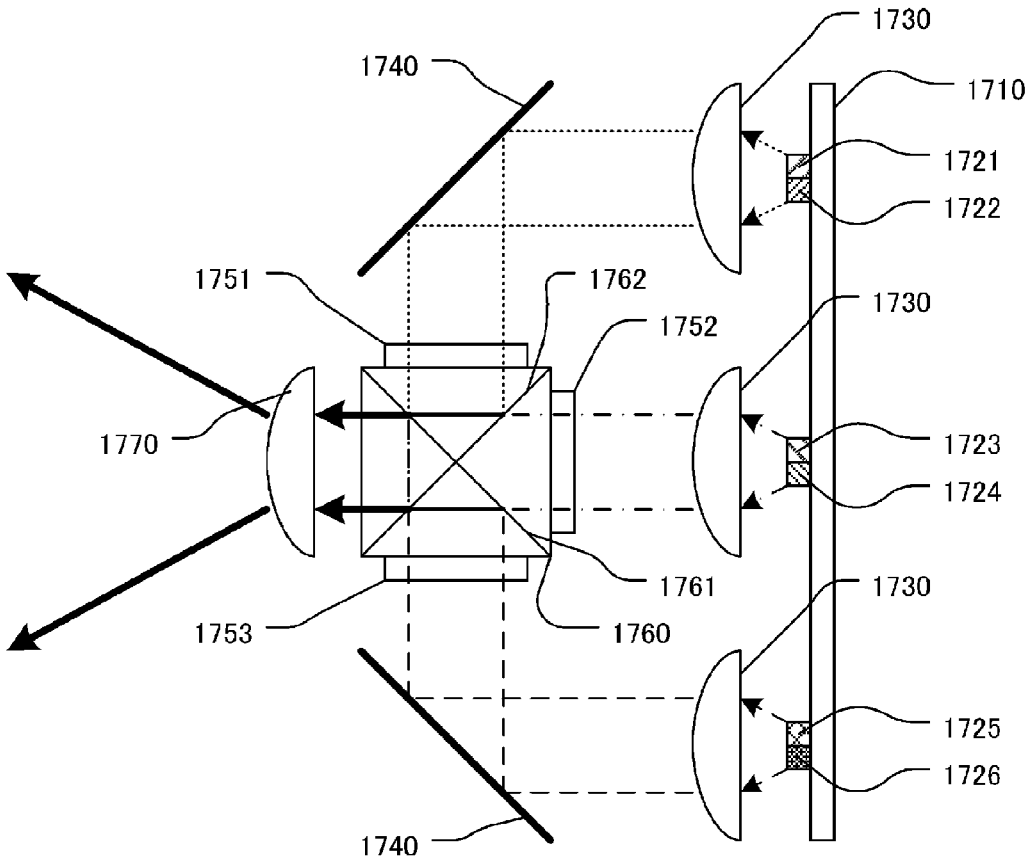
FIG. 18 is a configuration diagram of a projecting unit 1070.

A projecting unit 1070 projects an image according to a light source drive signal 1061 and the corrected pixel value 51. FIG. 18 shows a configuration diagram of the projecting unit 1070.

A light source substrate 1710 is a substrate on which light source elements are mounted.

As a wide color gamut light source group, a red laser 1721, a green laser 1723, and a blue laser 1725 are used. In addition, as a low chroma light source group, a red LED 1722, a green LED 1724, and a blue LED 1726 are used. Emission peak wavelengths of the respective light sources are assumed to be blue laser: λb=430 nm, green laser: λg=520 nm, red laser: λr=640 nm, blue LED: λbw=450 nm, green LED: λgw=550 nm, and red LED: λrw=610 nm.

Figure 19A:
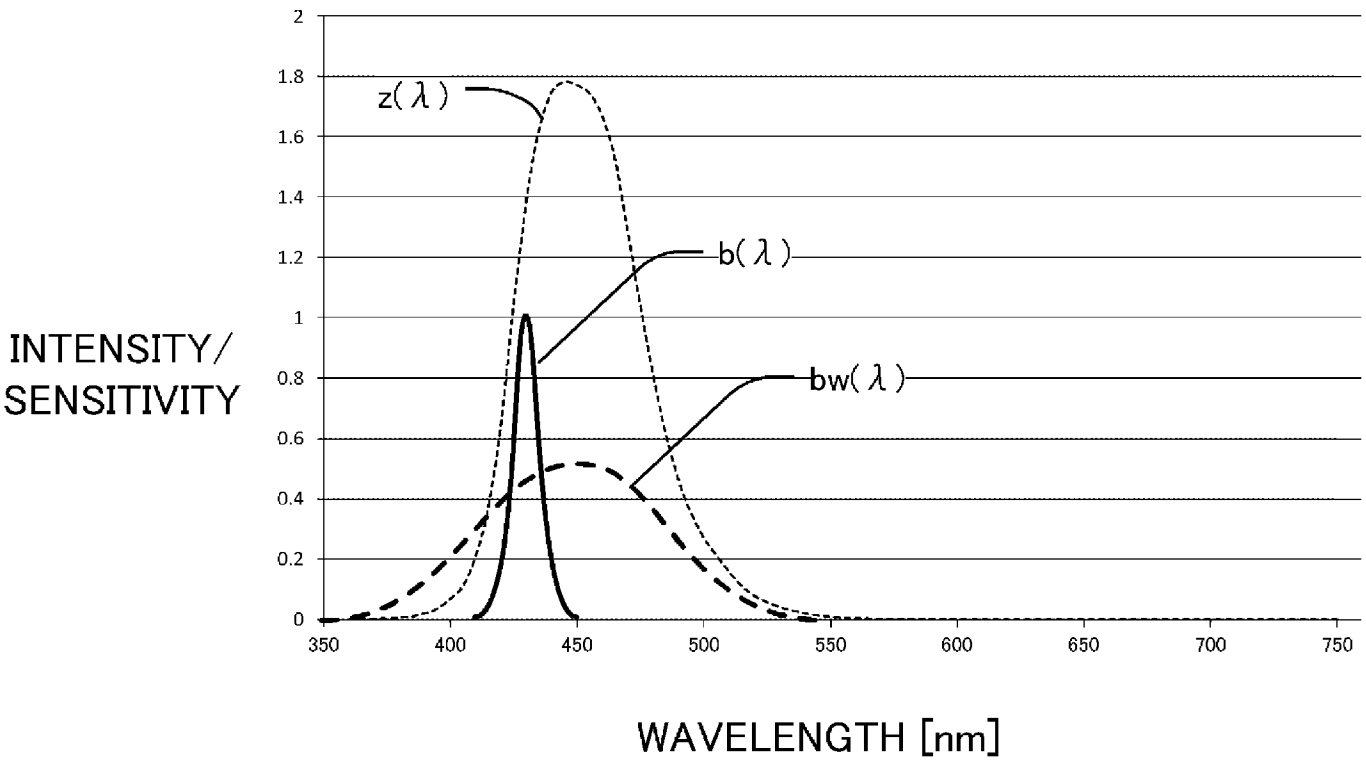
FIGS. 19A to 19C are relationship diagrams between light sources and color matching functions according to the fourth embodiment.
Figure 19B:
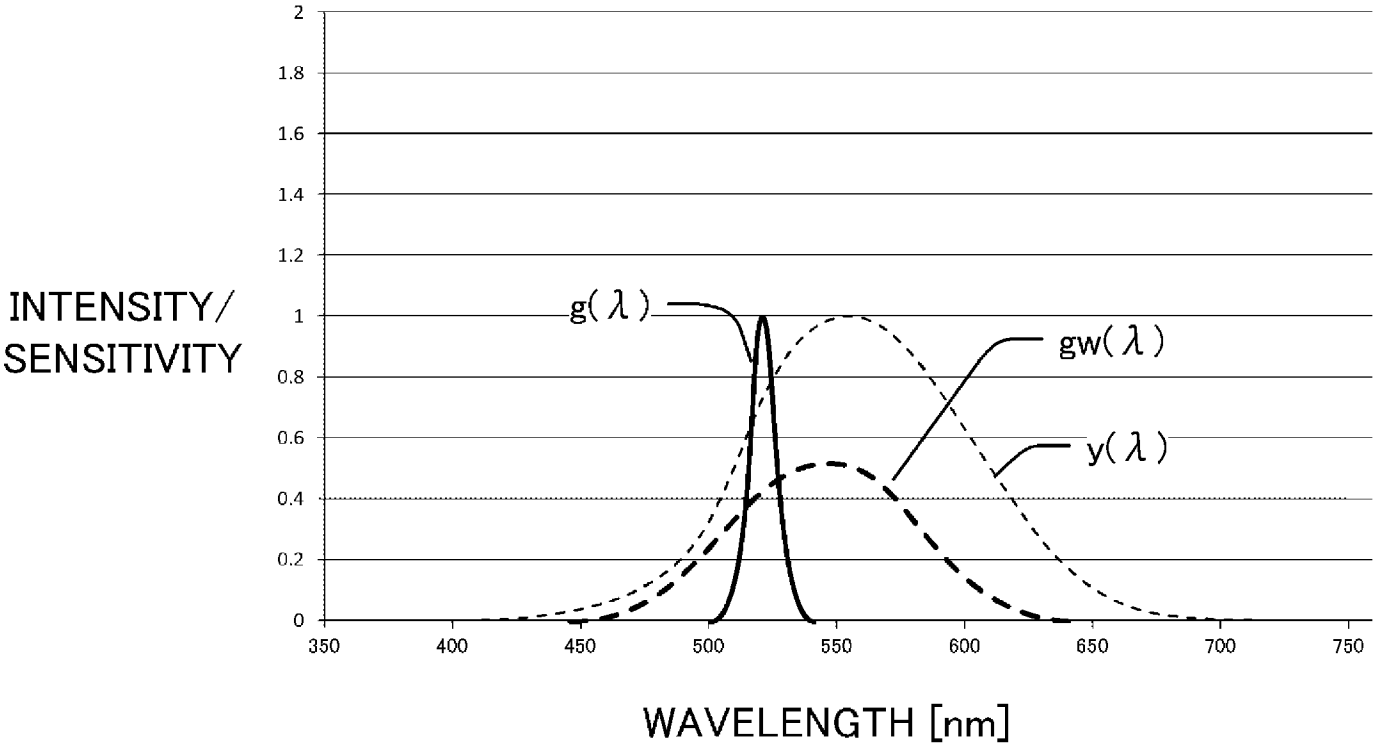
Figure 19C:
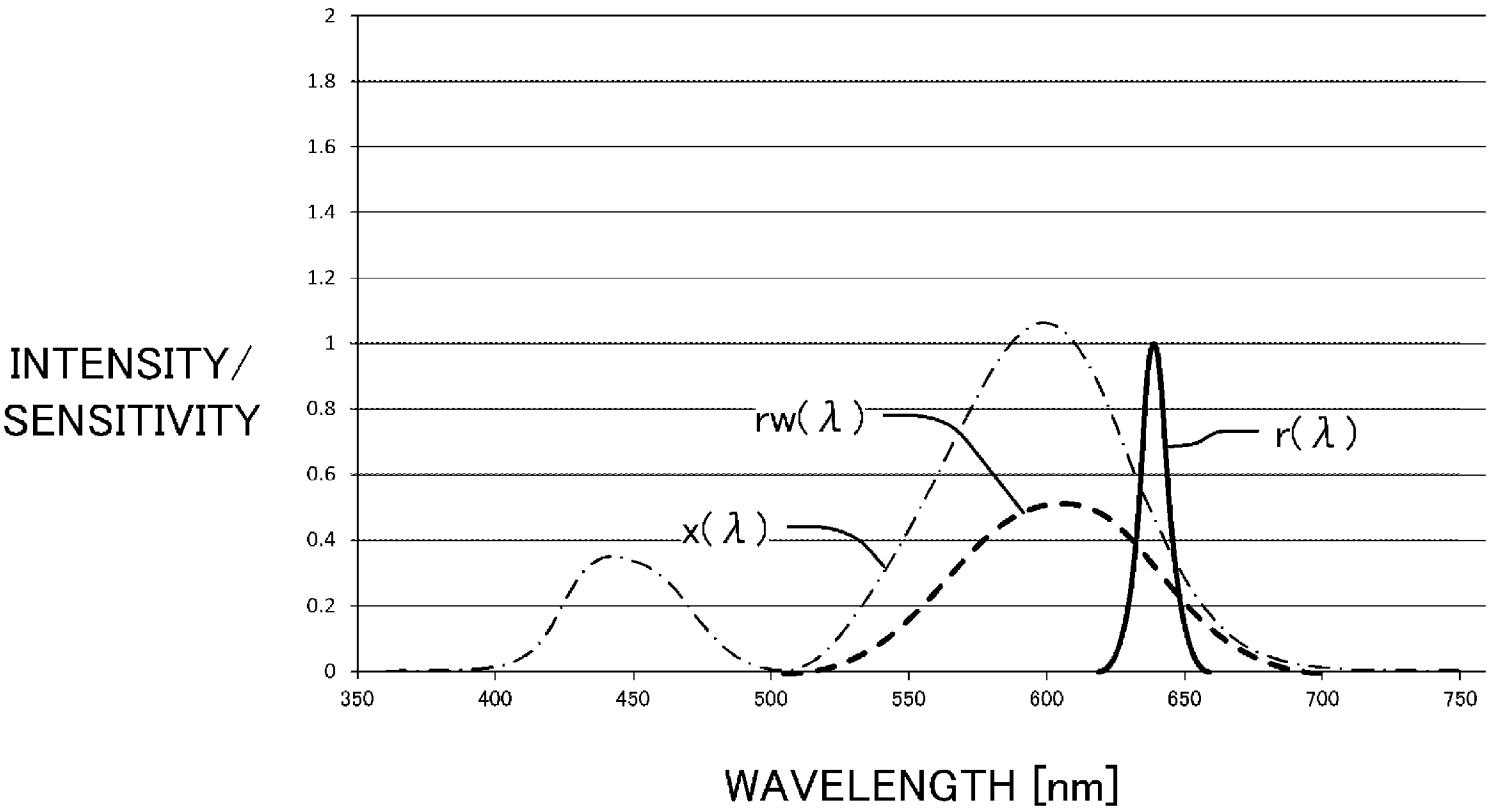

FIG. 19 shows a relationship diagram between emission spectra of the respective light sources and color matching functions. In FIG. 19, the emission spectrum of the red laser is represented by r (λ), the emission spectrum of the green laser is represented by g (λ), and the emission spectrum of the blue laser is represented by b (λ). In addition, the emission spectrum of the red LED is represented by rw (λ), the emission spectrum of the green LED is represented by gw (λ), and the emission spectrum of the blue LED is represented by bw (λ).

A condensing lens 1730 is a lens that condenses light emitted from the respective LED elements to create parallel light.

A reflective mirror 1740 changes an optical path of the condensed light source light and causes the condensed light source light to enter an LCD panel (to be described later).

An LCD panel R 1751 forms a gradation of a red component of the corrected pixel value 51 in a plane and modulates red light source light emitted from the red laser 1721 and the red LED 1722.

An LCD panel G 1752 and an LCD panel B 1753 modulate green and blue light source light in a similar manner.

A dichroic prism 1760 composites light source light independently modulated for the three RGB primary colors into a single optical path. A B reflective surface 1761 reflects light in the blue wavelength range and transmits light in other wavelength ranges. In addition, an R reflective surface 1762 reflects light in the red wavelength range and transmits light in other wavelength ranges.

A projecting lens 1770 projects modulated light that is a composite of the three RGB primary colors onto a screen.

A light source driving unit 1060 outputs a light source drive signal 1061 for alternately driving the wide color gamut light source group and the low chroma light source group based on the double speed timing signal 12. When the double speed timing signal 12 is a value representing the first subframe, the light source driving unit 1060 outputs a light source drive signal 1061 for driving the wide color gamut light source group 721. In addition, when the double speed timing signal 12 is a value representing the second subframe, the light source driving unit 1060 outputs a light source drive signal 1061 for driving the low chroma light source group 722.

The present invention can even be implemented with a projecting-type image display device by keeping other configurations and control similar to those of the first embodiment.

In addition, the present invention can be implemented with approximately the same configuration even using other light sources such as an ultraviolet-excited phosphor light source and an organic EL light source.

(Fifth Embodiment)

In a fifth embodiment, an example in which the present invention is applied to a projecting-type image display device which temporally divides a color component and projects an image onto a screen will be described.

Figure 20:
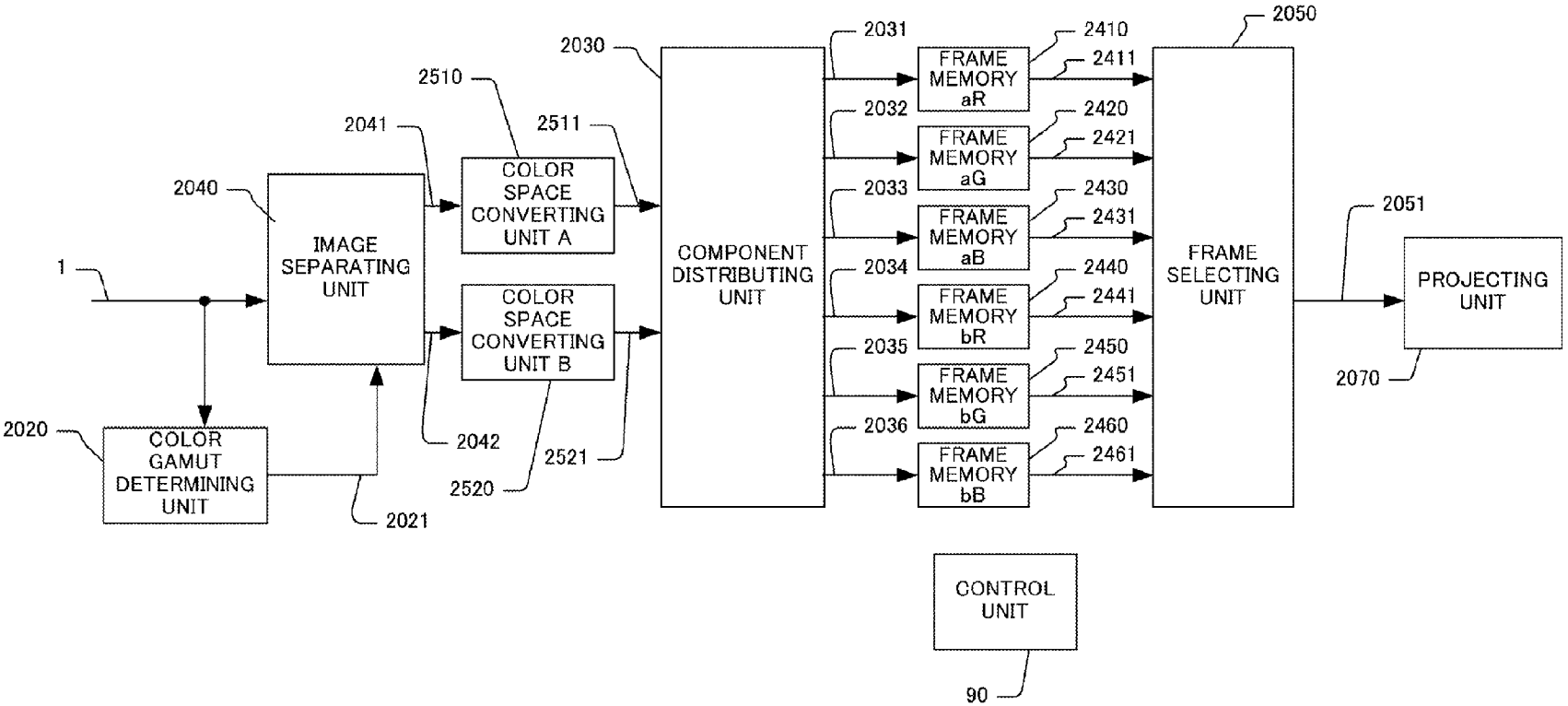
FIG. 20 is a configuration diagram of an image display device according to a fifth embodiment.

FIG. 20 shows a configuration diagram of an image display device according to a fifth embodiment of the present invention.

A color gamut determining unit 2020 performs a color gamut determination of the input image 1 according to a configuration and procedures approximately similar to those of the color gamut determining unit 20 according to the first embodiment. A display ratio of a wide color gamut light source subframe is outputted as a color gamut determination result 2021.

An image separating unit 2040 separates the input image 1 into a wide color gamut subframe 2041 and a low chroma subframe 2042. An image obtained by multiplying the input image 1 by the color gamut determination result 2021 (display ratio) is the wide color gamut subframe 2041. In addition, an image obtained by multiplying the input image 1 by a coefficient resulting from subtracting the color gamut determination result 2021 (display ratio) from 1 and inverting the subtraction result is the low chroma subframe 2042.

A color space converting unit A 2510 internally has a wide color gamut matrix coefficient for mapping from a color space of the input image 1 to a color space of the wide color gamut light source group, subjects a pixel value of the wide color gamut subframe 2041 to matrix conversion, and outputs a corrected wide color gamut subframe 2511.

A color space converting unit B 2520 includes a robust matrix coefficient for mapping from the color space of the input image 1 to a color space of the low chroma light source group, subjects a pixel value of the low chroma subframe 2042 to matrix conversion, and outputs a corrected low chroma subframe 2521.

A component distributing unit 2030 subjects the corrected wide color gamut subframe 2511 and the corrected low chroma subframe 2521 to color separation. The component distributing unit 2030 extracts a red component of the corrected wide color gamut subframe 2511 and outputs a wide color gamut R component 2031. In a similar manner, the component distributing unit 2030 extracts and outputs a wide color gamut G component 2032 and a wide color gamut B component 2033 from the corrected wide color gamut subframe 2511. Furthermore, the component distributing unit 2030 extracts and outputs a low chroma R component 2034, a low chroma G component 2035, and a low chroma B component 2036 from the corrected low chroma subframe 2521.

A frame memory aR 2410 accumulates the wide color gamut R component 2031 and outputs an accumulated wide color gamut R component 2411 in response to a request from a frame selecting unit 2050. A frame memory aG 2420, a frame memory aB 2430, a frame memory bR 2440, a frame memory bG 2450, and a frame memory bB 2460 perform similar operations. In other words, these frame memories output an accumulated wide color gamut G component 2421, an accumulated wide color gamut B component 2431, an accumulated low chroma R component 2441, an accumulated low chroma G component 2451, and an accumulated low chroma B component 2461.

The frame selecting unit 2050 sequentially reads out the accumulated wide color gamut R component 2411 to the accumulated low chroma B component 2461 at a speed (frequency) that is 6 times the input image 1 and outputs a selected image 2051. Since color components of the selected image 2051 have been separated, the selected image 2051 is a grayscale image for each color component.

Figure 21:
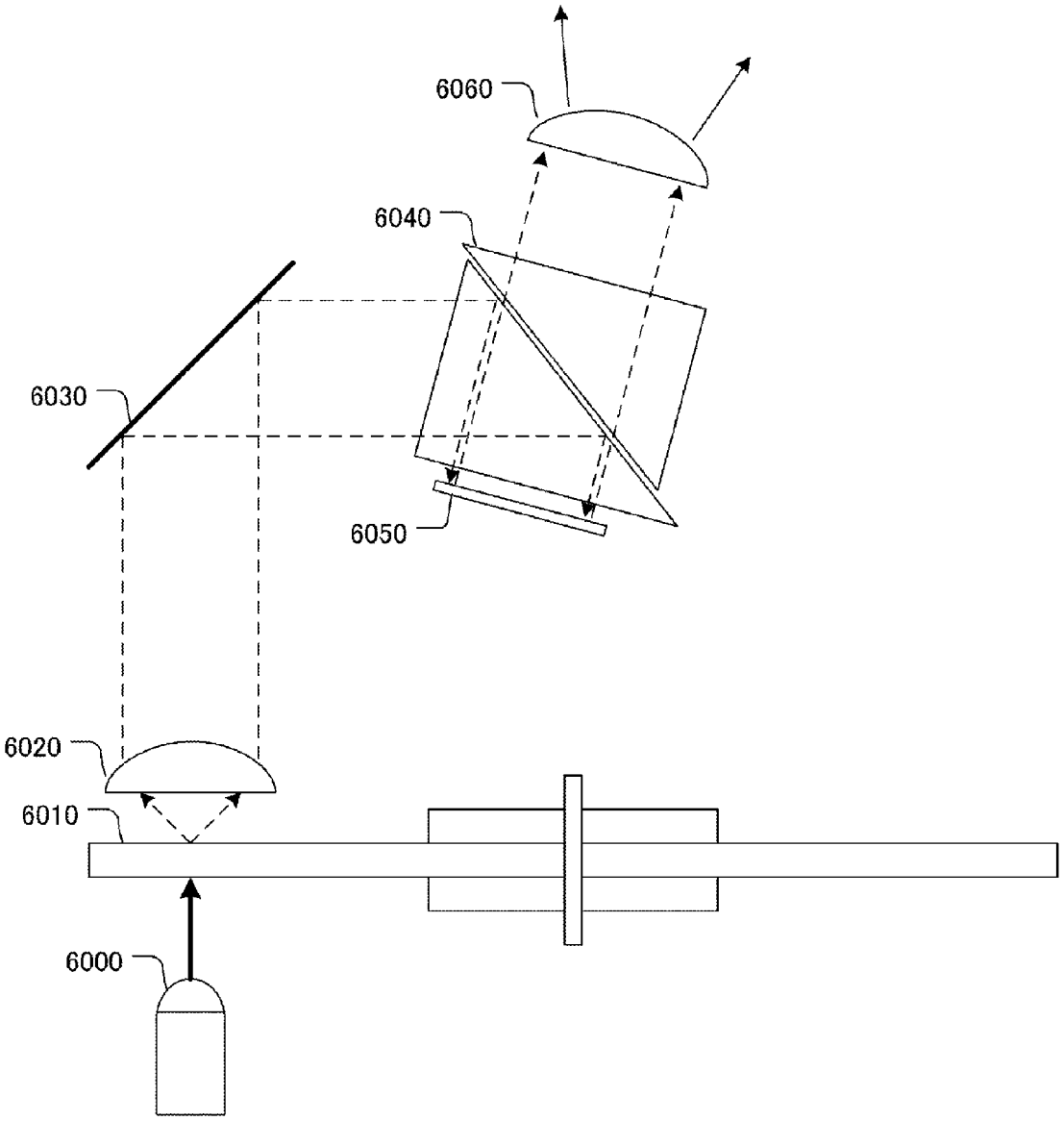
FIG. 21 is a configuration diagram of a projecting unit 2070.

A projecting unit 2070 projects an image in accordance with the selected image 2051. FIG. 21 shows a configuration diagram of the projecting unit 2070. The projecting unit 2070 according to the fifth embodiment is constituted by a light source 6000, a color wheel 6010, a condensing lens 6020, a reflective mirror 6030, a prism 6040, an optical modulator 6050, and a projecting lens 6060. Dotted lines in the drawing depict an optical path of light irradiated from the light source 6000.

The light source 6000 is a light source that causes light of red (R), blue (B), and green (G) necessary for color display to be emitted from the color wheel 6010. The light source 6000 uses a light-emitting diode which is made of an InGaN based material and which emits ultraviolet light with an emission wavelength of approximately 380 nm. The light source 6000 emits light when a current is applied to the light source 6000.

The color wheel 6010 is a wavelength converting member that converts ultraviolet light irradiated by the light source 6000 into visible light respectively made up of red (R), blue (B), and green (G) necessary for color display. A phosphor layer is formed in the color wheel 6010 as a wavelength converting layer that converts inputted ultraviolet light into visible light. Ultraviolet light is wavelength-converted into visible light by the phosphor layer. Details of the color wheel 6010 will be described later.

The condensing lens 6020 is a lens that condenses visible light emitted from the color wheel 6010 to create parallel light.

The reflective mirror 6030 is a reflective mirror which is positioned on an optical path of the light emitted from the condensing lens 6020 and which converts an optical axis toward the prism 6040.

Figure 22A:
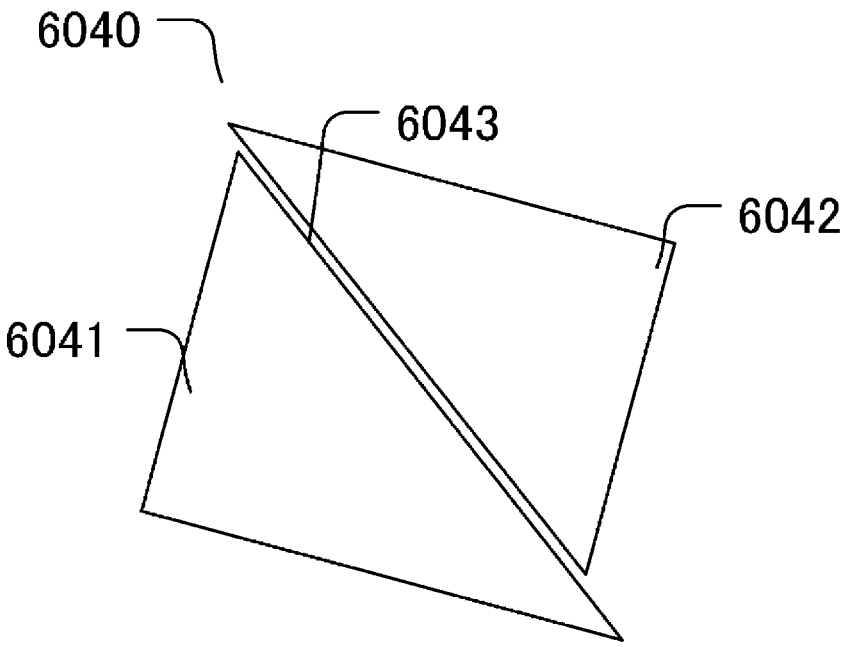
FIGS. 22A and 22B are structural diagrams of a prism 6040 and a sectional view of a color wheel 6010.

The prism 6040 is used as a polarizing splitter. As shown in FIG. 22A, the prism 6040 is structured such that glass base materials 6041 and 6042, which are both triangular, are bonded together so as to sandwich a bonding layer 6043 constituted by a polarized light separating film and a bonding film.

The optical modulator 6050 modulates light emitted from the color wheel 6010 by changing, in accordance with a gradation of each pixel in the selected image 2051, reflectance of a reflective liquid crystal display element corresponding to each pixel.

The projecting lens 6060 is a lens that enlarges and projects light that is modulated by the optical modulator 6050 onto a screen.

Figure 22B:
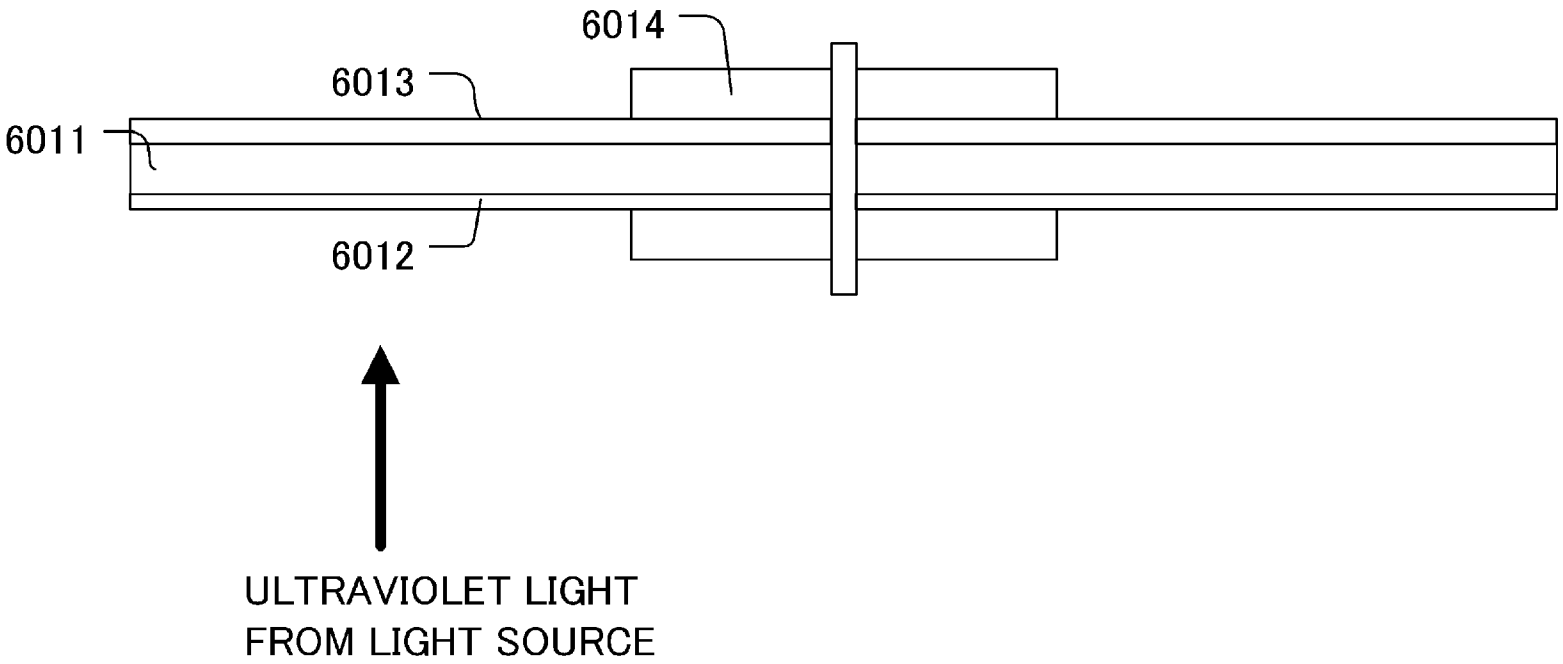

Next, details of the color wheel 6010 will now be described. FIG. 22B is a sectional view of the color wheel 6010.

The color wheel 6010 is constituted by a transparent substrate 6011 which can be rotated by a motor 6014, a visible light reflecting film 6012, and a phosphor layer 6013.

Quartz glass that transmits, without modification, ultraviolet light irradiated from the light source 6000 is used as the transparent substrate 6011.

Figure 23:
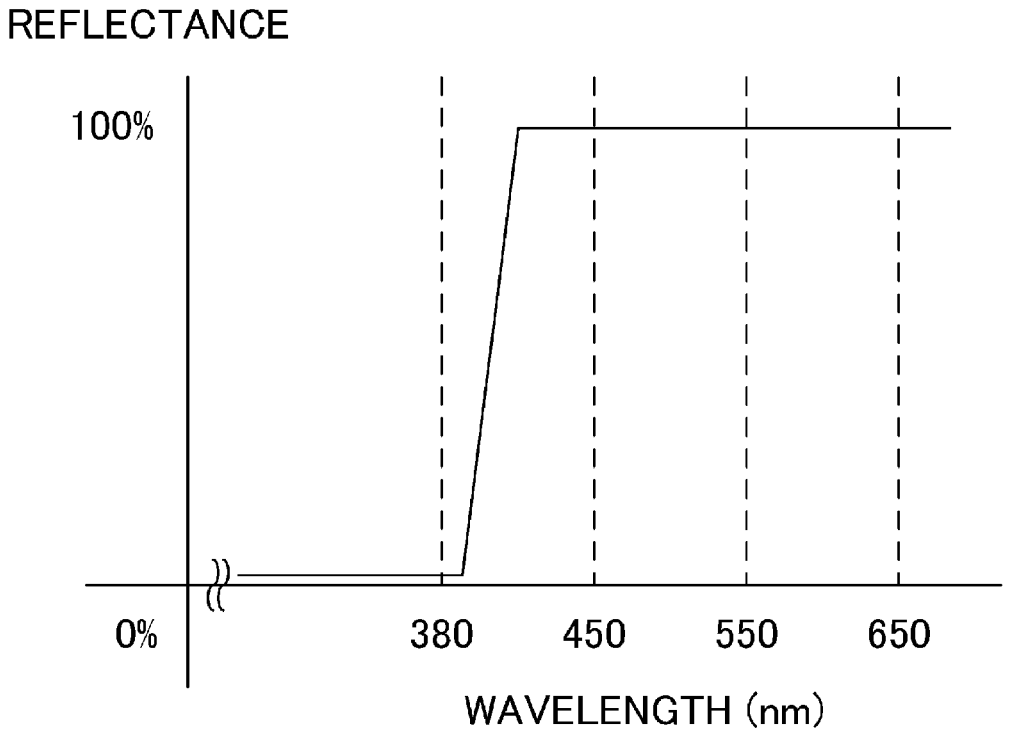
FIG. 23 shows reflection characteristics of a visible light reflecting film 6012.

The visible light reflecting film 6012 has characteristics of transmitting ultraviolet light irradiated by the light source 6000 and reflecting visible light. Therefore, the ultraviolet light irradiated by the light source 6000 can reach the phosphor layer 6013 in an efficient manner. FIG. 23 is a diagram showing reflection characteristics of the visible light reflecting film 6012 that reflects light with wavelengths equal to or more than approximately 400 nm.

The phosphor layer 6013 on the emitting side of the transparent substrate 6011 has characteristics of being excited by ultraviolet light with a wavelength of approximately 380 nm. Emission characteristics of the phosphor layer 6013 can be changed by varying a composition of a compound.

The motor 6014 is controlled by the control unit 90 so as to cause one rotation of the color wheel 6010 in one frame period of the input image 1.

Figure 24B:
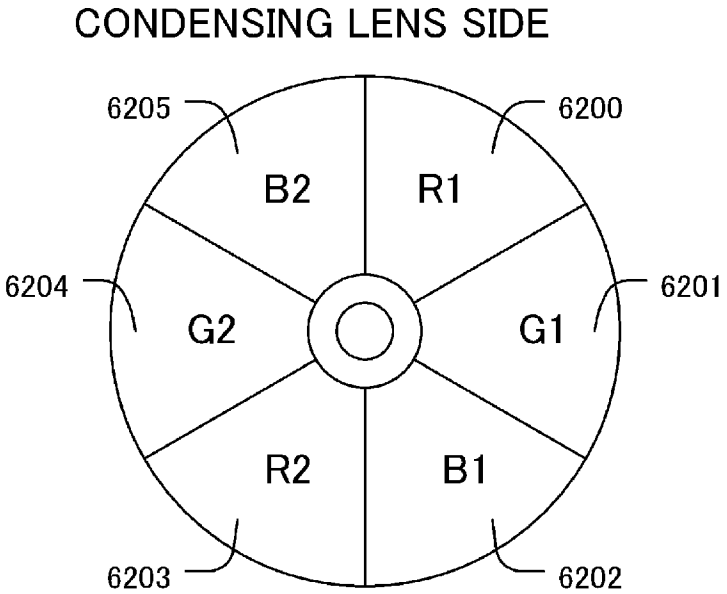
FIGS. 24A and 24B are plan views of the color wheel 6010.
Figure 24A:
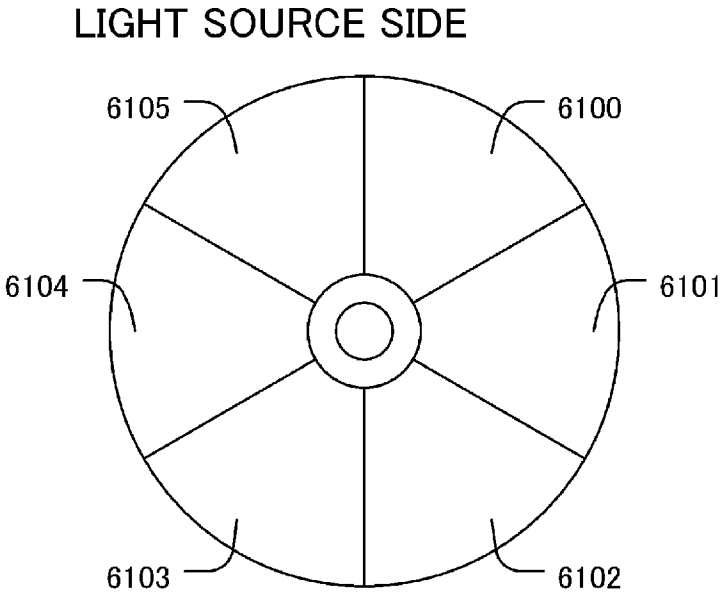

FIG. 24 is a plan view of the color wheel 6010. The color wheel 6010 has a disk shape and a side of the color wheel 6010 that receives the ultraviolet light of the light source 6000 is constituted by six regions 6100, 6101, 6102, 6103, 6104, and 6105 as shown in FIG. 24A. The visible light reflecting film 6012 is formed in each of these regions.

The condensing lens 6020 side of the color wheel 6010 is constituted by six regions 6200, 6201, 6202, 6203, 6204, and 6205 as shown in FIG. 24B. Each of these regions is coated with a phosphor that wavelength-converts the ultraviolet light into visible light of the respective colors of R1, G1, B1, R2, G2, and B2 to form a phosphor layer. Respective positions of the regions 6200 to 6205 correspond to respective positions of the regions 6100 to 6105 on the rear side. A phosphor layer that emits light with the characteristics of r (λ) shown in FIG. 19 is applied and formed in the R1 region 6200. In a similar manner, phosphor layers that emit light with the characteristics of g (λ), b (λ), rw (λ), gw (λ), and bw (λ) are applied and formed in the regions 6201 to 6205.

As the color wheel 6010 rotates, the ultraviolet light from the light source 6000 sequentially irradiates regions 6100→6101→ . . . →6105, and light of R1→G1→ . . . →B2 is sequentially emitted from the regions 6200 to 6205. A rotation speed and a rotation phase of the color wheel 6010 are controlled so that the rotation of the color wheel 6010 is synchronized with the selected image 2051 that is selected and outputted by the frame selecting unit 2050.

The configurations and control described above enable the present invention to be implemented with a projecting-type image display device which temporally divides a color component and projects an image onto a screen.

The optical modulator 6050 may be configured using a binary modulator that is capable of on-off control at high speed to control gradations according to PWM modulation.

In addition, a configuration may be adopted in which necessary light source light is obtained with a white light source such as a halogen lamp and a color wheel using a color filter.

Furthermore, a configuration in which light sources such as LEDs and lasers directly sequentially irradiate light or a configuration in which necessary light source light is directly obtained from combinations of light sources and a color wheel may be adopted.

(Sixth Embodiment)

The present invention can also be implemented using a light source whose emission characteristics can be varied by driving the light source under different driving conditions. Generally, emission wavelengths of light-emitting diodes and semiconductor lasers are known to vary depending on driving currents. Moreover, generally, an amount of driving current and an emission amount are known to be approximately proportional to one another.

Configurations and operations according to the sixth embodiment are approximately similar to those of the image display device according to the first embodiment.

Only three light-emitting diodes are arranged on a unit surface of the backlight unit 72 as a red light source 723, a green light source 724, and a blue light source 725.

Relationships between driving currents and emission characteristics of these light-emitting diodes are as follows.

red light-emitting diode vR:

at current value IvR1, λvr1=590 nm at current value IvR2, λvr2=620 nm at current value IvR3, λvr3=610 nm green light-emitting diode vG:

at current value IvG1, λvg1=545 nm at current value IvG2, λvg2=565 nm at current value IvG3, λvg3=555 nm blue light-emitting diode vB:

at current value IvB1, λvb1=420 nm at current value IvB2, λvb2=470 nm at current value IvB3, λvb3=445 nm The current value IvR1 is a rated current of the red light-emitting diode vR, IvR2 is a current that is ¼ of the rated current, and IvR3 is a current that is ½ of the rated current. The same applies to the current values of the green light-emitting diode vG and the blue light-emitting diode vB.

The backlight driving unit 60 drives the respective light sources by varying driving conditions in each subframe. FIG. 25 shows a conceptual diagram of the driving.

Figure 25A:
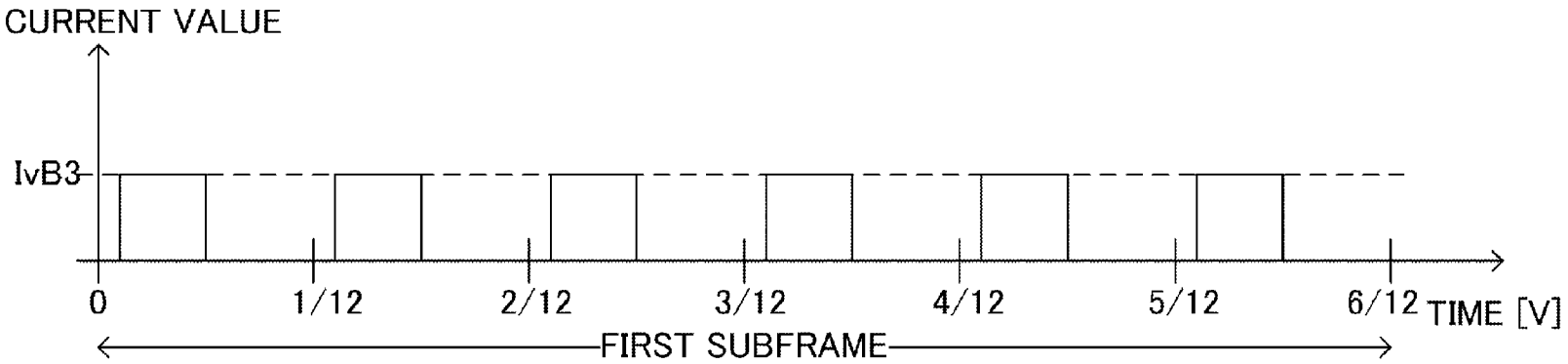
FIGS. 25A and 25B are conceptual diagrams of control in which driving conditions are varied in each subframe to drive each light source.
Figure 25B:
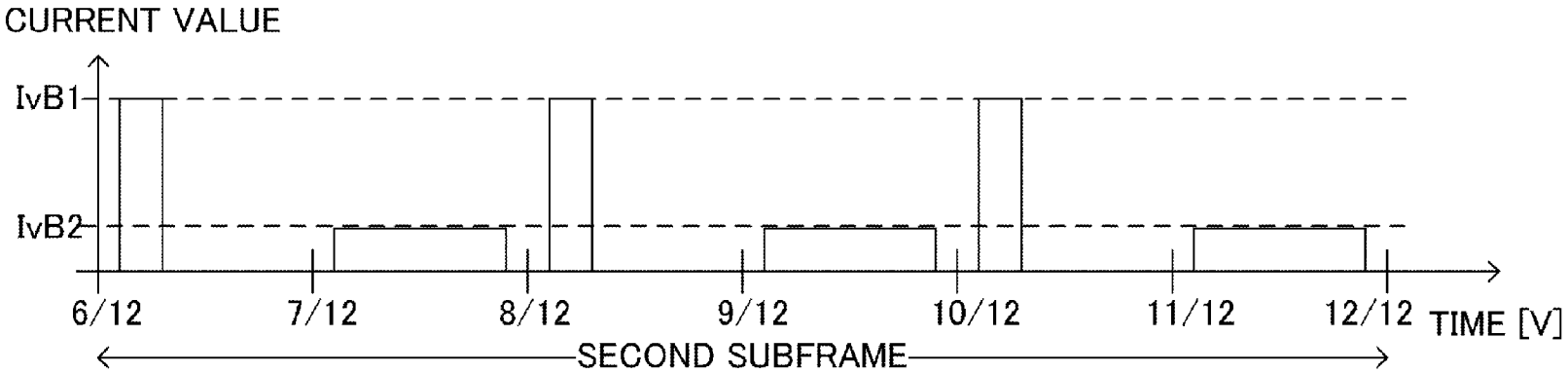

In the first subframe that requires a wide color gamut light source, the backlight driving unit 60 performs PWM driving of the blue light-emitting diode vB at the current amount of IvB3 and a duty ratio of 1:1 as shown in FIG. 25A. In addition, in the second subframe that requires a low chroma light source, the backlight driving unit 60 alternately performs PWM driving of the blue light-emitting diode vB at the current amount of IvB1 and a duty ratio of 1:3 and PWM driving of the blue light-emitting diode vB at the current amount of IvB2 and a duty ratio of 4:0 as shown in FIG. 25B. In the sixth embodiment, as shown in FIG. 25B, current values are varied so as to be switched a plurality of times at prescribed intervals in a subframe period. The same applies to the red light-emitting diode vR and the green light-emitting diode vG. According to this driving method, an amount of light is compensated by varying the duty ratio of PWM with a variation in the current amount so that the amount of light does not vary when the current amount is varied.

By driving light sources whose emission wavelengths vary depending on the driving current in this manner and causing the light sources to alternately emit light at two different emission wavelengths, light source characteristics equivalent to those produced when light is emitted from two different light sources as in the second embodiment can be produced. In other words, by switching driving currents and varying emission peak wavelengths at prescribed intervals, light source characteristics equivalent to those produced when light is emitted from two light sources with different emission peak wavelengths can be produced.

Other configurations and operations are similar to those of the image display device according to the first embodiment.

By dynamically varying driving conditions of a light source in this manner, a single light source can be used as a wide color gamut light source as well as a low chroma light source.

The present invention can be implemented using a light source driving pattern other than the pattern exemplified in the sixth embodiment. For example, a higher PWM frequency may be adopted to achieve flicker reduction.

In addition, the low chroma light source may be configured so as to have characteristics that continuously vary by continuously varying current amounts and lighting periods in a PWM driving pattern of the second subframe.

(Seventh Embodiment)

A seventh embodiment represents an invention for reducing a rise or a decline in brightness that is perceived when an observer visually tracks an object moving in an image displayed on an image display device. Such a rise or decline in brightness occurs at a boundary portion between an image component that is displayed in the first subframe and an image component that is displayed in the second subframe.

A mechanism of an occurrence of a rise in brightness and a decline in brightness at a boundary portion will be described using an image displayed on the image display device described in the first embodiment as an example. For the sake of convenience, when the input image 1 is denoted by $f_n$, an image displayed in the first subframe of $f_n$ will be denoted as $f_{na}$ and an image displayed in the second subframe of $f_n$ will be denoted as $f_{nb}$.

Figure 26:
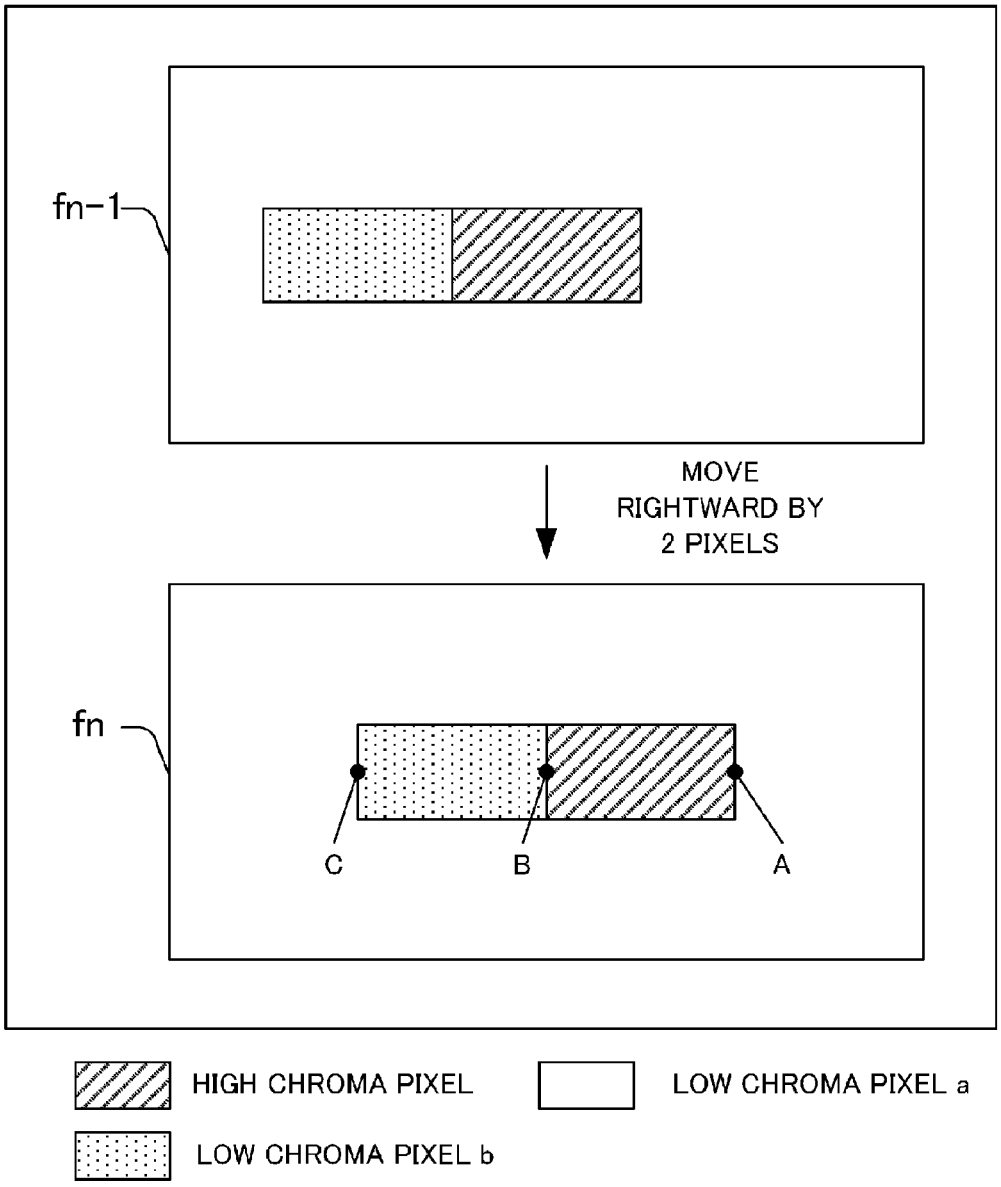
FIG. 26 is a diagram for illustrating a mechanism of occurrence of a rise in brightness and a decline in brightness at a boundary portion.

FIG. 26 shows the input image 1 that is inputted to the image display device according to the first embodiment. Let us assume that a low chroma pixel a and a low chroma pixel b are pixels having pixel values classified into the area M1 by the color gamut determining unit 20, and a high chroma pixel c is a pixel having a pixel value classified into "other". A rectangle representing the high chroma pixel c and the low chroma pixel b at the center of the image moves toward the right by 2 pixels in 1 frame. Accordingly, $f_{n-1}$ and $f_n$ represent two consecutive frames at a given time point during a period in which the rectangle is in motion. In this situation, it is anticipated that the observer is to perform visual tracking in which the moving rectangle is tracked by the eyes of the observer.

Figure 27A:
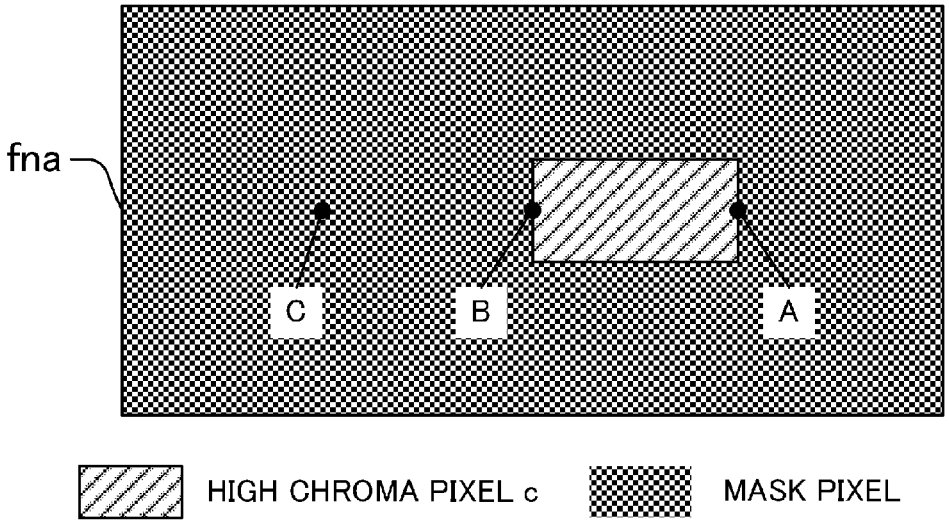
FIGS. 27A and 27B are diagrams for illustrating a mechanism of occurrence of a rise in brightness and a decline in brightness at a boundary portion.
Figure 27B:
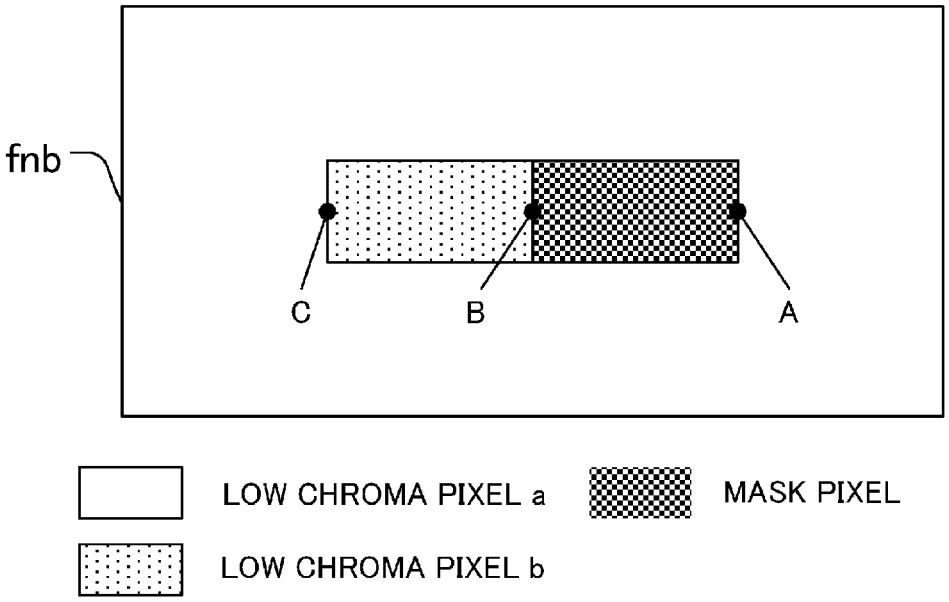

FIG. 27 shows display contents in a case where $f_n$ is inputted to the image display device according to the first embodiment as the input image 1. $f_{na}$ in FIG. 27A represents display contents of the first subframe using a wide color gamut light source, and $f_{nb}$ in FIG. 27B represents display contents of the second subframe using a low chroma light source. A mask pixel illustrated in the drawing refers to a pixel that is displayed black due to the display ratio D thereof being 0. When the observer does not visually track the mobile object, the two subframes are composited as-is as described in the first embodiment to be perceived by the observer. As a result, the observer perceives an image of $f_n$ shown in FIG. 26.

Figure 28:
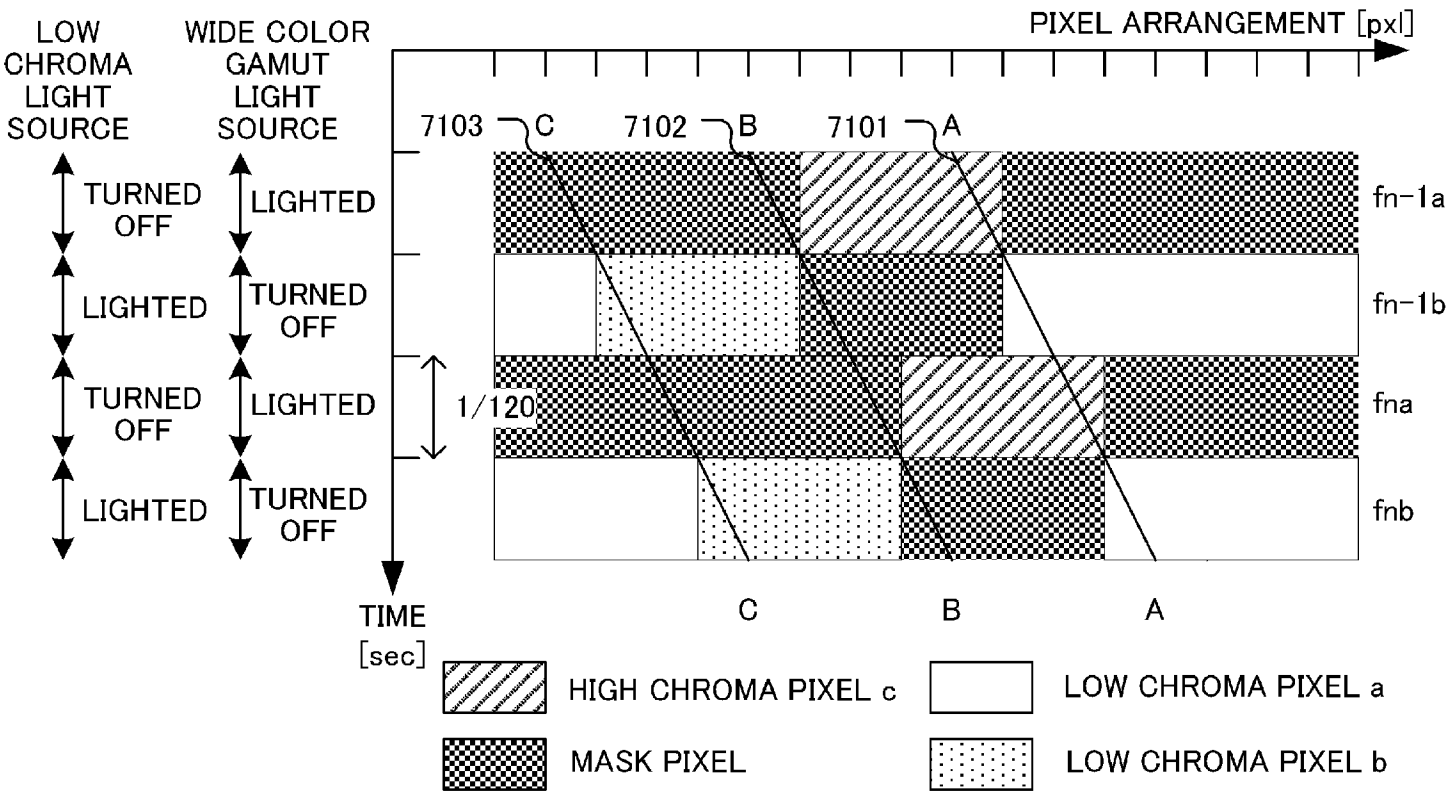
FIG. 28 is a diagram for illustrating a mechanism of occurrence of a rise in brightness and a decline in brightness at a boundary portion.

The perception of an image when the observer visually tracks a rectangular mobile object constituted by the high chroma pixel c and the low chroma pixel b will be described with reference to FIG. 28. FIG. 28 illustrates a variation in display contents for each subframe by extracting display contents of horizontal lines passing near points A, B, and C in FIG. 27. In FIG. 28, an abscissa represents horizontal pixel positions and a vertical direction represents time. In addition, $f_{n-1a}$, $f_{n-1b}$, $f_{na}$, and $f_{nb}$ respectively represent display contents of the first subframe and the second subframe of an n−1-th frame and display contents of the first subframe and the second subframe of an n-th frame. As shown in FIG. 28, the image display device sequentially displays the first subframe $f_{n-1a}$ of $f_{n-1}$ using the wide color gamut light source, the second subframe $f_{n-1b}$ of $f_{n-1}$ using the low chroma light source, the first subframe $f_{na}$ of $f_n$ using the wide color gamut light source, and the second subframe $f_{nb}$ of $f_n$ using the low chroma light source.

When the observer visually tracks the high chroma pixel c and the low chroma pixel b which are moving toward the right by 2 pixels in 1 frame, light from pixels along diagonal lines 7101 to 7103 in FIG. 28 is integrated on the retina of the observer. As a result, the high chroma pixel c and the low chroma pixel a are integrated so as to overlap each other near point A. Therefore, the observer perceives the vicinity of the point A to be brighter by the amount of the overlapping as compared to when visual tracking is not performed. In addition, since many mask pixels (black) are integrated in the vicinity of the point B, the observer perceives the vicinity of the point B to be darker as compared to when visual tracking is not performed. Since the high chroma pixel c and the low chroma pixel a do not overlap each other and many mask pixels are not integrated in a vicinity of the point C, the observer perceives brightness of the vicinity of the point C to be similar to when visual tracking is not performed.

As described above, in a case where a boundary portion (the point A or the point B) between an image component that is displayed in the first subframe and an image component that is displayed in the second subframe exists in a mobile object, when the observer visually tracks the mobile object, brightness of the boundary portion is perceived to rise or decline.

In the seventh embodiment, distribution to an image component that is displayed in the first subframe and an image component that is displayed in the second subframe is performed in accordance with a chroma of a pixel. Therefore, when a boundary portion between a low chroma pixel and a high chroma pixel exists in a mobile object, brightness is more likely to be perceived to vary near the boundary when visually tracking the mobile object. In consideration thereof, in the seventh embodiment, when distributing an image to an image component that is displayed in the first subframe and an image component that is displayed in the second subframe, pixels that satisfy a prescribed condition or, in other words, a mobile object including a boundary portion between a low chroma pixel and a high chroma pixel and peripheral pixels of the mobile object are collected in one of the subframes. Which of the first subframe and the second subframe is used to collect the pixels is to be determined in accordance with modes (to be described later). Accordingly, a boundary between the image component that is displayed in the first subframe and the image component that is displayed in the second subframe is reduced. As a result, an occurrence of a portion at which brightness is perceived to rise or decline when the observer performs visual tracking is suppressed. A specific configuration will be described below.

Figure 29:
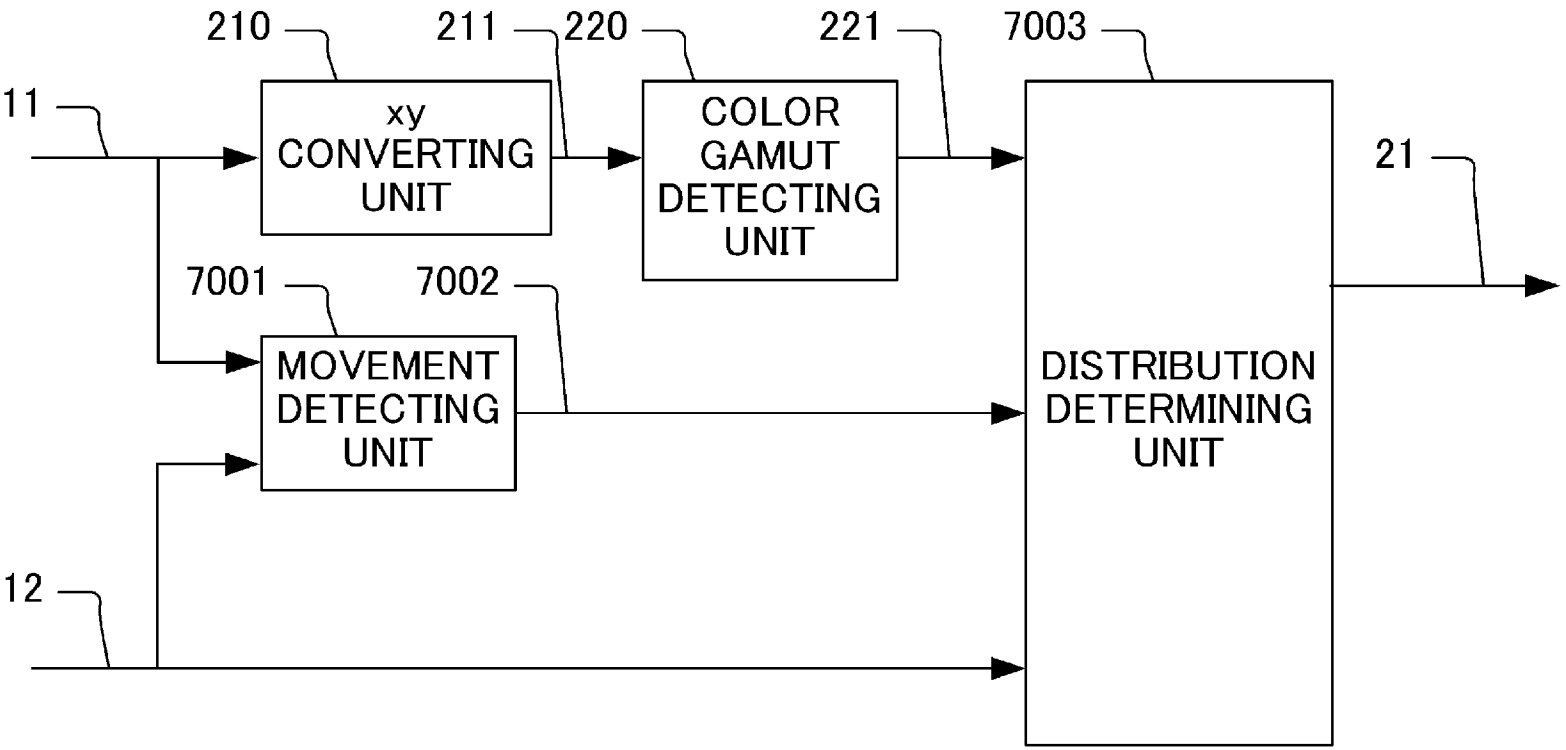
FIG. 29 is a configuration diagram of a color gamut determining unit 20 according to a seventh embodiment.

A configuration of the image display device according to the seventh embodiment is approximately similar to the image display device according to the first embodiment and only differs in a configuration of the color gamut determining unit 20. FIG. 29 shows the color gamut determining unit 20 according to the seventh embodiment. The same portions as the first embodiment will be assigned the same reference numerals and a description thereof will be omitted.

A movement detecting unit 7001 determines a presence or absence of motion in pixel units from the double speed input image 11 and outputs a movement determination result 7002. Specifically, the movement detecting unit 7001 first detects a timing of the first subframe from the double speed timing signal 12 and accumulates a double speed input image in a frame memory at the timing. The movement detecting unit 7001 compares, in pixel units, the double speed input image inputted at the timing of the first subframe with a double speed input image accumulated at a timing of an immediately previous first subframe on the frame memory. When there is a difference between pixel values, the movement detecting unit 7001 makes a determination of a "moving pixel", and when the pixel values are the same, the movement detecting unit 7001 makes a determination of a "still pixel". The movement detecting unit 7001 outputs the determination result as a movement determination result 7002 in pixel units. Since a double speed input image of the second subframe is the same as a double speed input image of the first subframe, the movement detecting unit 7001 only operates on the first subframe and does not perform movement detection on the second subframe.

Next, a distribution determining unit 7003 will be described. Based on the color gamut determination result 221, the double speed timing signal 12, the movement determination result 7002, and an instruction (specification) of a mode from the control unit 90, the distribution determining unit 7003 determines a ratio at which each pixel of the double speed input image is to be distributed between the first subframe and the second subframe. In the seventh embodiment, it is assumed that a mode instruction from the control unit 90 concerns one of two modes, namely, an individual variability reducing mode (a first mode) and a color gamut priority mode (a second mode).

The color gamut priority mode is a mode in which a mobile object including a boundary portion between an image component that is displayed in the first subframe and an image component that is displayed in the second subframe and peripheral pixels of the mobile object are collected in the first subframe in which the pixels are displayed using a wide color gamut light source. In the color gamut priority mode, the mobile object and nearby pixels thereof can be displayed in a wide color gamut.

Figure 30:
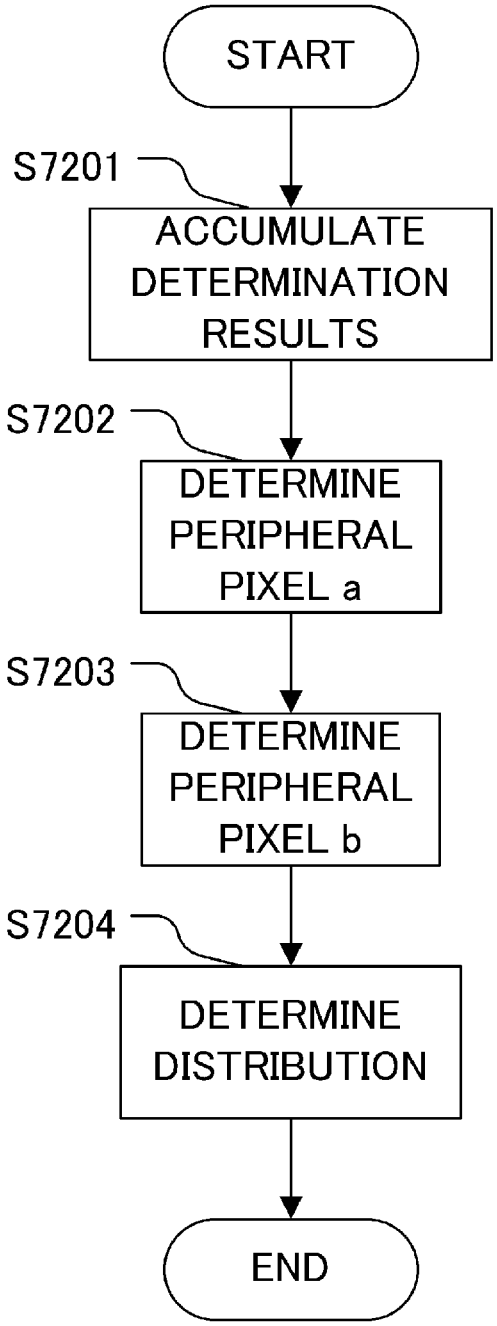
FIG. 30 is a flowchart showing processing performed by a distribution determining unit 7003.

Conversely, the individual variability reducing mode is a mode in which a mobile object including a boundary portion between an image component that is displayed in the first subframe and an image component that is displayed in the second subframe and peripheral pixels of the mobile object are collected in the second subframe in which the pixels are displayed using a low chroma light source. In the individual variability reducing mode, the mobile object and nearby pixels thereof can be displayed while reducing individual variability in color perception. Details of the processes will be described later. FIG. 30 shows a flow chart showing processing performed by the distribution determining unit 7003.

In step S7201, the distribution determining unit 7003 accumulates one subframe's worth of the color gamut determination result 221 and the movement determination result 7002. However, since the movement determination result 7002 is not outputted at a timing of the second subframe, it is assumed that the movement determination result 7002 accumulated at the timing of the first subframe is to be used in subsequent processes of the second subframe.

In step S7202, based on the accumulated color gamut determination result 221 and the movement determination result 7002, the distribution determining unit 7003 determines whether or not each pixel is a peripheral pixel a. The peripheral pixel a will be described below.

First, a determination of the peripheral pixel a in the color gamut priority mode will be described. When the color gamut determination result 221 of the determination object pixel is M2 or "other" and the movement determination result 7002 is "moving pixel", the distribution determining unit 7003 determines m×n number of pixels centered on the determination object pixel to be peripheral pixels a. In other words, high chroma pixels which constitute a mobile object and pixels in the periphery of the mobile object are determined to be peripheral pixels a.

On the other hand, in the individual variability reducing mode, when the color gamut determination result 221 is M1 and the movement determination result 7002 is "moving pixel", the distribution determining unit 7003 determines m×n number of pixels centered on the determination object pixel to be peripheral pixels a. In other words, low chroma pixels which constitute a mobile object and pixels in the periphery of the mobile object are determined to be peripheral pixels a.

The distribution determining unit 7003 performs this process on all of the pixels of the first subframe and obtains a peripheral pixel a determination result. The distribution determining unit 7003 produces a determination result of "not a peripheral pixel a" for pixels not determined to be a peripheral pixel a.

In step S7203, based on the accumulated movement determination result 7002 and the peripheral pixel a determination result, the distribution determining unit 7003 determines whether or not each pixel is a peripheral pixel b. The peripheral pixel b will be described below.

First, a determination of the peripheral pixel b in the color gamut priority mode will be described. When the movement determination result 7002 of a determination object pixel is a "moving pixel" and the determination object pixel is determined to be a peripheral pixel a, the distribution determining unit 7003 determines mb×nb number of pixels centered on the determination object pixel to be peripheral pixels b.

Meanwhile, in the individual variability reducing mode, when the movement determination result 7002 is a "moving pixel" and the determination object pixel is determined to be a peripheral pixel a, the distribution determining unit 7003 determines mb×nb number of pixels centered on the determination object pixel to be peripheral pixels b.

The distribution determining unit 7003 performs this process on all of the pixels of the first subframe and obtains a peripheral pixel b determination result. The distribution determining unit 7003 produces a determination result of "not a peripheral pixel b" for pixels not determined to be a peripheral pixel b.

Figure 31:
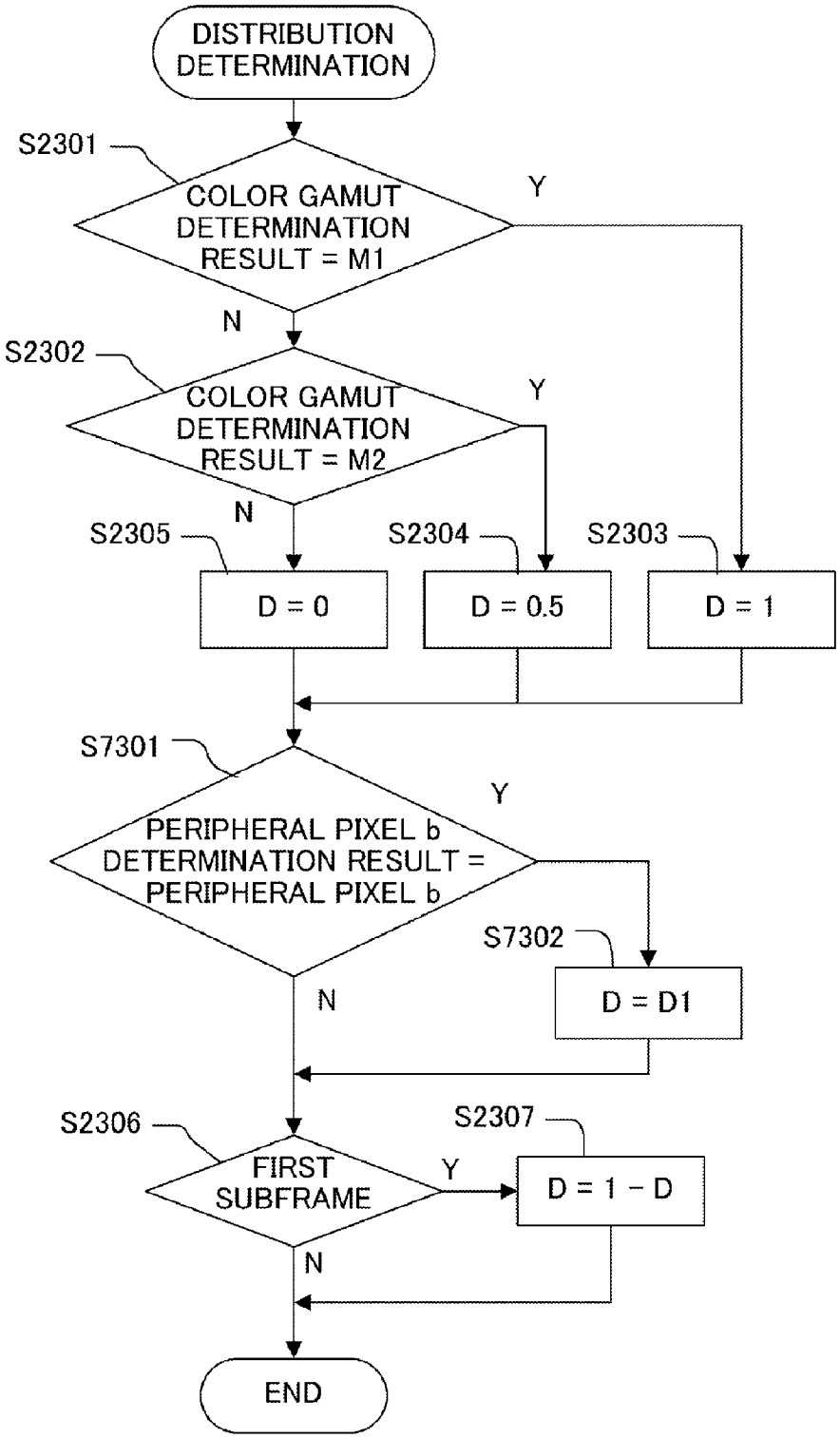
FIG. 31 is a flow chart showing a process of step S7204.

In step S7204, the distribution determining unit 7003 obtains a display ratio D per pixel based on the accumulated color gamut determination result 221, the double speed timing signal 12, and the peripheral pixel b determination result. FIG. 31 shows a flow chart of processing for obtaining the display ratio D. Values of 0 to 1 of the display ratio D correspond to distribution ratios of 0% to 100%. In addition, since steps S2301 to S2307 are similar to those in the flow chart shown in FIG. 9, a description thereof will be omitted.

In step S7301, the distribution determining unit 7003 verifies the peripheral pixel b determination result of an object pixel whose display ratio D is to be obtained, and when the determination result is "peripheral pixel b", the distribution determining unit 7003 proceeds to step S7302. When the determination result is "not a peripheral pixel b", the distribution determining unit 7003 proceeds to step S2306.

In step S7302, the distribution determining unit 7003 changes the display ratio D of the object pixel to D1. D1 is set to 0 in the color gamut priority mode and to 1.0 in the individual variability reducing mode.

According to the procedure described above, the distribution determining unit 7003 obtains the display ratio D of all pixels in step S7204. The distribution determining unit 7003 outputs information on the obtained display ratio D of each pixel as the display ratio 21.

In this case, the process of step S7203 is performed so as to suppress overlapping of a boundary between pixels that are eventually collected in one of the subframes (pixels that are determined to be peripheral pixels b in this step) and other pixels on a moving pixel. In other words, pixels are distributed to the first subframe and the second subframe so that a boundary portion between the image component that is displayed in the first subframe and the image component that is displayed in the second subframe is no longer included in the mobile object. This is performed so that, when a boundary portion between the image component that is displayed in the first subframe and the image component that is displayed in the second subframe exists on a mobile object when the mobile object is being visually tracked by the observer, there is a possibility that a rise in brightness or a decline in brightness may be perceived at the portion. In the seventh embodiment, a mobile object configured so as to include a plurality of pixels with mutually different values of the display ratio D as determined in steps S2303 to S2305 and pixels in a prescribed range around the mobile object are collected in one subframe regardless of the chroma determination result in steps S2301 to S2302. Accordingly, since the mobile object no longer exists at a boundary portion between the image component that is displayed in the first subframe and the image component that is displayed in the second subframe, brightness is no longer perceived to rise or decline even when the observer visually tracks the mobile object.

As described earlier, since components other than the color gamut determining unit 20 are approximately similar to those of the first embodiment, a description thereof will be omitted.

Next, operations of the color gamut determining unit 20 shown in the seventh embodiment will be described using a specific input image as an example.

Let us assume that examples of the input image are $f_{n-1}$ and $f_n$ shown in FIG. 26. In addition, let us assume that a display mode in the present example is the color gamut priority mode.

Figure 32A:
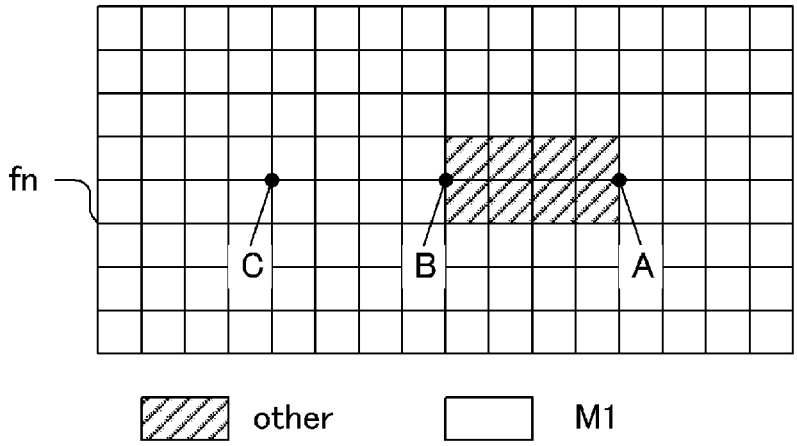
FIGS. 32A to 32F show operation examples of a color gamut determining unit 20 in a color gamut priority mode according to the seventh embodiment.

FIG. 32A shows a conceptual diagram of the color gamut determination result 221 when $f_n$ shown in FIG. 26 is inputted to the image display device. In FIG. 32A, each of the blocks arranged in a grid pattern correspond to one pixel of the image. In the present example, the color gamut determination result 221 of each pixel is assumed to be either "M1" or "other".

Figure 32B:
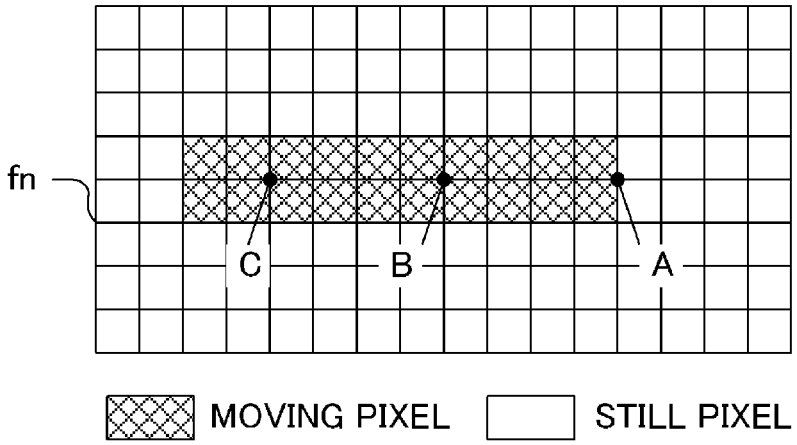

Next, FIG. 32B shows a conceptual diagram of the movement determination result 7002. In the present example, it is assumed that all of the high chroma pixels c and the low chroma pixels b of $f_n$ shown in FIG. 26 are determined to be "moving pixels" and all of the low chroma pixels a of $f_n$ shown in FIG. 26 are determined to be "still pixels".

Figure 32C:
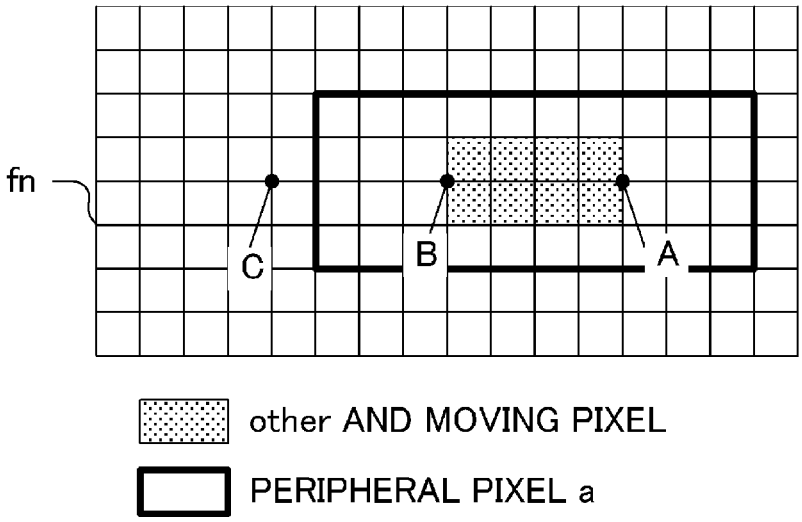

Next, FIG. 32C shows a conceptual diagram of a peripheral pixel a determination result as obtained from the color gamut determination result 221 and the movement determination result 7002. In the present example, it is assumed that m×n=7×3 number of peripheral pixels of a pixel whose color gamut determination result 221 is "other" and whose movement determination result 7002 is "moving pixel" are determined to be peripheral pixels a. Therefore, the determination result of all of the pixels enclosed by a bold frame in FIG. 32C is "peripheral pixel a" and the determination result of other pixels is "not a peripheral pixel a".

Figure 32D:
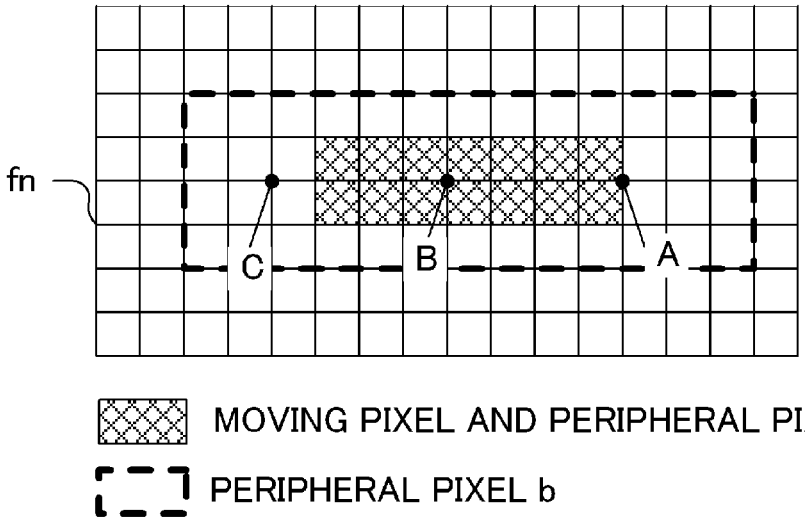

Next, FIG. 32D shows a conceptual diagram of a peripheral pixel b determination result as obtained from the movement determination result 7002 and the peripheral pixel a determination result. In the present example, it is assumed that mb×nb=7×3 number of peripheral pixels of a pixel that is a "peripheral pixel a" and whose movement determination result 7002 is "moving pixel" are determined to be peripheral pixels b. The determination result of all of the pixels enclosed by a bold dashed frame in FIG. 32D is "peripheral pixel b".

Figure 32E:
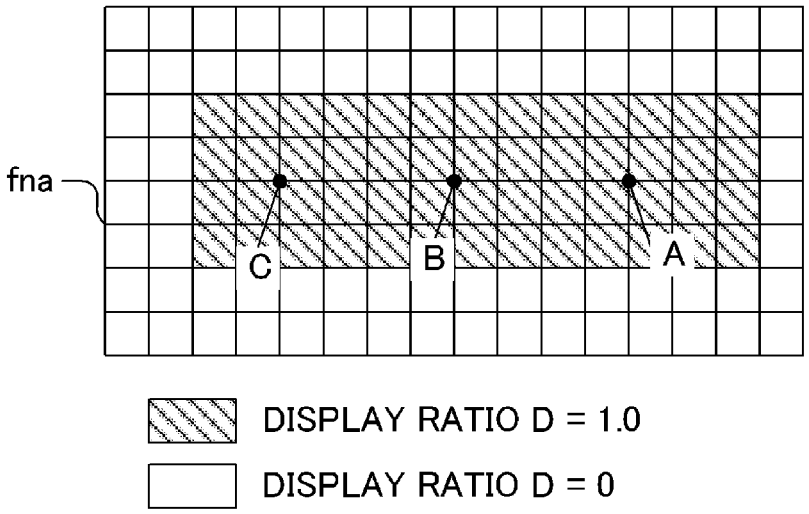
Figure 32F:
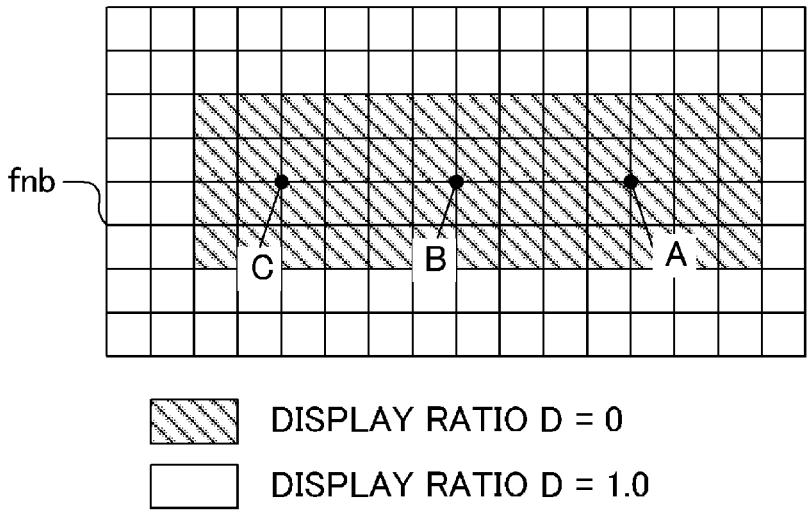

As described above, the display ratio D is determined based on the color gamut determination result 221, the peripheral pixel b determination result, and the double speed timing signal 12. In the present example, the display ratio 21 of the first subframe $f_{na}$ is as shown in FIG. 32E and the display ratio 21 of the second subframe $f_{nb}$ is as shown in FIG. 32F.

Values of m, n, mb, and nb affect a distance between the mobile object and a boundary portion (a new boundary portion) between the image component that is distributed to the first subframe and the image component that is distributed to the second subframe, which are distributed on the basis of the determination by the distribution determining unit 7003. In order to separate the mobile object and the new boundary portion from each other, m, n, mb, and nb are preferably set as large as possible. However, when m, n, mb, and nb are large, since many pixels in the periphery of the mobile object are collected in one of the subframes regardless of the color gamut determination result in steps S2301 and S2302, m, n, mb, and nb are desirably set to minimum necessary magnitudes.

Next, FIG. 33 shows display contents of the image display device according to the present example. In addition, FIG. 34 shows a conceptual diagram of the perception of an image when the observer visually tracks a rectangle made up of high chroma pixels c and low chroma pixels b.

Figure 33A:
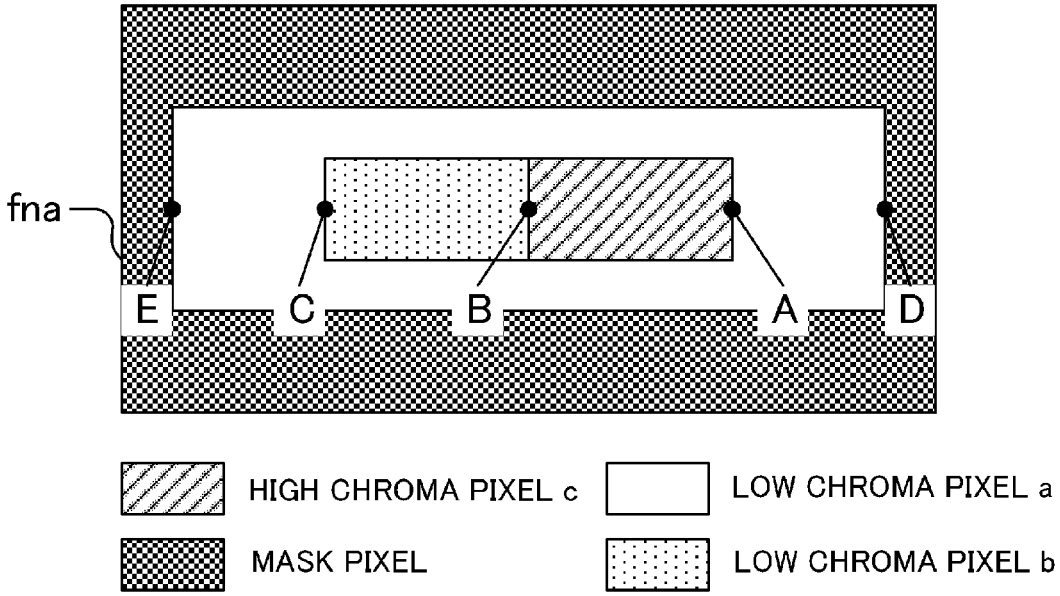
FIGS. 33A and 33B show operation examples in the color gamut priority mode according to the seventh embodiment.
Figure 34:
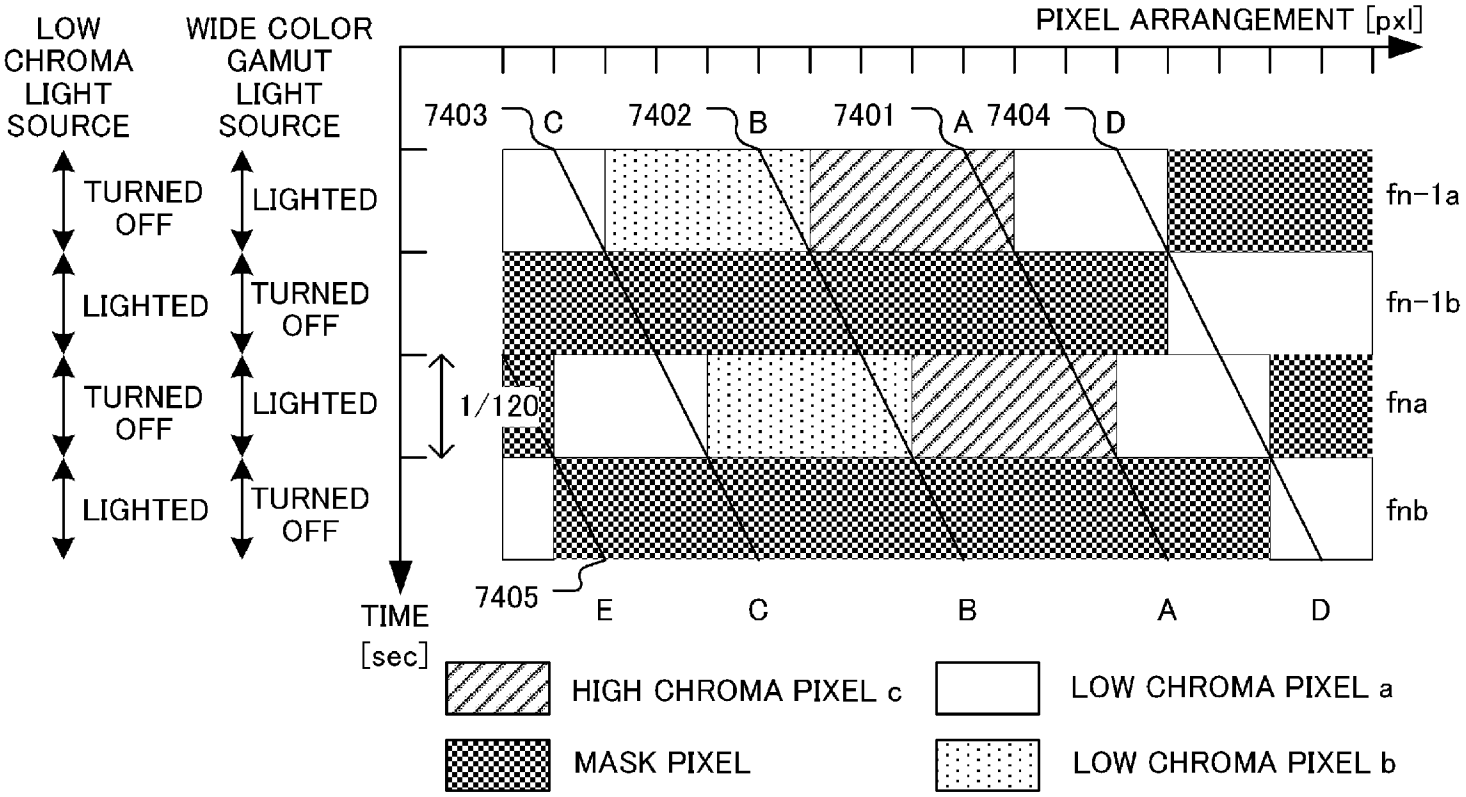
FIG. 34 is a diagram illustrating an operation example in the color gamut priority mode according to the seventh embodiment.

FIG. 33A shows display contents of the first subframe. As shown in FIG. 32E, in the first subframe, a display ratio of the rectangle made up of high chroma pixels c and low chroma pixels b and the low chroma pixels a in the periphery of the rectangle is 1.0, the display ratio of other pixels is 0, and a portion with a display ratio of 0 becomes mask pixels (black).

Figure 33B:
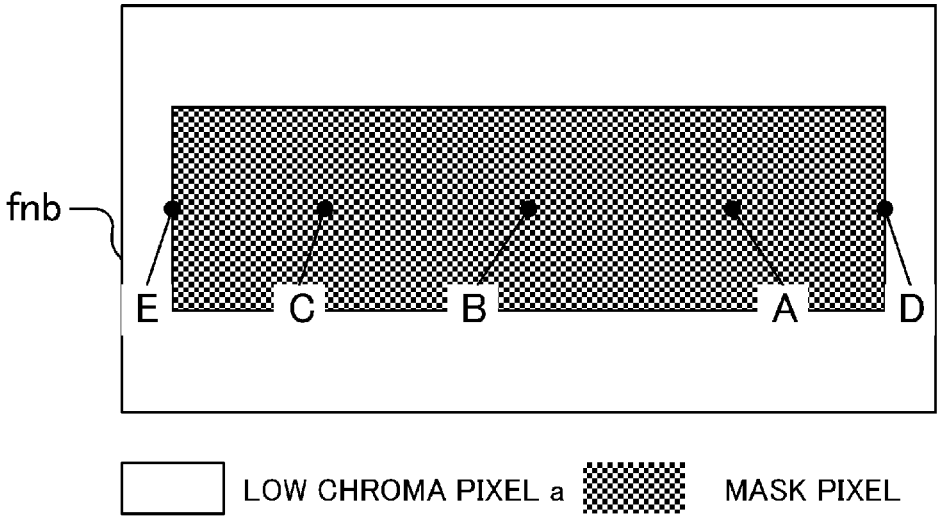

FIG. 33B shows display contents of the second subframe. As shown in FIG. 32F, a display ratio of the rectangle made up of high chroma pixels c and low chroma pixels b and the low chroma pixels a in the periphery of the rectangle is 0, the display ratio of other pixels is 1.0, and a portion with a display ratio of 0 becomes mask pixels (black).

Next, the perception of an image when the observer visually tracks a rectangle made up of the high chroma pixels c and the low chroma pixels b according to the present example will be described with reference to FIG. 34. FIG. 34 illustrates a variation for each subframe by extracting display contents of horizontal lines passing near points A to E in FIG. 33. Unlike FIG. 28 that illustrates display contents according to the first embodiment, in the seventh embodiment, the high chroma pixels c and the low chroma pixels a are not integrated so as to overlap each other near point A as shown in FIG. 34. Therefore, a perception of the vicinity of point A being brighter than when the observer does not perform visual tracking can be reduced. In addition, unlike FIG. 28, a large number of mask pixels (black) are not added in the vicinity of the point B. Therefore, a perception of the vicinity of point B being darker than when the observer does not perform visual tracking can be reduced.

In the seventh embodiment, a vicinity of point D and a vicinity of point E form a boundary portion between the image component displayed in the first subframe and the image component displayed in the second subframe. However, the vicinities of the points D and E are still portions that are separated from the mobile object. Therefore, since the observer does not perform visual tracking, perception of a rise in brightness or a decline in brightness hardly occurs.

Next, an operation example when a mode instruction is for the individual variability reducing mode will be described. For the description, $f_n$ in FIG. 26 will continued to be used as the input image. Therefore, the conceptual diagrams of the color gamut determination result 221 and the movement determination result 7002 shown in FIGS. 32A and 32B apply in a similar manner to the example described earlier.

Figure 35A:
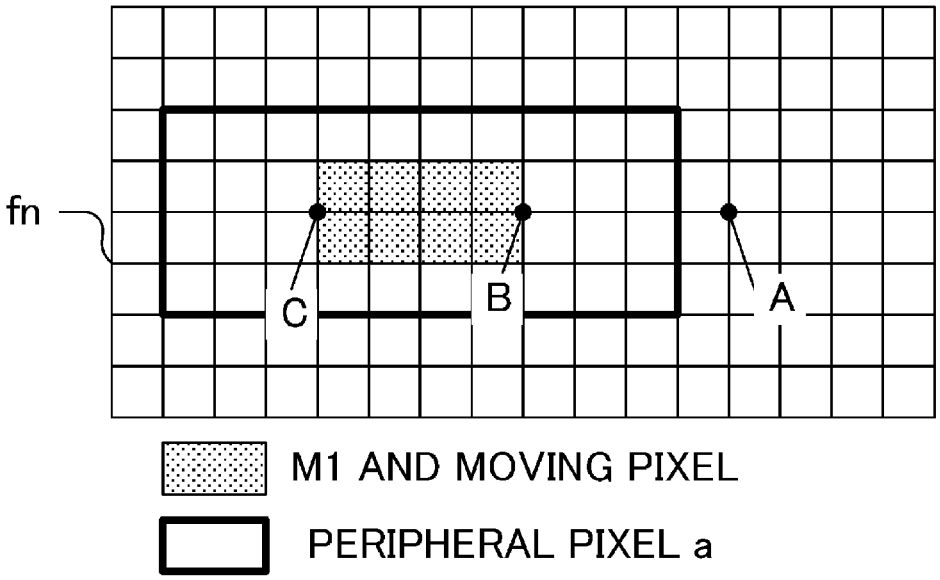
FIGS. 35A to 35D show operation examples of the color gamut determining unit 20 in an individual variability reducing mode according to the seventh embodiment.

Next, FIG. 35A shows a conceptual diagram of a peripheral pixel a determination result as obtained from the color gamut determination result 221 and the movement determination result 7002. In the present example, it is assumed that m×n=7×3. The determination result of all pixels enclosed in the bold frame is the peripheral pixel a.

Figure 35B:
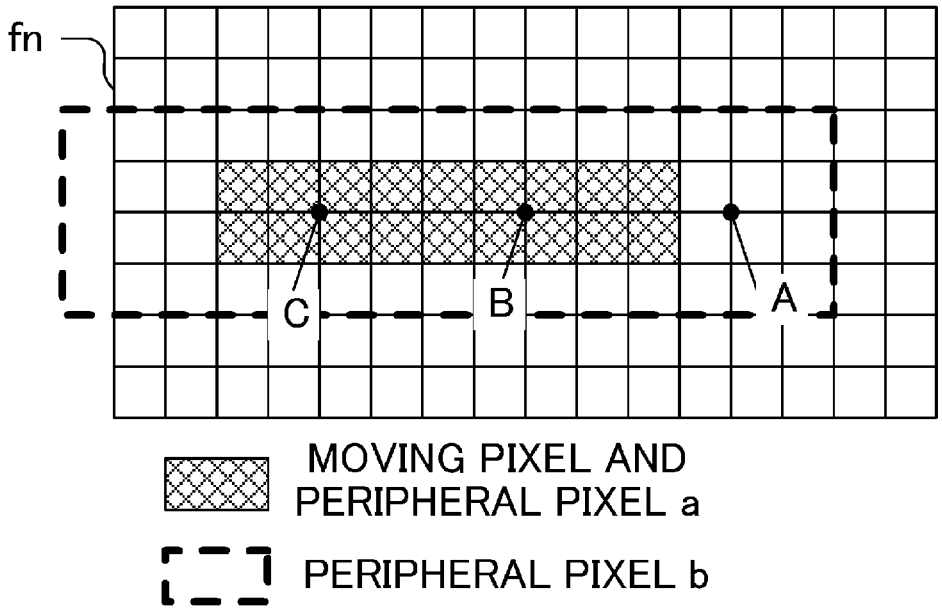

Next, FIG. 35B shows a conceptual diagram of a peripheral pixel b determination result as obtained from the movement determination result 7002 and the peripheral pixel a determination result. In the present example, it is assumed that mb×nb=7×3. The determination result of all pixels enclosed in the bold dashed frame is the peripheral pixel b.

Figure 35C:
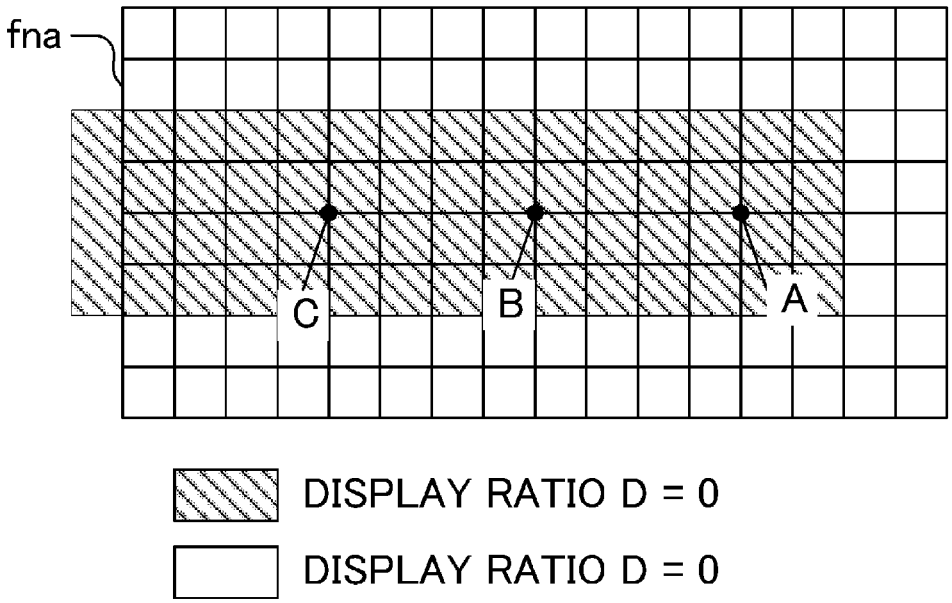
Figure 35D:
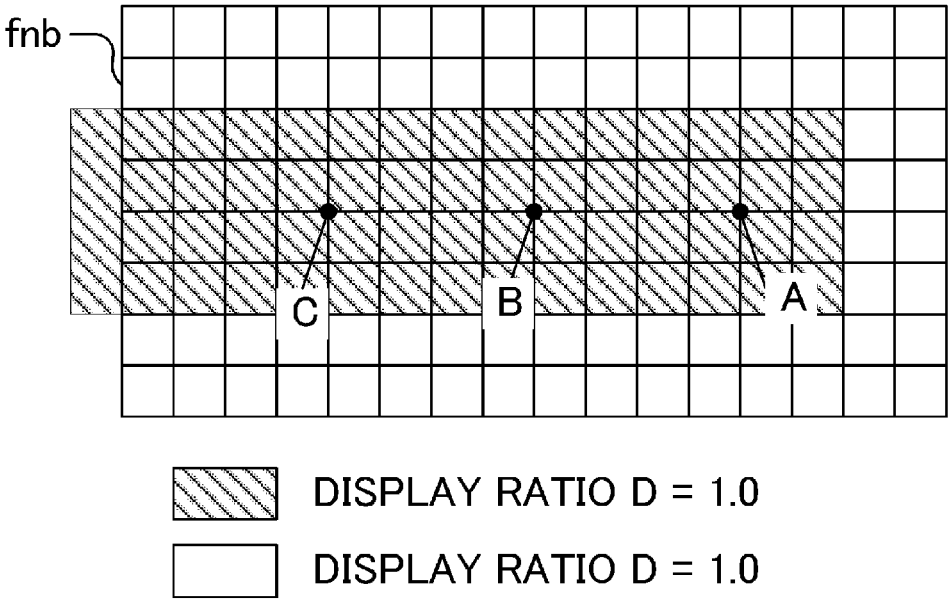

As described above, the display ratio D is determined based on the color gamut determination result 221, the peripheral pixel b determination result, and the double speed timing signal 12. In the present example, the display ratio 21 of the first subframe is as shown in FIG. 35C and the display ratio 21 of the second subframe is as shown in FIG. 35D.

Next, FIG. 36 shows display contents of the image display device according to the present example.

Figure 36A:
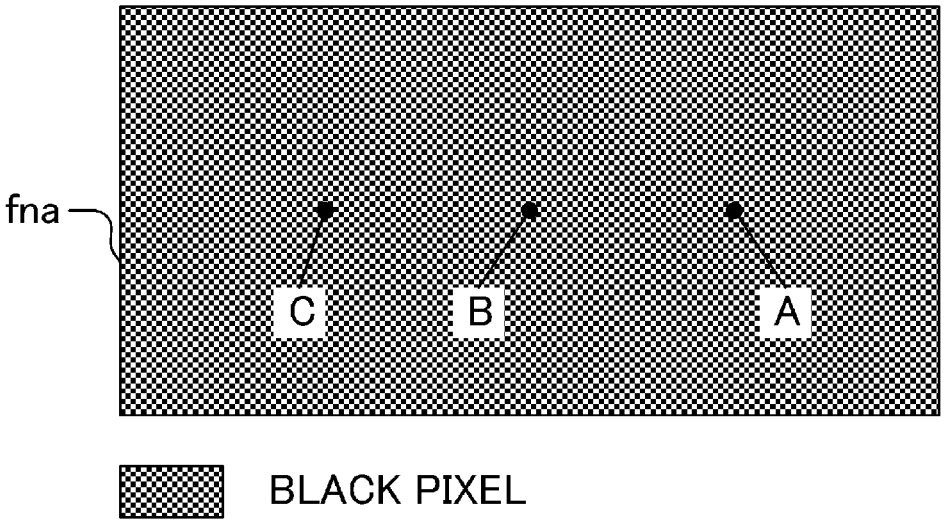
FIGS. 36A and 36B show operation examples in the individual variability reducing mode according to the seventh embodiment.

FIG. 36A shows display contents of the first subframe. As shown in FIG. 35C, in the first subframe, since the display ratio of all pixels is 0, all of the pixels are mask pixels (black).

Figure 36B:
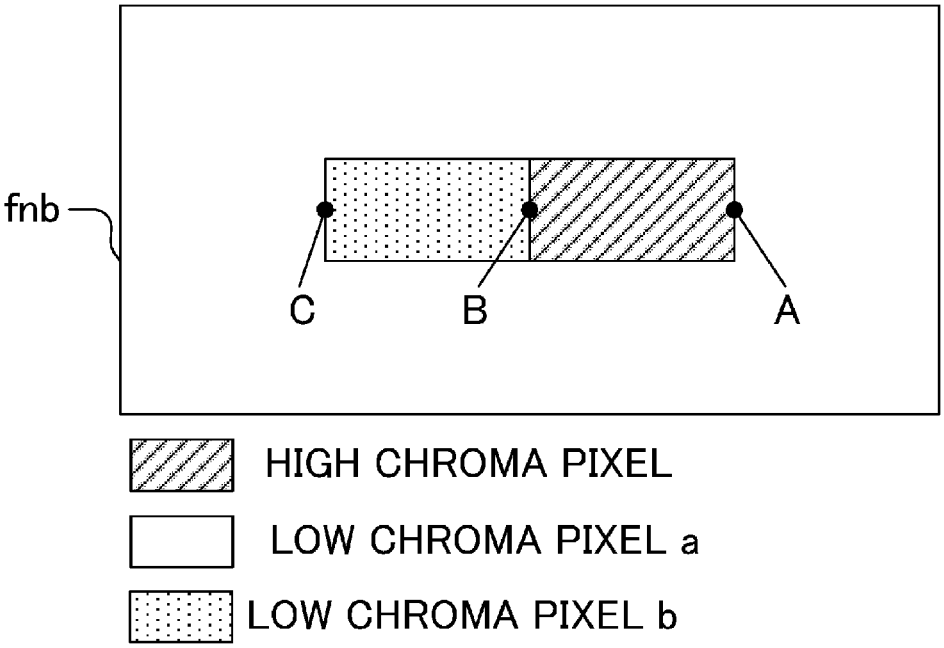

FIG. 36B shows display contents of the second subframe. As shown in FIG. 35D, since the display ratio of all pixels is 1.0, the same contents as $f_n$ in FIG. 26 that is the input image are displayed.

In the present example, since all pixels are displayed in the second subframe, there is no boundary portion between image components of the first subframe and the second subframe. Therefore, a perception of a rise in brightness or a decline in brightness does not occur even if the observer performs visual tracking.

According to the configuration and procedures described above, a rise in brightness or a decline in brightness which is perceived when the observer visually tracks an image displayed on the image display device can be reduced.

In addition, as shown in FIG. 28, when the vicinity of the point A is visually tracked, color mixing occurs since the high chroma pixels c and the low chroma pixels a are integrated so as to overlap each other. Even with respect to this problem, in the seventh embodiment, since the high chroma pixels and the low chroma pixels a are not integrated so as to overlap each other as shown in the vicinity of A in FIG. 34, color mixing can be reduced.

Furthermore, in the seventh embodiment while a mobile object and peripheral pixels thereof to be collected in one of the subframes are determined in the two stages of the peripheral pixel a determination and the peripheral pixel b determination, the pixels to be collected in one of the subframes may be determined solely based on the peripheral pixel a determination result without performing the peripheral pixel b determination. In this case, processing can be simplified. In addition, by increasing the values of m, n, mb, and nb, overlapping of the boundary portion between image components to be displayed in the respective subframes after collecting the mobile object and peripheral pixels thereof in one of the subframes on the mobile object can be suppressed in a more reliable manner.

In addition, while the peripheral pixel b determination is performed only once after the peripheral pixel a determination in the seventh embodiment, the peripheral pixel b determination may be performed a plurality of times. In this case, while processing becomes complicated, overlapping of the boundary portion between image components to be displayed in the respective subframes after collecting the mobile object and peripheral pixels thereof in one of the subframes on the mobile object can be suppressed in a more reliable manner.

Furthermore, in the seventh embodiment, while values of D1 shown in FIG. 31 are set to 0 in the color gamut priority mode and to 1.0 in the individual variability reducing mode, values of D1 are not limited thereto. For example, the present invention is also achieved when the value of D1 in the color gamut priority mode is set to 0.5 and the value of D1 in the individual variability reducing mode is set to 0.5.

In addition, while a configuration of the color gamut determining unit 20 is described in the seventh embodiment using the first embodiment as an example, the configuration of the color gamut determining unit 20 according to the seventh embodiment may be used in combination with the other embodiments. For example, the color gamut determining unit 20 according to the second to fourth and sixth embodiments or the color gamut determining unit according to the fifth embodiment may be adopted as the configuration of the color gamut determining unit described in the seventh embodiment.

Furthermore, the mode instruction from the control unit 90 may be performed by preparing an I/F that can be instructed from outside of the image display device so that modes can be switched in response to a specification from the outside.

(Eighth Embodiment)

While a display ratio is determined using information on movement of an image in the seventh embodiment, the display ratio is determined using information on area in an eighth embodiment. Generally, color discrimination sensitivity is known to decline when a color area is small. Therefore, when a color area of a region is small, individual variability in color perception is also small. Therefore, a region with a small color area does not pose a major problem regardless of whether the region is displayed in the first subframe that uses a wide color gamut light source for display or the region is displayed in the second subframe that uses a low chroma light source for display. In consideration thereof, in the eighth embodiment, as pixels satisfying prescribed conditions, pixels of a region with a small color area are collected in one of the subframes. Accordingly, a boundary portion between an image component that is displayed in the first subframe and an image component that is displayed in the second subframe is reduced. This boundary portion may cause the observer to perceive a rise in brightness, a decline in brightness, or color mixing when being visually tracked by the observer. Due to a reduction of the boundary portion, perception of a rise in brightness, a decline in brightness, and color mixing can be suppressed when the observer visually tracks the boundary portion.

Figure 37:
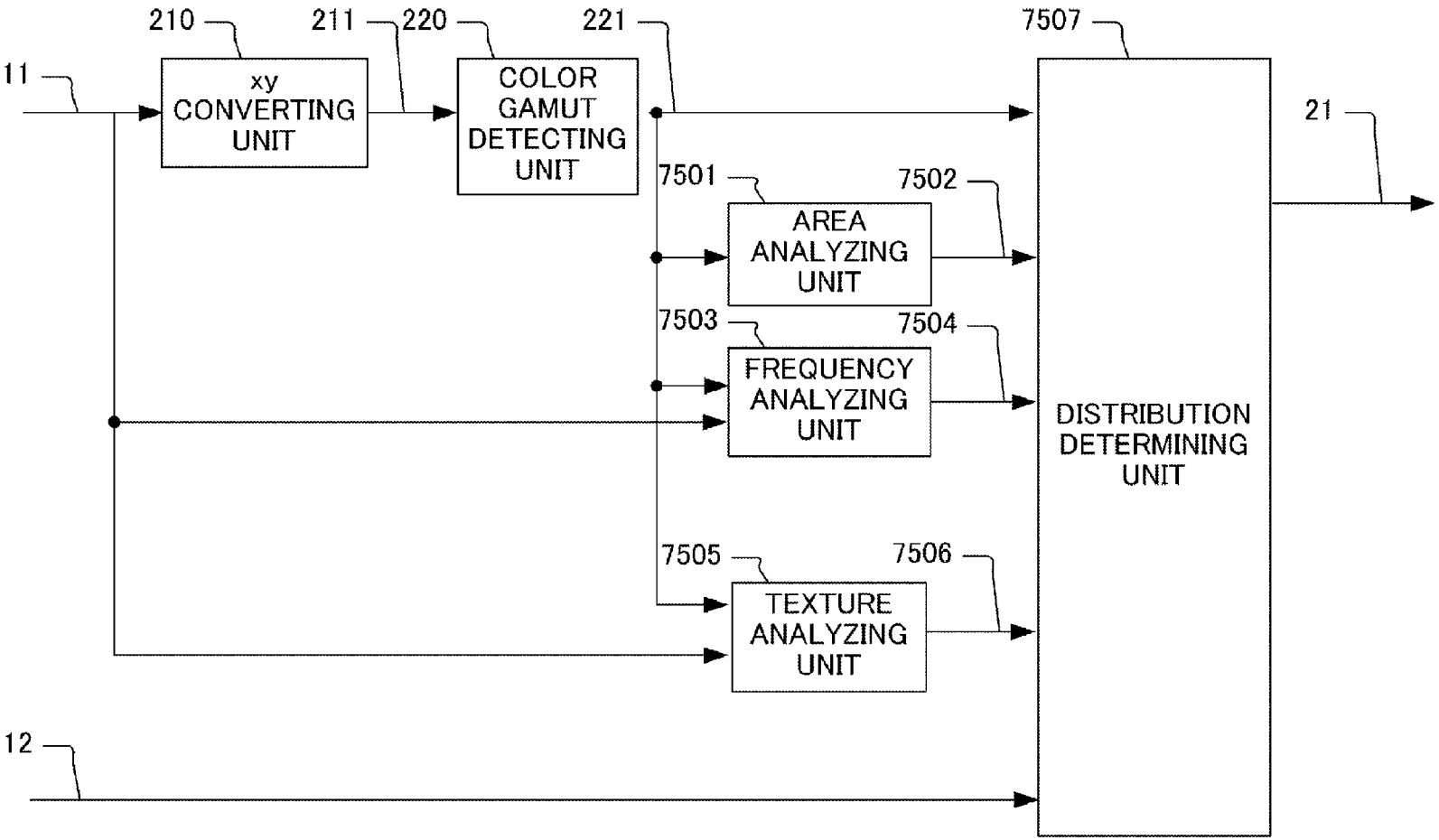
FIG. 37 is a configuration diagram of a color gamut determining unit 20 according to an eighth embodiment.

A configuration of the image display device according to the eighth embodiment is approximately similar to the image display device according to the first embodiment and only differs in a configuration of the color gamut determining unit 20. FIG. 37 shows the color gamut determining unit 20 according to the eighth embodiment. The same portions as the first embodiment will be assigned the same reference numerals and a description thereof will be omitted.

An area analyzing unit 7501 performs a labeling process (to be described later) on the color gamut determination result 221 and outputs an area analysis result 7502 per pixel. In the eighth embodiment, by analyzing area, pixels belonging to a region with a small low chroma area are collected in the first subframe in a process to be described later. Specific processing by the area analyzing unit 7501 will be described. The area analyzing unit 7501 first accumulates 1 subframe's worth of the color gamut determination result 221. The area analyzing unit 7501 performs labeling on the accumulated color gamut determination result 221 according to the procedure described below.

Step 1: The area analyzing unit 7501 raster-scans the color gamut determination result 221 per pixel and searches for a pixel whose color gamut determination result 221 is M1 or M2 and which has not yet been assigned a label. When such a pixel is found, the area analyzing unit 7501 attaches a new label to the pixel.

Step 2: For each of 8 neighboring pixels of the pixel to which the new label has been attached in step 1, the area analyzing unit 7501 determines whether or not the color gamut determination result 221 is M1 or M2 and whether or not the pixel has not yet been assigned a label. The area analyzing unit 7501 assigns the same label as that attached in step 1 to a pixel whose color gamut determination result 221 is M1 or M2 and which has not yet been assigned a label.

Step 3: In a similar manner, for each of 8 neighboring pixels of each pixel to which a new label has been assigned in step 2, the area analyzing unit 7501 determines whether or not the color gamut determination result 221 is M1 or M2 and whether or not the pixel has not yet been assigned a label. The area analyzing unit 7501 assigns the same label as that attached in step 1 to a pixel whose color gamut determination result 221 is M1 or M2 and which has not yet been assigned a label. This process is performed each time a label is newly assigned and is continued until there are no more pixels to be assigned the same label as that attached in step 1.

Step 4: When there are no more pixels to be assigned the same label as that attached in step 1, the area analyzing unit 7501 returns to step 1. Subsequently, the area analyzing unit 7501 repeats steps 1 to 3 until raster scans of the color gamut determination result 221 of all pixels are completed.

The label is changed for every repetition of steps 1 to 3. While three labels A to C are used in the eighth embodiment for the sake of convenience, the number of labels may be increased or reduced as necessary. In addition, while pixels whose color gamut determination result 221 is "other" are not assigned labels in the steps described above, for the sake of convenience, it is assumed that the pixels are assigned a label Z. The area analyzing unit 7501 outputs label information of each pixel as the area analysis result 7502.

The labeling process will be described using a specific example.

Figures 38A, 38B:
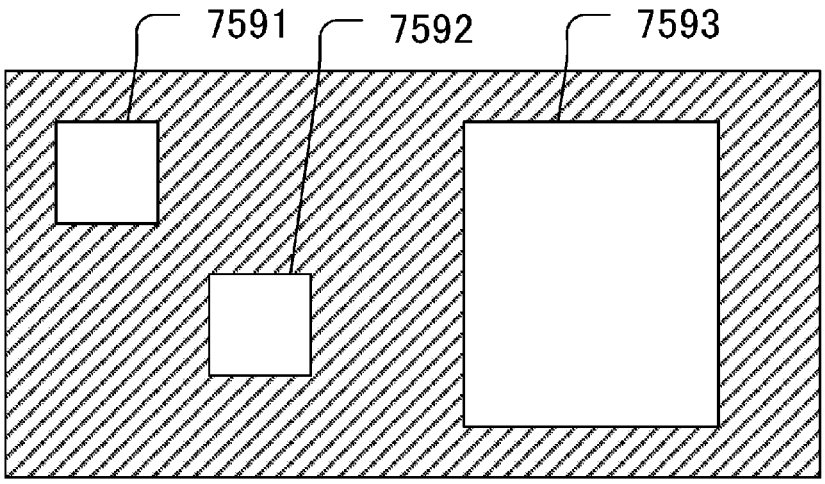

FIG. 38A shows an example of the input image 1 that is inputted to the image display device according to the eighth embodiment. In the drawing, low chroma pixels represent pixels having pixel values whose color gamut determination result 221 is M1 and high chroma pixels represent pixels having pixel values whose color gamut determination result 221 is "other". FIG. 38B shows a conceptual diagram of 1 subframe's worth of the color gamut determination result 221 that is accumulated by the area analyzing unit 7501 when this image is inputted. In FIG. 38B, each of the blocks arranged in a grid pattern correspond to one pixel of the double speed input image 11. In addition, a numerical value in each block represents the color gamut determination result 221 of the pixel. In this case, let us assume that 1 represents M1 and 0 represents "other".

The area analyzing unit 7501 starts raster scans in sequence from the color gamut determination result 221 of the top left pixel in FIG. 38B. Since the color gamut determination result 221 is "other" up to a pixel 7601, the area analyzing unit 7501 assigns the label Z. Since the color gamut determination result 221 is M1 and a label is not yet assigned at a pixel position of the pixel 7601, the area analyzing unit 7501 assigns the label A to the pixel 7601 (step 1).

Next, the area analyzing unit 7501 checks the color gamut determination result 221 and the presence or absence of labels for the 8 neighboring pixels (pixels colored in gray in FIG. 38B) of the pixel 7601. Since the color gamut determination result 221 is M1 and labels are not yet assigned to the pixels to the right, lower right, and below the pixel 7601, the area analyzing unit 7501 assigns the same label A as the pixel 7601 to these pixels (step 2).

Next, in a similar manner, the area analyzing unit 7501 checks the color gamut determination result 221 and the presence or absence of labels for the respective 8 neighboring pixels of the three pixels to the right, lower right, and below the pixel 7601 which have been assigned the same label A as the pixel 7601 in step 2. In the example shown in FIG. 38B, since there are no pixels whose color gamut determination result 221 is M1 and which are not yet assigned a label among the 8 neighboring pixels of any of the three pixels, assigning of the label A is concluded (step 3).

The area analyzing unit 7501 restarts raster scans from a pixel at a position next to the pixel 7601 and searches for a pixel whose color gamut determination result 221 is M1 or M2 and which is not yet assigned a label. Since the color gamut determination result 221 is "other" for pixels up to (but not including) the pixel 7602, the label Z is assigned to these pixels. Since the color gamut determination result 221 of the pixel 7602 is M1 and a label is not yet assigned to the pixel 7602, the area analyzing unit 7501 assigns the label B to the pixel 7602 (step 1).

Next, the area analyzing unit 7501 checks the color gamut determination result 221 and the presence or absence of labels for each of the 8 neighboring pixels of the pixel 7602 to perform the process of step 2. By continuing the labeling process in a similar manner thereafter, the labels A to C and Z are eventually assigned to the respective pixels as shown in FIG. 38C.

Next, a frequency analyzing unit 7503 will be described. The frequency analyzing unit 7503 performs a frequency analysis for each pixel based on the double speed input image 11 and the color gamut determination result 221 and outputs a frequency analysis result 7504. In the eighth embodiment, by analyzing frequency, pixels belonging to a high-spatial frequency region with a large area but reduced color discrimination sensitivity such as a thin line are collected in the first subframe by a process to be described later.

Specific processing by the frequency analyzing unit 7503 will now be described. First, the frequency analyzing unit 7503 obtains a brightness value of each pixel of the double speed input image 11 and accumulates 1 subframe's worth of brightness values. For example, the brightness value of each pixel can be calculated using the following equation.

$$Y=0.2R+0.7G+0.1B,$$

where R, G, and B denote RGB values and Y denotes a brightness value of each pixel.

Next, the frequency analyzing unit 7503 applies a high-pass filter (HPF) to the brightness value of each pixel whose color gamut determination result is M1 or M2 and obtains an HPF output of each pixel. In the eighth embodiment, a 3×3 two-dimensional filter is used as the HPF. FIG. 39C shows filter coefficients of the HPF. In addition, when the color gamut determination result 221 of a pixel referenced by the filter is "other", the brightness value of the pixel is assumed to be 0. Accordingly, an HPF output at a boundary between pixels with M1 or M2 and pixels with "other" as the color gamut determination result is increased. The frequency analyzing unit 7503 obtains an HPF output value for all pixels and outputs an absolute value of the HPF output value as a frequency analysis result 7504. For the sake of convenience, the frequency analysis result 7504 of a pixel whose color gamut determination result 221 is "other" is assumed to be 0.

Operations of the frequency analyzing unit 7503 will be described using a specific example.

Figures 39A, 39B:
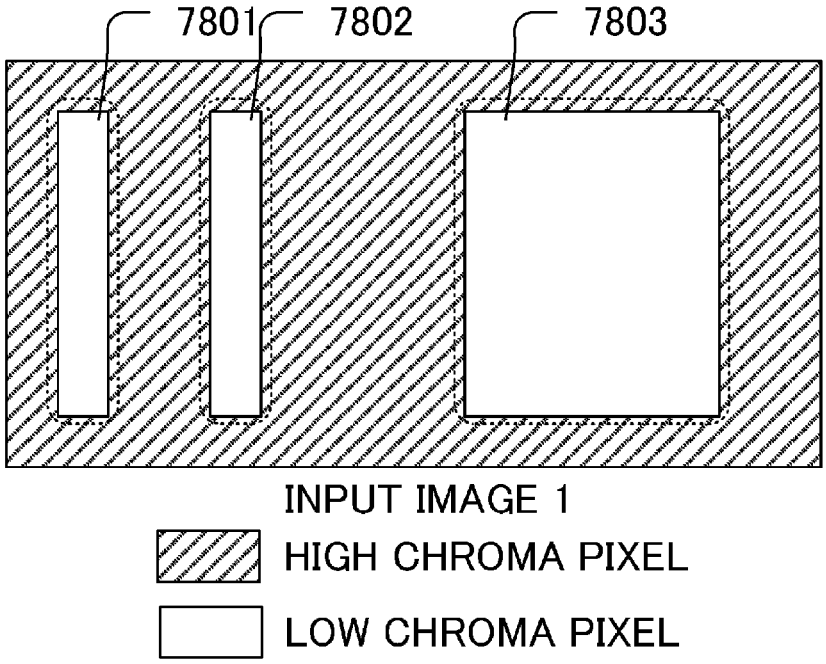

FIG. 39A shows an example of the input image 1 that is inputted to the image display device according to the eighth embodiment. In the drawing, low chroma pixels represent pixels having pixel values whose color gamut determination result 221 is M1 and high chroma pixels represent pixels having pixel values whose color gamut determination result 221 is "other". FIG. 39B shows a conceptual diagram of 1 subframe's worth of brightness values that are accumulated by the frequency analyzing unit 7503 when this image is inputted. In FIG. 39B, each of the blocks arranged in a grid pattern correspond to one pixel of the double speed input image 11. In addition, a numerical value in each block represents the brightness value of the pixel. In this case, for the sake of convenience, the brightness values are normalized to a maximum value of 1 and a minimum value of 0. In FIG. 39B, the color gamut determination result 221 of the pixel groups of regions 7801, 7802, and 7803 enclosed by dashed lines is M1 and the color gamut determination result 221 of other pixels is "other". FIG. 39D shows a result of the frequency analyzing unit 7503 applying the HPF on the accumulated brightness values and obtaining the frequency analysis result 7504.

Figures 40A, 40B:
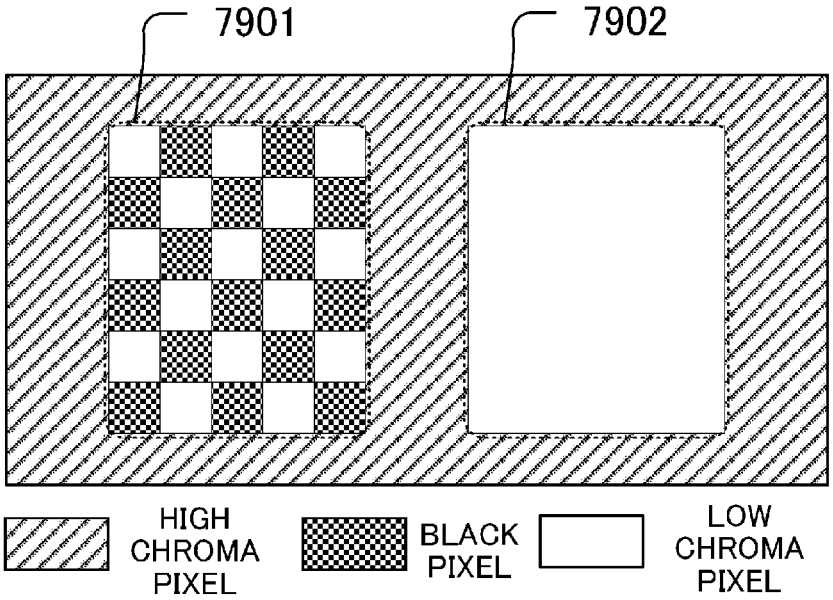

Next, a texture analyzing unit 7505 will be described. The texture analyzing unit 7505 obtains a dispersion value of each pixel based on the double speed input image 11 and the color gamut determination result 221 and outputs a texture analysis result 7506. For example, while a region 7901 having a black and white checkered pattern as shown in FIG. 40A is a large-area region of low chroma pixels when classified according to chroma, the region has low color discrimination sensitivity. In the eighth embodiment, by analyzing texture, pixels belonging to such a region are collected in the first subframe in a process to be described later.

Specific processing by the texture analyzing unit 7505 will now be described. First, the texture analyzing unit 7505 obtains a brightness value of each pixel of the double speed input image 11 and accumulates 1 subframe's worth of the brightness values. Subsequently, for each pixel whose color gamut determination result is M1 or M2, the texture analyzing unit 7505 calculates a sum of absolute differences between the brightness value of the pixel and brightness values of 8 neighboring pixels of the pixel. A sum of absolute differences is calculated using the following equation.

$$T(i,\ j)=\sum_{a=-1}^{1}\sum_{b=-1}^{1}\mathrm{abs}(Y(i,\ j)-Y(i+a,\ j+b)), \qquad \text{[Expression 6]}$$

where i denotes a horizontal coordinate and j denotes a vertical coordinate of an object pixel on the double speed input image 11, T (i, j) denotes a sum of absolute differences of the object pixel, Y (i, j) denotes a brightness value of the object pixel, and Y (i+a, j+b) denotes a brightness value of a pixel at a horizontal coordinate of i+a and a vertical coordinate of j+b. In addition, abs represents a function for obtaining an absolute value. The texture analyzing unit 7505 calculates the sum of absolute differences of all pixels and outputs the sum of absolute differences as a texture analysis result 7506. For the sake of convenience, the texture analysis result 7506 of a pixel whose color gamut determination result 221 is "other" is assumed to be 0.

Operations of the texture analyzing unit 7505 will be described using a specific example.

FIG. 40A shows an example of the input image 1 that is inputted to the image display device according to the eighth embodiment. In the drawing, low chroma pixels and black pixels represent pixels having pixel values whose color gamut determination result 221 is M1 and high chroma pixels represent pixels having pixel values whose color gamut determination result 221 is "other". FIG. 40B shows 1 subframe's worth of brightness values that are accumulated by the texture analyzing unit 7505 when this image is inputted. In this case, for the sake of convenience, the brightness values are normalized to a maximum value of 1 and a minimum value of 0. FIG. 40C shows the texture analysis result 7506 that is obtained based on the accumulated brightness values. Numerical values in the drawing represent the texture analysis results 7506 of the respective pixels.

Figure 41:
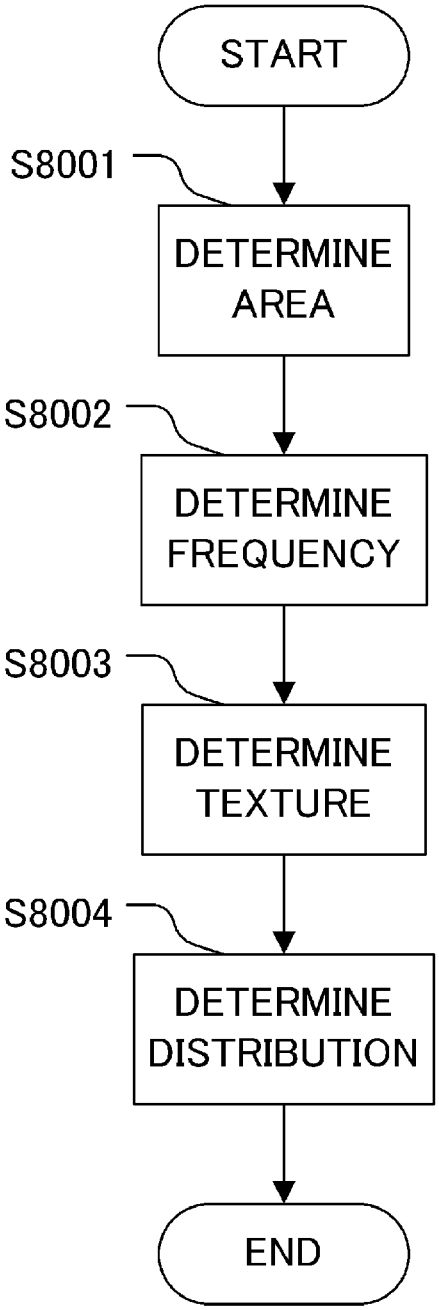
FIG. 41 is a flowchart showing processing performed by a distribution determining unit 7507.

Next, a distribution determining unit 7507 will be described. Based on the color gamut determination result 221, the double speed timing signal 12, the area analysis result 7502, the frequency analysis result 7504, and the texture analysis result 7506, the distribution determining unit 7507 determines a ratio at which each pixel of the double speed input image is to be distributed between the first subframe and the second subframe. FIG. 41 is a flow chart showing processing performed by the distribution determining unit 7507.

In step S8001, the distribution determining unit 7507 performs area determination by obtaining an area per label from the area analysis result 7502 and obtains an area determination result per pixel. Specifically, first, for each label, the distribution determining unit 7507 counts the number of pixels to which the label is assigned and sets the number of pixels as an area of the label. An area determination result of a pixel to which is assigned a label representing an area smaller than a threshold is assumed to be 1. In addition, an area determination result of a pixel to which is assigned a label representing an area equal to or larger than the threshold is assumed to be 0. However, an area determination result of a pixel to which is assigned the label Z is assumed to be 0 regardless of the area.

The operation of step S8001 will be described using the area analysis result 7502 shown in FIG. 38C as an example. In this example, the area of the label A is 4, the area of the label B is 30, and the area of the label C is 4. By setting the threshold to 5, the area determination result of pixels to which are assigned the label A and the label C is 1, the area determination result of pixels to which are assigned the label B is 0, and the area determination result of pixels to which are assigned the label Z is 0.

In step S8002, the distribution determining unit 7507 performs frequency determination based on the frequency analysis result 7504 and obtains a frequency determination result for each pixel. The distribution determining unit 7507 sets the frequency determination result of pixels whose frequency analysis result 7504 is equal to or greater than a threshold to 1 and sets the frequency determination result of pixels whose frequency analysis result 7504 is smaller than the threshold to 0.

The operation of step S8002 will be described using the frequency analysis result 7504 shown in FIG. 39D as an example. Assuming that the threshold is 6, the frequency determination result of the pixels in a region 7801 and a region 7802 is 1 and the frequency determination result of other pixels is 0.

In step S8003, the distribution determining unit 7507 performs texture determination based on the texture analysis result 7506 and the area analysis result 7502 and obtains a texture determination result for each pixel. Specifically, first, the distribution determining unit 7507 calculates an average value of the texture analysis result 7506 for each label in the area analysis result 7502. A texture determination result of a pixel to which is assigned a label representing an average value that is equal to or greater than a threshold is assumed to be 1. A texture determination result of a pixel to which is assigned a label representing an average value that is smaller than the threshold is assumed to be 0. However, a texture determination result of a pixel to which is assigned the label Z is assumed to be 0 regardless of an average value of the texture analysis result.

A concept of step S8003 will be described using the input image 1 shown in FIG. 40A as an example. FIG. 40C shows the texture analysis result 7506 when the input image 1 shown in FIG. 40A is inputted to the image display device according to the eighth embodiment, and FIG. 40D shows the area analysis result 7502 when the input image 1 shown in FIG. 40A is inputted to the image display device according to the eighth embodiment. In this case, a texture analysis result average value of the label A is 4.3 and a texture analysis result average value of the label B is 1.0. By setting the threshold to 4, the texture determination result of pixels to which are assigned the label A is 1 and the texture determination result of pixels to which are assigned the label B is 0. In addition, the texture determination result of pixels to which are assigned the label Z is 0 regardless of the texture analysis result.

Figure 42:
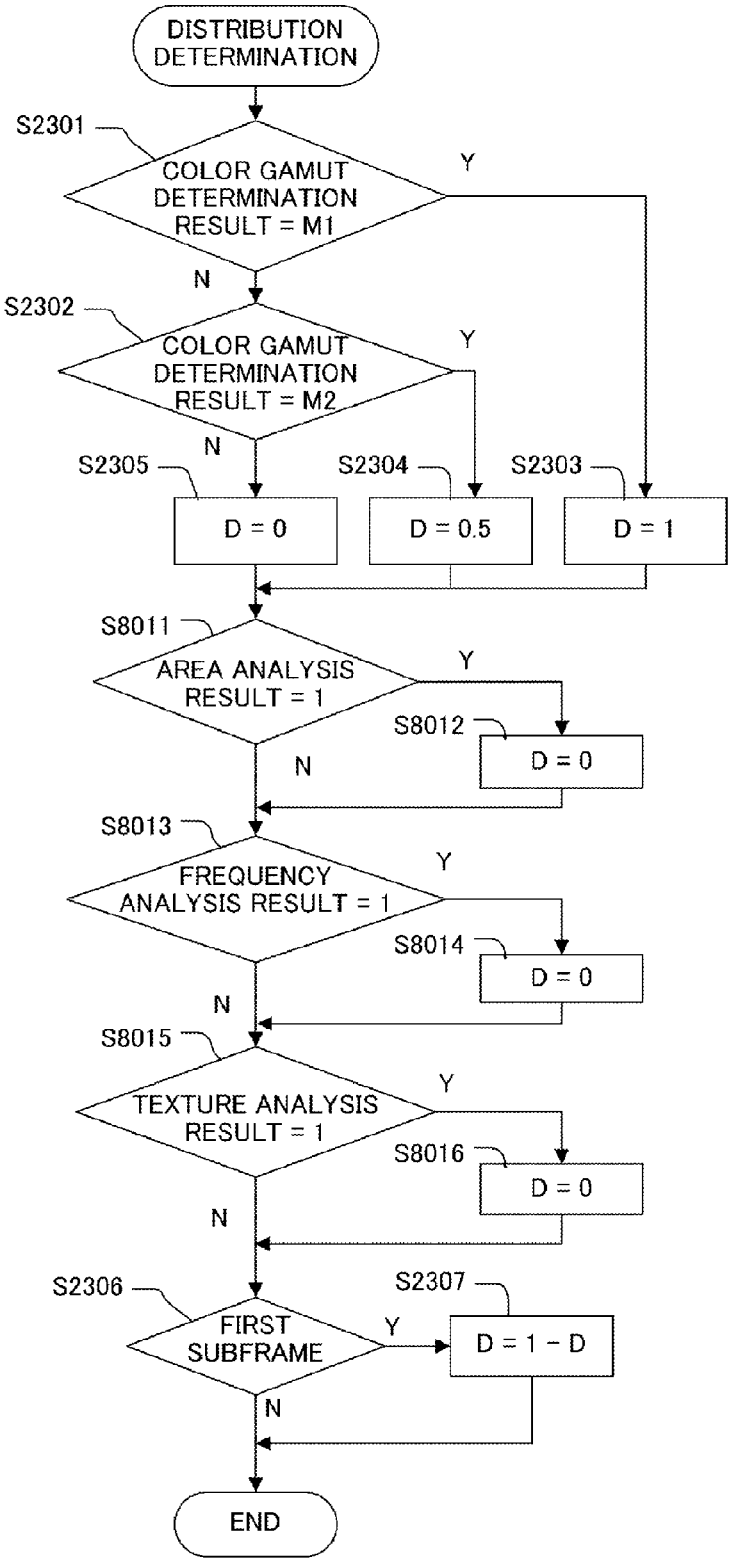
FIG. 42 is a flow chart showing a process of step S8004.

In step S8004, based on the color gamut determination result 221 and the area determination result, the frequency determination result, and the texture determination result obtained in steps S8001 to S8003, the distribution determining unit 7507 obtains the display ratio D for each pixel. FIG. 42 shows a flow chart of processing for obtaining the display ratio D. Values of 0 to 1 of the display ratio D correspond to distribution ratios of 0% to 100%. In addition, since steps S2301 to S2307 are similar to those in the flow chart shown in FIG. 9, a description thereof will be omitted.

In step S8011, when the area determination result of an object pixel is 1, the distribution determining unit 7507 proceeds to step S8012. Otherwise, the distribution determining unit 7507 proceeds to step S8013.

In step S8012, the distribution determining unit 7507 changes the display ratio D of the object pixel to 0.

In step S8013, when the frequency determination result of the object pixel is 1, the distribution determining unit 7507 proceeds to step S8014. Otherwise, the distribution determining unit 7507 proceeds to step S8015.

In step S8014, the distribution determining unit 7507 changes the display ratio D of the object pixel to 0.

In step S8015, when the texture determination result of the object pixel is 1, the distribution determining unit 7507 proceeds to step S8016. Otherwise, the distribution determining unit 7507 proceeds to step S2306.

In step S8016, the distribution determining unit 7507 changes the display ratio D of the object pixel to 0.

The distribution determining unit 7507 obtains the display ratio D of all pixels according to the procedure described above. In addition, the distribution determining unit 7507 outputs information on the obtained display ratio D of each pixel as the display ratio 21.

As described earlier, since components other than the color gamut determining unit 20 are approximately similar to those of the first embodiment, a description thereof will be omitted.

Next, operations of the image display device shown in the eighth embodiment will be described using a specific input image as an example. FIGS. 38A, 39A, and 40A used to describe the respective processes of the color gamut determining unit 20 according to the eighth embodiment will be used as examples of the input image.

Figure 43A:
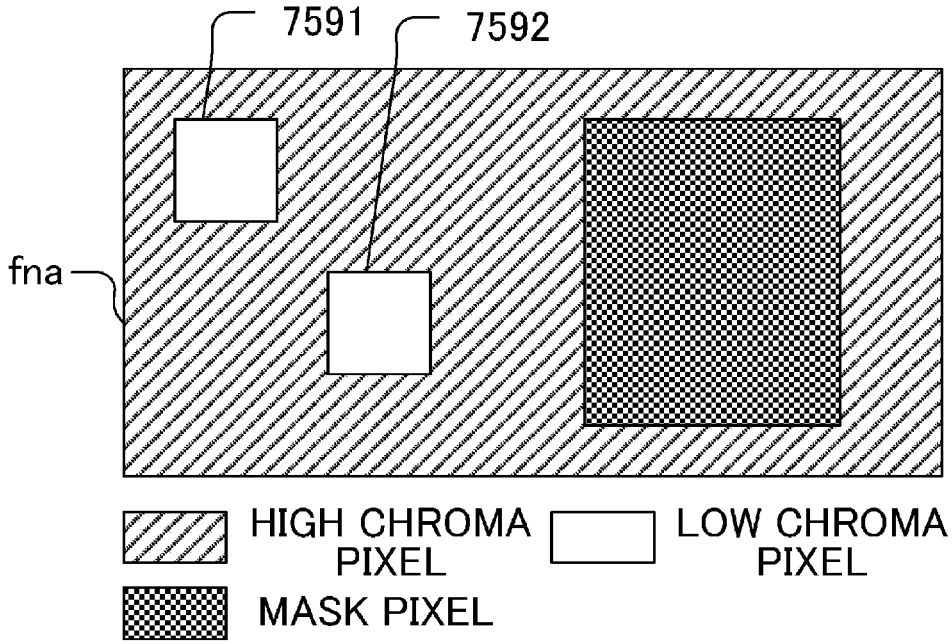
FIGS. 43A and 43B are diagrams illustrating operation examples according to the eighth embodiment.
Figure 43B:
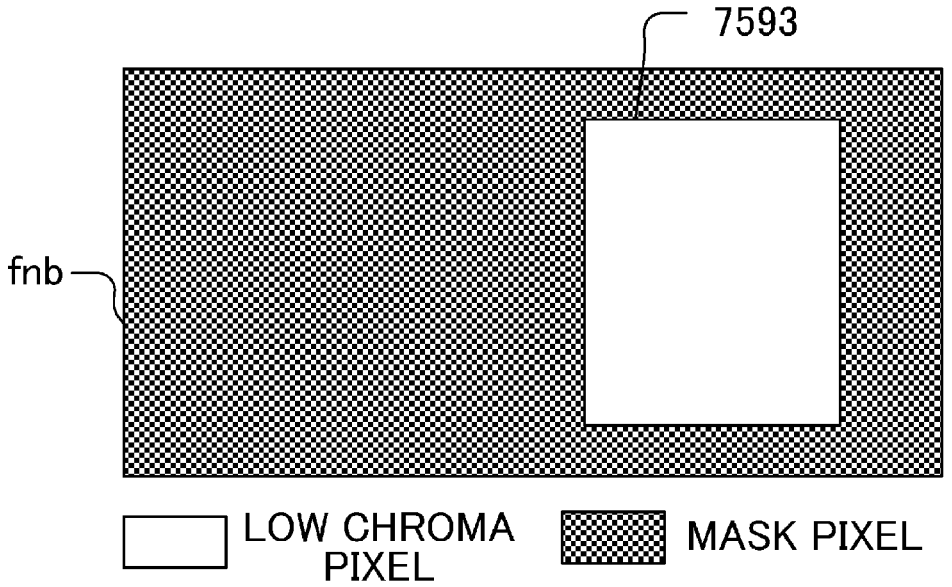

FIG. 43A shows display contents of the first subframe and FIG. 43B shows display contents of the second subframe when the input image 1 shown in FIG. 38A is inputted. Even among regions made up of low chroma pixels, a region 7591 and a region 7592 with small areas as shown in FIG. 38A are displayed in the first subframe by the area determination process. Therefore, a boundary portion between the region 7591 and the region 7592 that are made up of low chroma pixels and peripheral regions thereof made up of high chroma pixels does not constitute a boundary between an image component displayed in the first subframe and an image component displayed in the second subframe. Accordingly, even if the observer visually tracks these small-area regions, the occurrence of a rise in brightness, a decline in brightness, or color mixing around the small-area regions is suppressed. Since individual variability in perception is unlikely to occur in a small-area region, displaying a small-area region with low chroma in the first subframe in which a wide color gamut light source is used does not pose a major problem in terms of individual variability in perception. On the other hand, since a region 7593 of low chroma pixels with a large area is displayed in the second subframe, individual variability in perception can be reduced. In addition, since high chroma pixels are displayed in the first subframe, the high chroma pixels can be displayed over a wide color gamut.

Figure 44A:
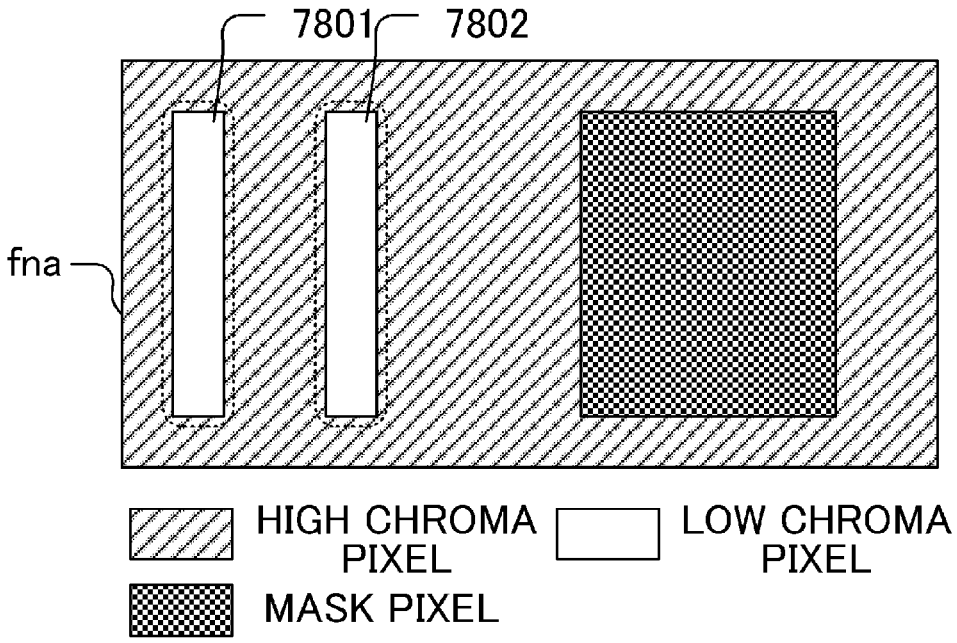
FIGS. 44A and 44B are diagrams illustrating operation examples according to the eighth embodiment.
Figure 44B:
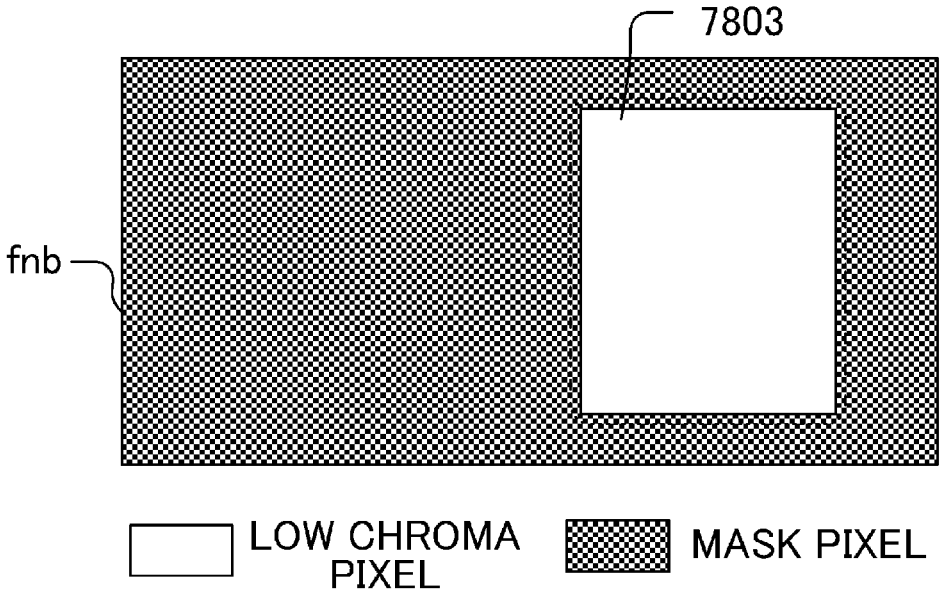

Next, FIG. 44A shows display contents of the first subframe and FIG. 44B shows display contents of the second subframe when the input image 1 shown in FIG. 39A is inputted. Even among regions made up of low chroma pixels, a region 7801 and a region 7802 with high frequency such as a thin line as shown in FIG. 39A are displayed in the first subframe by the frequency determination process. Therefore, a boundary portion between the region 7801 and the region 7802 that are made up of low chroma pixels and peripheral regions thereof made up of high chroma pixels does not constitute a boundary between an image component displayed in the first subframe and an image component displayed in the second subframe. Accordingly, even if the observer visually tracks these high frequency regions, the occurrence of a rise in brightness, a decline in brightness, or color mixing around the high frequency regions is suppressed. Since individual variability in perception is unlikely to occur in a high frequency region, displaying a high frequency region with low chroma in the first subframe in which a wide color gamut light source is used does not pose a major problem in terms of individual variability in perception. On the other hand, since the region 7593 of low chroma pixels with low frequency is displayed in the second subframe, individual variability in perception can be reduced. In addition, since high chroma pixels are displayed in the first subframe, the high chroma pixels can be displayed over a wide color gamut.

Figure 45A:
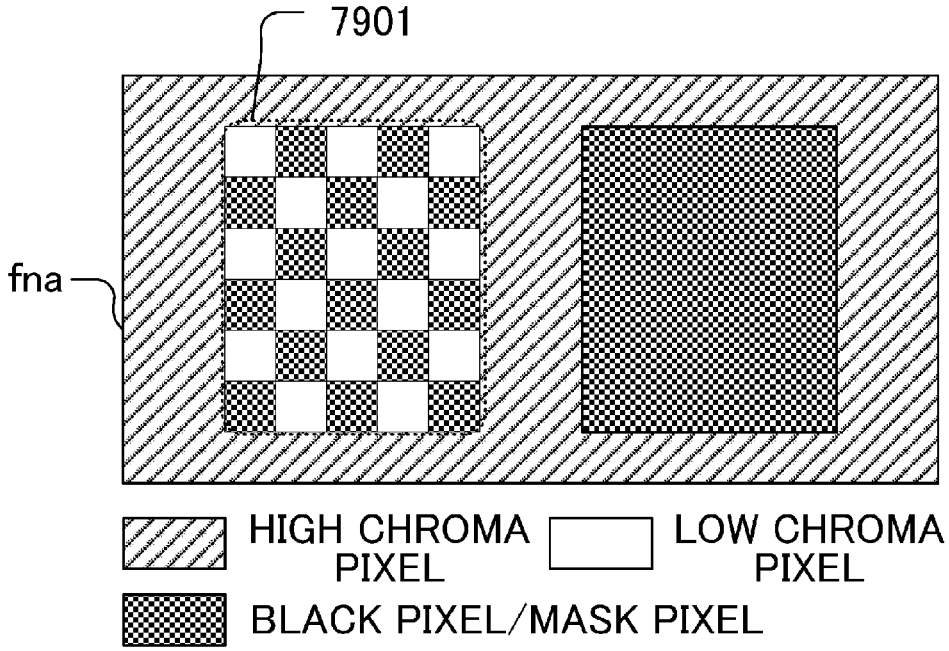
FIGS. 45A and 45B are diagrams illustrating operation examples according to the eighth embodiment.
Figure 45B:
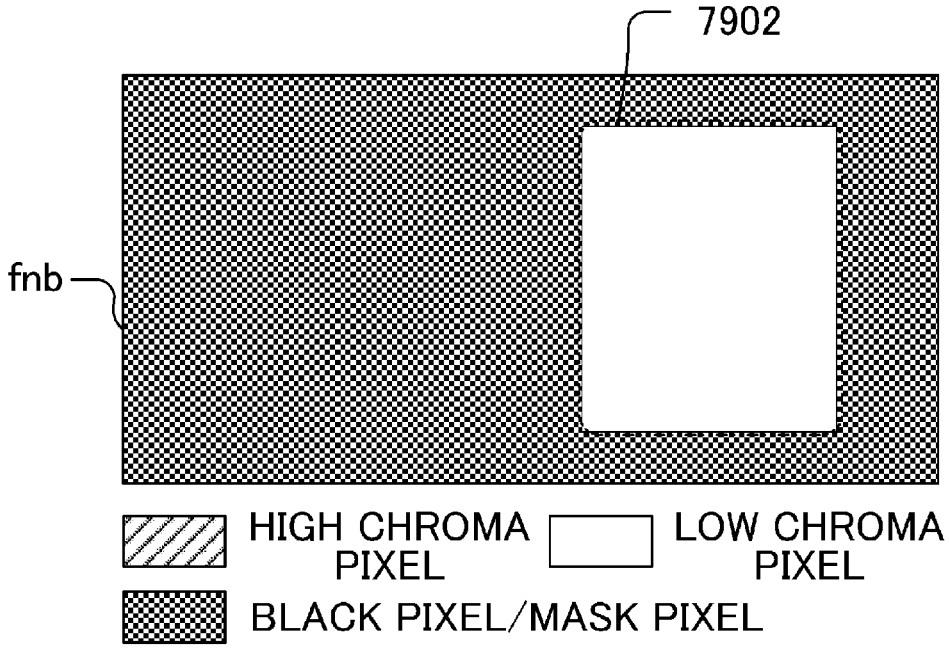

Next, FIG. 45A shows display contents of the first subframe and FIG. 45B shows display contents of the second subframe when the input image 1 shown in FIG. 40A is inputted. Even among regions made up of low chroma pixels, a region 7901 with an intricate pattern such as the checkered pattern shown in FIG. 40A is displayed in the first subframe by the texture determination process. Therefore, a boundary portion between the region 7901 that is made up of low chroma pixels and peripheral regions thereof made up of high chroma pixels does not constitute a boundary between an image component displayed in the first subframe and an image component displayed in the second subframe. Accordingly, even if the observer visually tracks the region with an intricate pattern, the occurrence of a rise in brightness, a decline in brightness, or color mixing around the region with an intricate pattern is suppressed. Since individual variability in perception is unlikely to occur in a region with an intricate pattern, displaying a region with an intricate pattern with low chroma in the first subframe in which a wide color gamut light source is used does not pose a major problem in terms of individual variability in perception. On the other hand, since a region 7902 of low chroma pixels that does not have an intricate pattern is displayed in the second subframe, individual variability in perception can be reduced. In addition, since high chroma pixels are displayed in the first subframe, the high chroma pixels can be displayed over a wide color gamut.

According to the configuration and procedures described above, a boundary between an image component displayed in the first subframe and an image component displayed in the second subframe at which a rise in brightness, a decline in brightness, or color mixing is likely to occur when the observer visually tracks an image displayed on the image display device can be reduced.

While regions made up of pixels with low chroma among regions with small areas, regions with high frequency, and regions with intricate textures are collected in the first subframe in the eighth embodiment, conversely, regions made up of pixels with high chroma may be collected in the second subframe. In addition, a configuration may be adopted in which a mode can be instructed (specified) from the control unit 90 as in the seventh embodiment, in which case a selection may be made regarding whether a region made up of low chroma pixels among regions with small areas, regions with high frequency, and regions with intricate textures (regions having a pattern with a high degree of complexity) is to be collected in the first subframe or a region made up of high chroma pixels among regions with small areas, regions with high frequency, and regions with intricate textures is to be collected in the second subframe.

Furthermore, while the three results of an area determination result, a frequency determination result, and a texture determination result are used to calculate a display ratio in the eighth embodiment, all of the three determination results need not necessarily be used. A configuration in which only one of the three determination results is used or a configuration in which two of the three determination results are used in combination may be adopted. Among the area analyzing unit 7501, the frequency analyzing unit 7503, and the texture analyzing unit 7505 in the configuration of the color gamut determining unit 20 shown in FIG. 37, a unit whose determination result is not used may be omitted.

In addition, while a configuration of the color gamut determining unit 20 is described in the eighth embodiment using the first embodiment as an example, the configuration of the color gamut determining unit 20 according to the eighth embodiment may be used in combination with the other embodiments. For example, the color gamut determining unit 20 according to the second to fourth and sixth embodiments or the color gamut determining unit according to the fifth embodiment may be adopted as the configuration of the color gamut determining unit described in the eighth embodiment.

(Ninth Embodiment)

In the seventh embodiment, an example of application of the present invention to a direct-type image display device in which an image formed on a modulating unit that modulates transmittance of light from an illuminating unit has been described. The present invention can also be applied to a projecting-type image display device in which an image formed on a modulating unit that modulates transmittance or reflectance of light from an illuminating unit is projected onto a screen.

A configuration diagram of an image display device according to the ninth embodiment of the present invention is approximately similar to the configuration diagram (FIG. 17) according to the fourth embodiment. By replacing the configuration of the color gamut determining unit 20 shown in FIG. 17 with the configuration of the color gamut determining unit 20 described in the seventh embodiment, the present invention can also be applied to a projecting-type image display device.

According to the configuration and procedures described above, a rise in brightness, a decline in brightness, or color mixing which is perceived when the observer visually tracks an image displayed on an image display device can be reduced even in the case of a projecting-type image display device.

(Tenth Embodiment)

In the eighth embodiment, an example of application of the present invention to a direct-type image display device in which an image formed on a modulating unit that modulates transmittance of light from an illuminating unit has been described. The present invention can also be applied to a projecting-type image display device in which an image formed on a modulating unit that modulates transmittance or reflectance of light from an illuminating unit is projected onto a screen.

A configuration diagram of an image display device according to the tenth embodiment of the present invention is approximately similar to the configuration diagram (FIG. 17) according to the fourth embodiment. By replacing the configuration of the color gamut determining unit 20 shown in FIG. 17 with the configuration of the color gamut determining unit 20 described in the eighth embodiment, the present invention can also be applied to a projecting-type image display device.

According to the configuration and procedures described above, a boundary portion between image components at which a rise in brightness, a decline in brightness, or color mixing perceived when the observer visually tracks an image displayed on an image display device occurs can be reduced even in the case of a projecting-type image display device.

Moreover, the seventh to tenth embodiments can be applied to all image display devices which separate an input image into a first image component and a second image component according to prescribed conditions, which display the first image component in a first subframe period, and which display the second image component in a second subframe period. While examples in which an input image is separated into a first image component and a second image component according to conditions that chroma of a pixel belongs to any of M1, M2, and "other" have been described in the seventh to tenth embodiments, conditions applied to the separation into subframes are not limited to the chroma of pixels. In addition, while examples in which one frame is separated into two subframes have been described, the number of subframes is not limited thereto. Furthermore, while examples in which a light source that is lighted during the first subframe period and a light source that is lighted during the second subframe period are light sources with different spectra have been described in the seventh to tenth embodiments, methods of lighting the light sources are not limited thereto. The problem in which a change in brightness or color mixing is inadvertently perceived at a boundary portion between image components when an observer visually tracks the boundary portion and which can be solved by the seventh to tenth embodiments occurs regardless of the spectrum of the light source that is lighted in each subframe. In other words, this is a phenomenon that occurs when the observer performs visual tracking in a configuration which separates an input image into a plurality of image components and which temporally separates and displays the image components in different subframe periods even if the light source that is lighted in each subframe is the same. Therefore, the configurations according to the seventh to tenth embodiments can be applied to image display devices other than those configured so that a light source with a different spectrum is lighted in each subframe. As a result, an effect of suppressing a change in brightness or color mixing when an observer performs visual tracking can be produced.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-066613, filed on Mar. 27, 2013, and Japanese Patent Application No. 2013-259258, filed on Dec. 16, 2013, which are hereby incorporated by reference herein in their entirety.

What is claimed is:

1. An image display device that displays an image, the image display device comprising:

(a) a backlight device including a plurality of light sources;

(b) a separator configured to divide an input image into a first image component and a second image component;

(c) a modulator configured to modulate light from the backlight device based on (i) the first image component in a first period within a display period of the image and (ii) the second image component in a second period within a display period of the image; and (d) a controller configured to control the backlight device so as to emit first light in the first period and to emit second light in the second period, wherein each of the first light and the second light includes red light, green light, and blue light; and wherein a spectrum of the second light has wider band characteristics than a spectrum of the first light.

2. The image display device according to claim 1, wherein the separator distributes pixels belonging to a prescribed color gamut including a white point among pixels of the input image to a first image component and a second image component at a first ratio and distributes pixels not belonging to the prescribed color gamut to the first image component and the second image component at a second ratio.

3. The image display device according to claim 2, wherein, with regard to pixels belonging to the prescribed color gamut, the separator distributes a component of a prescribed color to a first image component and a second image component at the first ratio and distributes a component other than the prescribed color to the first image component and the second image component at a third ratio.

4. The image display device according to claim 1, wherein the backlight device includes a plurality of first light sources, each of the first light sources emitting light of a color corresponding to each of red, green, and blue and a second light source that emits white light, wherein the first light is white light that is a composite of light emitted by the plurality of first light sources, and wherein the second light is white light emitted by the second light source.

5. The image display device according to claim 1, wherein the backlight device includes a plurality of first light sources, each of the first light sources emitting light of a color corresponding to each of red, green, and blue, and a plurality of second light sources, each of the second light sources emitting light of a color corresponding to each of red, green, and blue and having a wider spectrum as compared to the light emitted by each of the plurality of first light sources, wherein the first light is white light that is a composite of light emitted by the plurality of first light sources, and wherein the second light is white light that is a composite of light emitted by the plurality of second light sources.

6. The image display device according to claim 1, wherein the backlight device includes a plurality of first light sources, each of the first light sources emitting light of a color corresponding to each of red, green, and blue, and a second light source which emits light of a color corresponding to a prescribed color and which has a wider spectrum as compared to the light of a color corresponding to the prescribed color that is emitted by the first light sources, wherein the first light is white light that is a composite of light emitted by the plurality of first light sources, and wherein the second light is white light that is a composite of the light emitted by the second light source and light of a color corresponding to a color other than the prescribed color that is emitted by the first light sources.

7. The image display device according to claim 1, wherein the backlight device includes a plurality of first light sources, each of the first light sources emitting light of a color corresponding to each of red, green, and blue and a second light source which emits light of a color corresponding to a prescribed color and which has a different peak wavelength as compared to the light of a color corresponding to the prescribed color that is emitted by the first light sources, wherein the first light is white light that is a composite of light emitted by the plurality of first light sources, and wherein the second light is white light that is a composite of the light emitted by the plurality of first light sources and the light emitted by the second light source.

8. The image display device according to claim 2, wherein the prescribed color gamut is a color gamut that is not wider than a displayable color gamut when the backlight device emits the second light.

9. The image display device according to claim 2, wherein the prescribed color gamut is a low chroma color gamut.

10. The image display device according to claim 2, wherein, in a case where the distribution is made at the first ratio, more pixels are distributed to the second image component than the first image component, and wherein, in a case where the distribution is made at the second ratio, more pixels are distributed to the first image component than to the second image component.

11. The image display device according to claim 1, wherein a wavelength range in which a sensitivity equals or exceeds a first reference in both a color matching function that is furthest on a short wavelength side and a color matching function that is furthest on a long wavelength side in a model of fluctuation due to individual variability of color matching functions is assumed to be a sensitive wavelength range, and wherein an intensity of a spectrum of light of a prescribed color that is included in the second light equals or exceeds a second reference across an entire sensitive wavelength range of a color matching function corresponding to the prescribed color.

12. The image display device according to claim 11, wherein the first reference a sensitivity that is ¾ of a peak sensitivity, and wherein the second reference an intensity that is ½ of a peak intensity in the sensitive wavelength range.

13. The image display device according to claim 1, wherein a spectrum of light of a prescribed color that is included in the second light has a plurality of peak wavelengths, wherein a peak wavelength that is furthest on a short wavelength side among the plurality of peak wavelengths is a shorter wavelength than a peak wavelength of a color matching function that is furthest on a short wavelength side in a fluctuation model of individual variability of a color matching function corresponding to the prescribed color, and wherein a peak wavelength that is furthest on a long wavelength side among the plurality of peak wavelengths is a longer wavelength than a peak wavelength of a color matching function that is furthest on a long wavelength side in a fluctuation model of individual variability of a color matching function corresponding to the prescribed color.

14. The image display device according to claim 1, further comprising a light transmitting unit having transmission wavelength characteristics corresponding to red, green, and blue respectively, wherein the modulator modulates light transmitted through the light transmitting unit based on an image signal, and wherein a spectrum of light of a prescribed color that is included in the second light has a plurality of peak wavelengths and all of the plurality of peak wavelengths are within a transmission wavelength range of the light transmitting unit corresponding to the prescribed color.

15. The image display device according to claim 1, wherein the separator distributes pixels belonging to a prescribed color gamut including a white point among pixels of the input image to a first image component and a second image component at a first ratio and distributes pixels not belonging to the prescribed color gamut to the first image component and the second image component at a second ratio, and wherein the separator further distributes pixels which are in a region constituted by one of pixels belonging to the prescribed color gamut and pixels not belonging to the prescribed color gamut and which satisfy prescribed conditions to a first image component and a second image component at a same ratio as the other one of pixels belonging to the prescribed color gamut and pixels not belonging to the prescribed color gamut.

16. The image display device according to claim 15, wherein the pixels satisfying the prescribed conditions are pixels of a moving region and a periphery thereof, pixels of a region whose area is smaller than a threshold, pixels whose spatial frequencies are equal to or higher than a threshold, or pixels of a region with a pattern whose degree of complexity is equal to or higher than a threshold.

17. The image display device according to claim 16, wherein the distribution of pixels of an input image to a first image component and a second image component by the separator includes a first mode and a second mode, wherein, in the first mode, the separator distributes pixels satisfying the prescribed conditions to the first image component and the second image component at a first ratio regardless of whether or not the pixels belong to the prescribed color gamut, and wherein, in the second mode, the separator distributes pixels satisfying the prescribed conditions to the first image component and the second image component at a second ratio regardless of whether or not the pixels belong to the prescribed color gamut.

18. The image display device according to claim 1, wherein the first image component is a high chroma image component, and wherein the second image component is a low chroma image component.

* * * * *